US011607085B2

(12) United States Patent
Cook

(10) Patent No.: US 11,607,085 B2
(45) Date of Patent: Mar. 21, 2023

(54) SHOWER PANS AND RELATED LINEAR DRAIN CONFIGURATIONS

(71) Applicant: Tile Redi, LLC, Charlotte, NC (US)

(72) Inventor: Joseph R. Cook, Parkland, FL (US)

( * ) Notice: Subject to any disclaimer, the term of this patent is extended or adjusted under 35 U.S.C. 154(b) by 0 days.

(21) Appl. No.: 16/712,421

(22) Filed: Dec. 12, 2019

(65) Prior Publication Data

US 2022/0192433 A1 Jun. 23, 2022

(51) Int. Cl.
*A47K 3/40* (2006.01)

(52) U.S. Cl.
CPC ..... *A47K 3/40* (2013.01)

(58) Field of Classification Search
CPC ..... A47K 3/40
USPC ..... 4/613
See application file for complete search history.

(56) References Cited

U.S. PATENT DOCUMENTS

| | | | | |
|---|---|---|---|---|
| 11,406,228 | B2 * | 8/2022 | Cook | E03C 1/0408 |
| 2006/0213006 | A1 * | 9/2006 | Rush, Jr. | A47K 3/40 4/613 |
| 2011/0197355 | A1 * | 8/2011 | Lemire | A47K 3/405 4/613 |
| 2013/0276226 | A1 * | 10/2013 | Cook | A47K 3/40 4/613 |
| 2014/0033424 | A1 * | 2/2014 | Cook | B29C 45/14 29/428 |
| 2014/0041112 | A1 * | 2/2014 | Cook | A47K 3/40 29/428 |
| 2014/0175700 | A1 * | 6/2014 | Cook | B29C 45/376 264/297.1 |
| 2020/0214510 | A1 * | 7/2020 | Brill | A47K 3/405 |

* cited by examiner

*Primary Examiner* — Jeremy Carroll
(74) *Attorney, Agent, or Firm* — Moore & Van Allen PLLC

(57) ABSTRACT

A drainable floor and linear drain, the drainable floor having an integral trench associated therewith, the trench comprising sidewall and a trench floor, and one or more floor covering panels positioned in registry with the drainable floor, where the one or more floor covering panels cover a portion of the projection of the trench floor, while leaving at least one other portion of the trench floor uncovered by such one or more floor covering panels.

31 Claims, 63 Drawing Sheets

SHOWER PANS AND RELATED LINEAR DRAIN CONFIGURATIONS

BACKGROUND OF THE INVENTION

Field of the Invention

The present invention relates generally to showers and other drainable structures, and associated trench (i.e., elongated) drains, and to shower trenches associated with any drain, and more particularly to shower pans with trench drains or shower trenches with associated drains, or both, where the dimensions of the trench may be different from the dimensions of the drainage apertures through which water drains into the trench.

Description of the Prior Art

Water can be drained from surfaces such as tables and floors by many different arrangements. For example, shower floors must have drains, i.e., apertures, positioned therein to permit water to drain into the wastewater drain in the subfloor. Linear, or elongated, drains have become popular for use in showers and elsewhere. Such drains are typically covered by apertured grates which conceal the interior of the trench and wastewater drain but which define slots, holes or other openings through which water drains. However, it is believed that consumers, for whatever reason, may be uncomfortable with the idea of standing on such apertured grates. This has tended to limit the use of linear drains to "end" drain locations, that is, locations adjacent to either the left or right side of the shower pan floor, or "rear" or "front" drain locations, which are near the rear of the floor furthest from the entry to the shower or at or near the shower entrance, respectively. This phenomenon, in turn, has limited the employment of shower trenches and trench drains for so-called "center" drain locations, where the person using the shower typically would stand. Consumers have shown a dislike for centrally located linear drains for a variety of reasons, including that they prefer not to stand on the grates which cover the linear drains, center linear drains in effect give the appearance of cutting the shower floor in half, and center linear drains cause users to change where they stand in the shower vis-à-vis the shower head. Also, objections have been raised to the inconvenience and difficulty of removing and manipulating the bulky and heavy linear drain covers to access the drain and clean the trench, particularly where the linear drain cover is tiled over, making it heavier and more difficult to handle, and where the linear drain is located around the perimeter of the shower. There is real risk that these large grates will damage surrounding wall and/or wall tile, as well as the tile on the drain cover if it is tiled. Many consumers will have difficulty in handling such grates when removing and manipulating them, and in institutional settings maintenance rather than housecleaning will be responsible for removing grates for cleaning purposes and fixing any damage done to other parts of the shower if and when a grate comes in contact with floor or wall coverings. The net effect of these and other objections to trenches not being consumer friendly has prevented shower trenches and trench drains from achieving the same kind of consumer acceptance as other drains, and has prevented consumers from enjoying the aesthetics of shower trenches and trench drains anywhere and everywhere in their shower.

Equally important, any consumer desiring a linear drain look in their shower will be able to accomplish the look of a linear drain, a shower trench, and a standard drain with a shower trench, with the solutions described herein, while also dramatically reducing the time, labor and cost of producing and/or installing a shower pan floor by reducing the time it takes to tile the shower, thereby also decreasing the cost of labor. Finally, this new shower installation/renovation solution will be equally friendly to both pro-installers and do-it-yourselfers, and, most importantly, this innovation will make it possible for all showers, regardless of location of the linear drain, trench drain, shower trench, trench grate or trench with a standard drain, since this solution will be available to all shower pan floors, including center, right, left, back, front and all other shower trench locations, trench drain locations, and shower drain and trench locations. However, there has not been a suitable solution for the use of linear drains in center drain locations, and the current solutions for linear drain locations not located around the perimeter of the shower have significant drawbacks related to the handling of the drain grates for purposes of accessing the linear drains for cleaning purposes and accessing the waste water pipe, sales of linear drains, shower trenches, trench drains, prefabricated shower pans employing centrally located linear drains, shower trench drains, or shower trenches associated with other shower drains, have been negatively affected, and this invention brings to the market a new solution for all linear drains which heretofore has not been available to the market, and which now benefits the market as a whole by providing solutions for linear drains and linear drain pans as well as additional solutions for all shower floors, along with those who just want the functionality of a trench drain without the look of the trench drain but the new sleek look of the linear drains and shower trenches and drains. This invention applies to all shower pans however made, including mud base and hot mop showers. The invention provides a variety of new looks that are available for all trench locations, reduced weight and length of the drain grates and covers, providing functional benefits in terms of removability and handling, being consumer and professional friendly both for installation, accessing the drain, and not being a maintenance headache that can chip floors and wall surfaces, it being light weight for cleaning folks in hospitality and consumer settings which requires plumbers or maintenance personnel rather than cleaning personnel to handle that aspect of cleaning thereby increasing the cost to both the institutional and consumer customers. Also, all linear drain installations benefit equally from the new looks, including allowing for two panel flooring solutions for all linear drain locations, together with a one panel flooring solution for certain perimeter locations. Of course, any flooring solution, including traditional rectangular tile, is perfectly suited for this invention.

Prefabricated waterproof shower pans have become the most effective solution for the construction of tileable shower and bath enclosures, as they provide a one-piece waterproof surface over which flooring and/or wall finishing material (such as tile) can be installed. Such pans are in wide use today.

In the design and manufacture of shower pans, it is necessary to provide means by which water can be directed to one or more drain openings by gravity. This is done by way of pitching, or sloping, the floor surface(s) from higher to lower positions on the pan floor, the lowest position(s) coinciding typically with the wastewater drain location(s). Given the myriad possible drain locations for any given shower arrangement, shower pan manufacturers must be able to produce pans having drains in whatever locations the customer specifies or the wastewater drain dictates. Minor variation in the location of the drain from one job to another, however, may mean developing an entirely new SKU (stock keeping unit) and/or drains and drain grates with the attendant manufacturing and inventorying costs.

In addition, most tiled shower pan floors have a multitude of areas that are pitched in different directions from each other, which requires the installer to apply finishing materials thereon (such as tile) and to cut or install the finishing materials where surfaces which are sloped in different directions intersect. In embodiments, to the greatest extent possible, therefore, it is desirable to have the pan floor pitched as a single planar surface. The use of trench drains simplifies the floor pitch dilemma to a great extent, but the size and required location of the trench often if not always determines the commercial appeal and ultimate acceptance of the product.

Many shower installations today utilize a centrally located drain, which necessitates the placement of a visible drain fixture somewhere in the tiled shower floor. Although consumers are accustomed to seeing drain fixtures somewhere on the tiled shower floor, and standing near or on the drain fixture, it would also be desirable to have a fully or partially concealed drain to improve the aesthetics of the shower installation (or bath or any other structure from which water is to be drained).

Wall panels for use in shower and bath installations have been around for a long time. However, that is not the case when it comes to floor panels covering surfaces such as tile and solid surface shower floors. Historically, large, flat floor finishing panels (i.e., tile or other decorative covering material) have been incompatible with the typical V-pitched shower pan floors due to the multiple areas on the shower pan floor that reside in different planes. From time to time, adventurous tile manufacturers have introduced V-shaped shower floor panels that mimicked the V-pitch in standard center drain pans, but with no meaningful commercial success. The limitations of both the shape and the aesthetics of such panels guaranteed limited market interest which is still the case today.

The ability to supply a multitude of shower pan SKUs using a relatively small number of associated removable and non-removable trench grates placed in trenches in different numbers, different sizes and different order, allows different looking shower floor configurations, whether created in the factory or in the field, while providing different numbers of both types of hidden and visible grates placed in the trench in any order desired by the customer, but without limiting the location of the waste water drain relative to the shower pan floor, provides a significant market advantage to a manufacturer.

Therefore, it is a principal object of this invention to provide a system and apparatus for shower installations having one or more of linear drains, trench drains, trench grates, shower trenches, and shower trenches associated with a shower drain therein, where the perceived dimensions of the drain and drain grate apparatus varies from the actual dimensions of the trench to provide the ornamental appearance that the drain apparatus being employed is relatively small.

It is also a principal object of this invention to provide a system and apparatus for shower installations having linear drains, linear drain grates and trench drains therein, where the perceived dimensions of the drain apparatus varies from the actual dimensions of the trench, and while simultaneously fully supporting floor covering panels installed over the trench and providing the appearance that it is safe to put weight on the entire solid surface of the shower floor.

Another principal object of the invention is to provide consumers and large project professionals alike unlimited shower floor designs through different combinations of linear drains, shower floor panels and trench grate combinations using different combinations and sizes of removable drain grates and non-removable substrate grates, while also providing sufficient drainage into the trench, thereby providing a design choice that won't damage the surrounding wall and floor coverings as is the case with the existing cumbersomely large and heavy grates currently in use which require professionals to remove these large grates to reduce the risk of damaging the surrounding wall and/or floor covering, rather than consumers or housekeeping personnel removing the grates.

It is another object of this invention to provide shower pans, including prefabricated shower pans, partially prefabricated pans, mud bases, hot mopped shower bases, and all other shower pans, having linear drains and monolithic (i.e., large, single piece and double piece) floor panel sections which non removably cover at least a portion of the trench while providing a wide variety of shower floor drain grate configurations and having the appearance that the linear trench is smaller than it actually is.

SUMMARY OF THE INVENTION

These and other objects are carried out through the provision of shower pans into which, or in connection with which, one or more linear drains are incorporated, and the resulting products. Such resulting products may be the product of linear drains, trenches molded into single piece prefabricated shower pans, trenches incorporated into multi-piece shower pan solutions, standalone trenches combined with any type of shower pan/base, prefabricated shower trenches incorporated into any type of shower pan/base, any pre-fabricated trench installed or fabricated in any shower pan, or any trench in a shower floor, where one or more removable and one or more non-removable drain covers are associated with the foregoing linear drains, trenches, drainable surfaces, shower floors and shower pans. One or more floor covering panels are then applied to the shower pan floor in such a way as to cover the entirety of the shower pan floor (other than drainage areas), while the panel or panels also cover at least a portion of the linear drain and trench. One or more of the panel or panels themselves, or their edges, define apertures (the aforementioned drainage areas) through which water may drain. "Floor covering panels" include all sizes and types of shower floor coverings, from small mosaic floor tiles to one and two piece monolithic shower floor panels, sourced from any appropriate materials, which include but are not limited to ceramic tile, porcelain tile, mosaic tiles, stone, marble, cultured marble, engineered stone, acrylic, polymeric material, all solid surface shower floor coverings, etc.

Employing the teachings of this invention permits a manufacturer to minimize the number of unique product SKUs which it manufactures and or inventories, while maximizing the number of unique solutions that can be offered to customers. In some embodiments, most or all shower floor grout lines are eliminated by the use of large (i.e., monolithic) floor covering members, creating a desirable visual effect. These benefits are achievable notwithstanding the ultimate location of the floor drain relative to the position of the trench in the shower pan floor, and irrespective of the location of the trench or trench drain relative to the floor. By simply providing floor panels in which suitable drainage area is defined, the consumer need not be concerned with such trivial considerations as how water is drained from the shower. The user just knows that he or she is in a beautiful, elegant, shower.

Embodiments are disclosed herein in which a shower product is produced using a shower pan and linear drain, which includes a shower pan floor, the shower pan having an integral trench associated therewith, and one or more floor covering panels positioned in registry with the shower pan floor, where the one or more floor covering panels cover a portion of the projection of the trench floor, while leaving at least one other portion of the trench floor uncovered by such one or more floor covering panels.

In connection with some of the embodiments, removable trench covers and/or grates may be employed over the portion of the trench floor which is left uncovered. The removable trench covers may be of the "tileable" or "non-tileable" type, depending upon the specifications of the designer of the installation, which may be the consumer in certain instances, or which may be the professional designer, architect or project engineer Embodiments are non-exclusively proposed herein that utilize one or more of: (i) removable trench covers; (ii) permanently installed linear trench covers and grates, (iii) only one floor panel; (iv) only two floor panels; (v) two or more different floor coverings; and (vi) linear drains. Removable trench covers and grates may be desirable to access the trench interior and/or trench drain for cleaning and maintenance purposes, although the inventions disclosed herein are not in any way dependent on the use of removable drain covers. The floor covering panels interact with each other by forming drainage slots over all or portions of one or more substrate or support grates, while simultaneously forming cutouts around the removable grates to allow them to be easily removed. In addition, permanently installed linear trench covers or grates may be employed over portions of linear drains that are covered by permanently installed floor covering panels to support the floor covering panels which reside over portions of the linear drain floor.

BRIEF DESCRIPTION OF THE DRAWINGS

FIG. 35B is an assembled perspective view of the fifth embodiment of the invention with a removable drain grate exploded out there from.

DETAILED DESCRIPTION OF EXEMPLARY EMBODIMENT(S)

Figure 1:
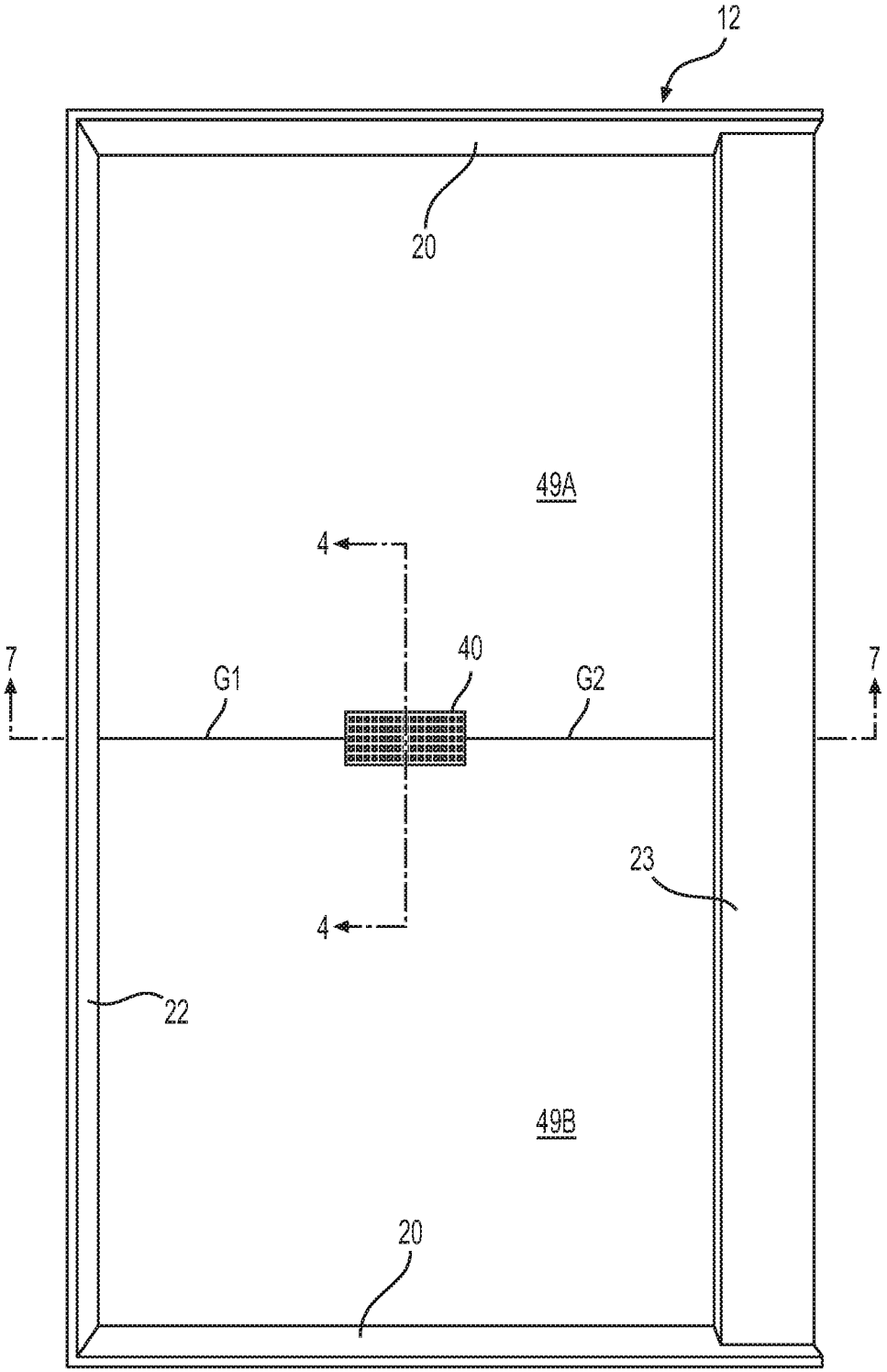
FIG. 1 is an assembled top plan view of a first embodiment of the invention.
Figure 2:
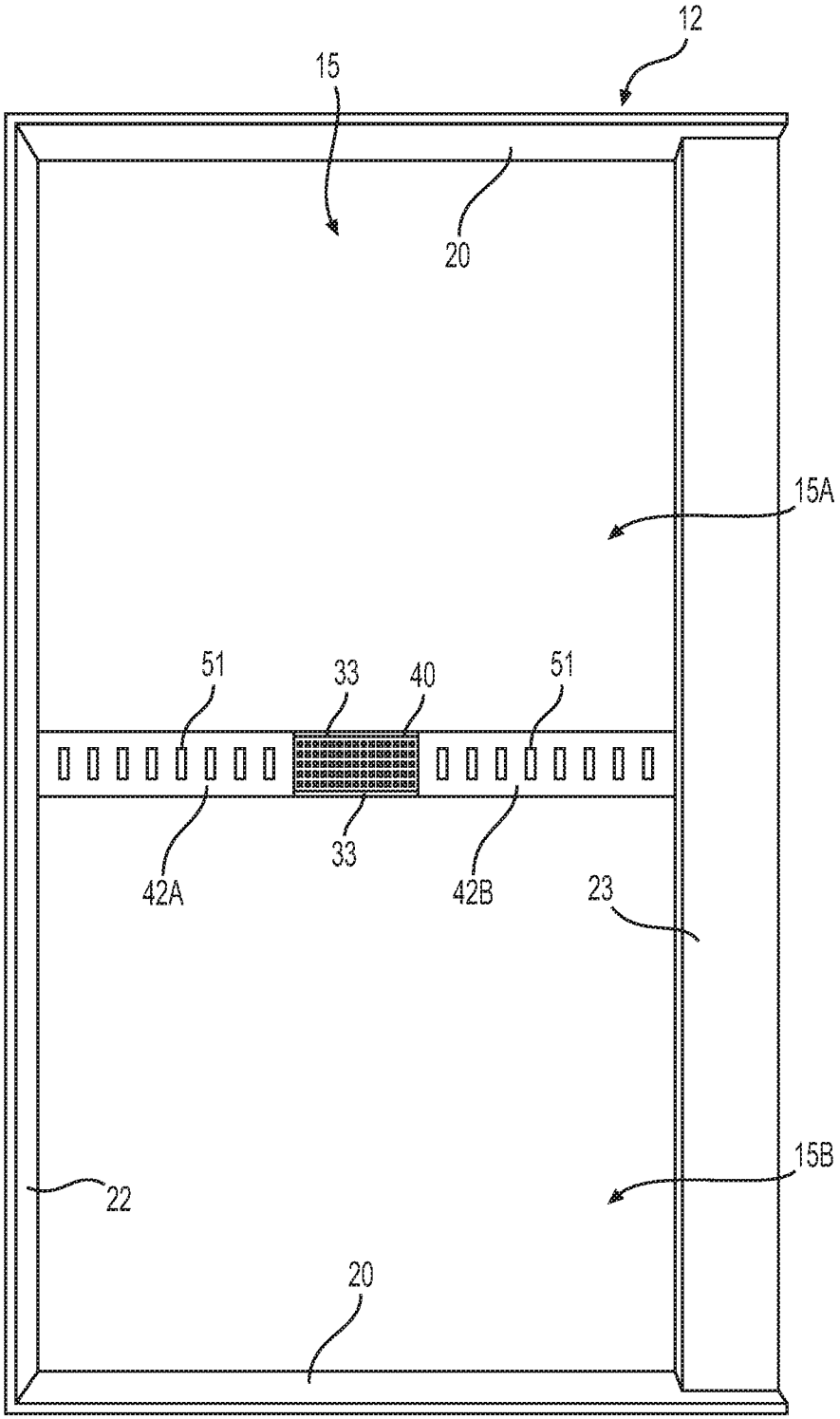
FIG. 2 is top plan view of the first embodiment of the invention with flooring removed.
Figure 3:
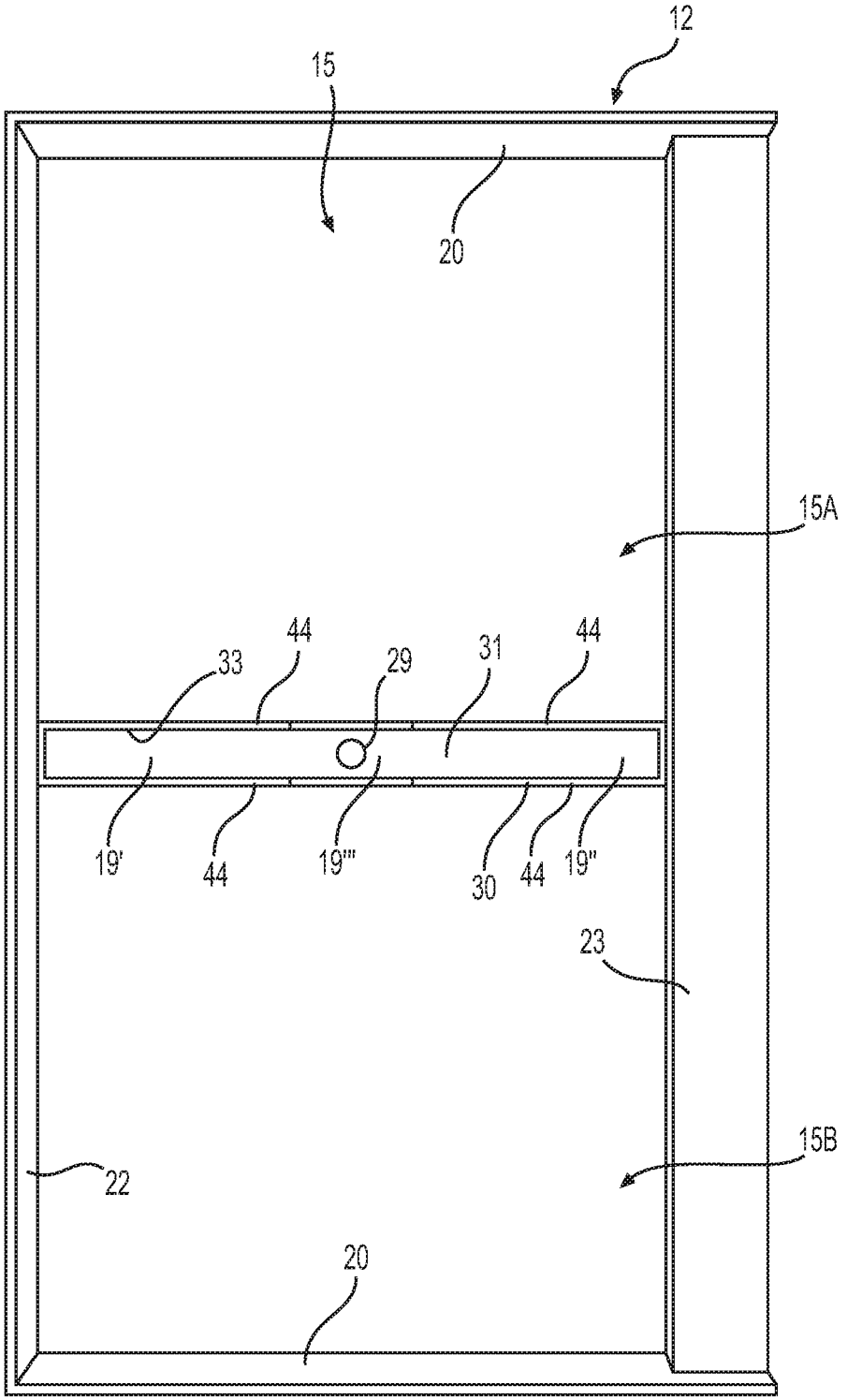
FIG. 3 is top plan view of the first embodiment of the invention with trench covering structure also removed.

The inventive embodiments of my invention reside primarily in combinations of structural components and manufacturing, installation and use steps related to the creation of a variety of shower floors incorporated into shower pan and drain arrangements in which at least a portion of the actual drainage apparatus is concealed from visual inspection.

Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms, such as "first" and "second," "top" and "bottom," and the like, may be used solely to distinguish one entity or element from another entity or element without necessarily requiring or implying any physical or logical relationship or order between such entities or elements.

The terms "comprises," "comprising," "comprise" or any other variation thereof are intended to cover a non-exclusive inclusion, such that a process, method, article, or apparatus that comprises a list of elements need not necessarily include only those elements, but may include other elements not expressly listed or inherent to such process, method, article, or apparatus.

The term "plurality of" as used in connection with any object or action means two or more of such objects or actions.

A claim element proceeded by the article "a" or "an" does not, without more constraints, preclude the existence of additional identical elements in the process, method, article, or apparatus that includes the element.

Terms such as "wall or flooring material," "floor and wall covering," "flooring material" and "covering material" mean one or more of ceramic, natural stone or other tile, stone, granite, marble, cultured marble, solid surface, or any other surface (e.g. stone), or non-slip finished shower surfaces such as vinyl or plastic, stucco, concrete and mortar surfaces, whether or not applied or combined with adhesives or other substances, and any other material or materials used to provide a finished surface.

The term "tiled" means any surface having floor or wall covering materials, such as one or more of ceramic, natural stone or other tile, stone, granite, marble, cultured marble, solid surface or any other surface (e.g. stone), or non-slip finished shower surfaces such as vinyl or plastic, stucco, concrete and mortar surfaces, whether or not applied or combined with adhesives or other substances, and any other material or materials used to provide a finished surface.

The term "non tileable" means one or more surfaces or structural components which are not capable of receiving wall or floor material or were not designed, marketed or sold with the intention of being tileable or tiled, and in fact are not tiled.

The term "tileable" or "ready-to-tile" means one or more surfaces or structural components which are capable of receiving wall or flooring material, whether through the use of adhesives or any other means of attachment, such as clips, straps or other mechanical fastening structure(s).

The term "prefabricated shower pan" means any manufactured or fabricated one piece shower pan (A) to which floor or wall coverings may be adhered, (B) which at the time of manufacture has either (i) a trench integrally associated therein or (ii) a molded or prefabricated trench integrally formed with one or more standard drain bodies, both of which are integrally associated into the shower pan at the time of manufacture or fabrication of such shower pan, or (iii) a drain integrated into the floor of the shower pan but such drain is not part of a trench drain nor is it located within a trench, or (iv) a trench drain molded or integrated into the shower floor in the factory as a one piece shower pan floor, and (C) which may also have integrated therein at the time of manufacture or fabrication a floor (which may be pitched), one or more splash walls, one or more curbs, and/or one or more barriered or barrier-free entrances.

The term "partially prefabricated shower pan" means any manufactured or fabricated shower pan assembly or kit to which floor or wall coverings are to be adhered which is not a one piece shower pan, but has two or more pieces which are assembled at any time after manufacture and prefabrication, usually in the field at or around the time of assembly and installation of the shower pan, which when assembled and installed in the field comprises a one piece or multi-piece shower floor and which (A) does not have either (i) a molded or prefabricated trench together with a standard drain integrally formed into such shower pan at the time of manufacture or (ii) a trench drain integrally formed into such shower pan at the time of manufacture, or (iii) a standard drain integrally formed into such shower pan, but which may have (B) one or more manufactured or fabricated integrated components, or component elements which make up, features such as a floor, a splash wall, a curb and/or a barriered or barrier-free entrance, and (C) as individual components one or more of a trench drain body, a standard drain body, a trench body, an integrally formed trench body and a standard drain, a trench body integrally formed with all or a portion of a shower pan floor, and a trench body and a standard drain integrally formed with all or a portion of a shower pan floor, and a standard drain integrated into (e.g. integrally formed with) all or a portion of a shower pan floor where there is no trench.

The term "mud base" means a floor structure created in the field by building a sloped surface from mortar or other well-known material for creating mud-based shower installations.

The term "hot mopped shower pan" means a mud base shower floor onto which is applied a molten, hardenable, liner material, such as asphalt and/or hot tar mixtures, and, in certain applications, one or more felt or other sealing layers, which collectively seal the floor from water leakage.

The term "linear drains" means elongated depressions, trenches associated with a standard drain, trench drains and trenches, whether right and/or left drain/trenches, back drains/trenches, front drains/trenches, and center drains/trenches, including trenches located anywhere in or on a drainable surface such as a shower floor.

Terms such as "tiled and/or tileable surface or fixture" and "surface or fixture" mean any fully or partially tiled and/or tileable bathtub, bathroom floor, shower floor, sink, fountain, fixture, floor, or other surface.

The term "non tileable and/or untiled surface" means a surface such as a floor, wall, shower floor, bath floor, sink, shower pan, or any other surface which has a drain integrated or associated with it, and such surface is either not tileable, or is not designed to be tiled or tileable, and/or such surface is in fact not tiled.

The term "shower pan" means a waterproof shower base or pan which can be used as an underlayment for a bathtub or shower, which can be any one of: (i) an assembly which is prefabricated through one or more manufacturing steps or processes; (ii) is assembled using one or more prefabricated component parts in the field; (iii) an assembly which is otherwise assembled in the field; (iv) which is built up or otherwise formed from a malleable, settable material (such as the well-known mortar); or (v) a prefabricated shower pan; (vi) a partially prefabricated shower pan; (vii) a mud based shower pan; and (viii) a hot mopped shower pan.

The term "standard drain" means any kind of drain made of any kind of material, including but not limited to metal or plastics, and with any kind of connection to a drain system such as a waste water system, including but not limited to a solvent weld drain, a welded connection drain, a hub (outside caulk) drain, a spigot drain, a hubless spigot drain, a hubless drain, an inside caulk (gasket) drain, a hubbed (push on) drain, a compression drain, and a clamping ring drain, but does not include a trench drain.

The term "drain area" means an area in which a drain is either to be formed or installed, or is actually formed or installed, in a shower pan.

The term "drain floor" means an area in which a drain recess is created and in which a drain fixture is installed or to be installed, formed or to be formed, or otherwise created, regardless of when it is installed, formed or otherwise created.

The term "trench drain" means existing integrally formed trench drains (also known as "linear drains") such as those which meet the requirements of the various plumbing codes pertaining to a trench drain.

The term "trench body" or "trench" means molded trench bodies or preformed or prefabricated trench bodies and other voids into which liquids may otherwise drain, such as depressions in a shower, bath, sink, basin or bathroom floor, whether preformed or formed during the assembly of the shower pan, bath tub, sink, basin or floor which may or may not be leak proof at the time the trench body is preformed, prefabricated, or molded, or subsequently made water proof sometime after manufacture such as in the field at or about the time of installation of the shower pan, and which is made from any appropriate material including but not limited to metal, such as cast iron, copper, steel, aluminum, plastics such as PVC or ABS, polyurethane, polyethylene, polymer resins, or the like.

The terms "trench cover" and "trench grate" mean any device or apparatus that can be used to cover a linear drain and be removable to allow access to the trench.

The term "substrate grate" means any device or apparatus that can be used to cover a linear drain that is intended to remain in place once flooring material is installed over all or a portion of the substrate grate.

The term "pre-manufactured" means any component of a shower pan that is manufactured prior to incorporation of that component into another product.

The term "molded' means any component that is formed with a finished product at the time that the finished product is molded.

The terms "pitch" or "slope" mean the change in elevation per unit of length of floor. A typical shower floor pitch is ¼" per foot, although any pitch is deemed to be within the scope of the inventions disclosed herein.

The term "non-removable" means installed with the intention that it not be removed during the useful life of the article.

The inventions disclosed herein may be employed in, by example but not by way of limitation, sinks, basins, showers, baths, shower pans, fixtures, washrooms, bathrooms, work shops, industrial facilities, and any other surface or fixture from which liquid is to be drained.

Referring now to FIGS. 1-9, there is shown an embodiment in accordance with certain of the teachings of the invention. This embodiment comprises a one-piece prefabricated shower pan 12 with an integrally molded trench 14. The pan 12 is comprised of a pitched floor 15 (which is preferably planar on either side of the trench 14) defining bottom surface 16 thereof, whether with or without ribs 17, and may include such additional features as one or more curbs 18, one or more side splash walls 20, and one or more rear splash walls 22. Accessory features of shower pans are well known, and it is contemplated that such features may or may not be used in connection with the embodiments disclosed herein. In addition, other known accessory features (such as barrier-free entrances) may be employed without departing from the spirit and scope of the invention.

Figure 19:
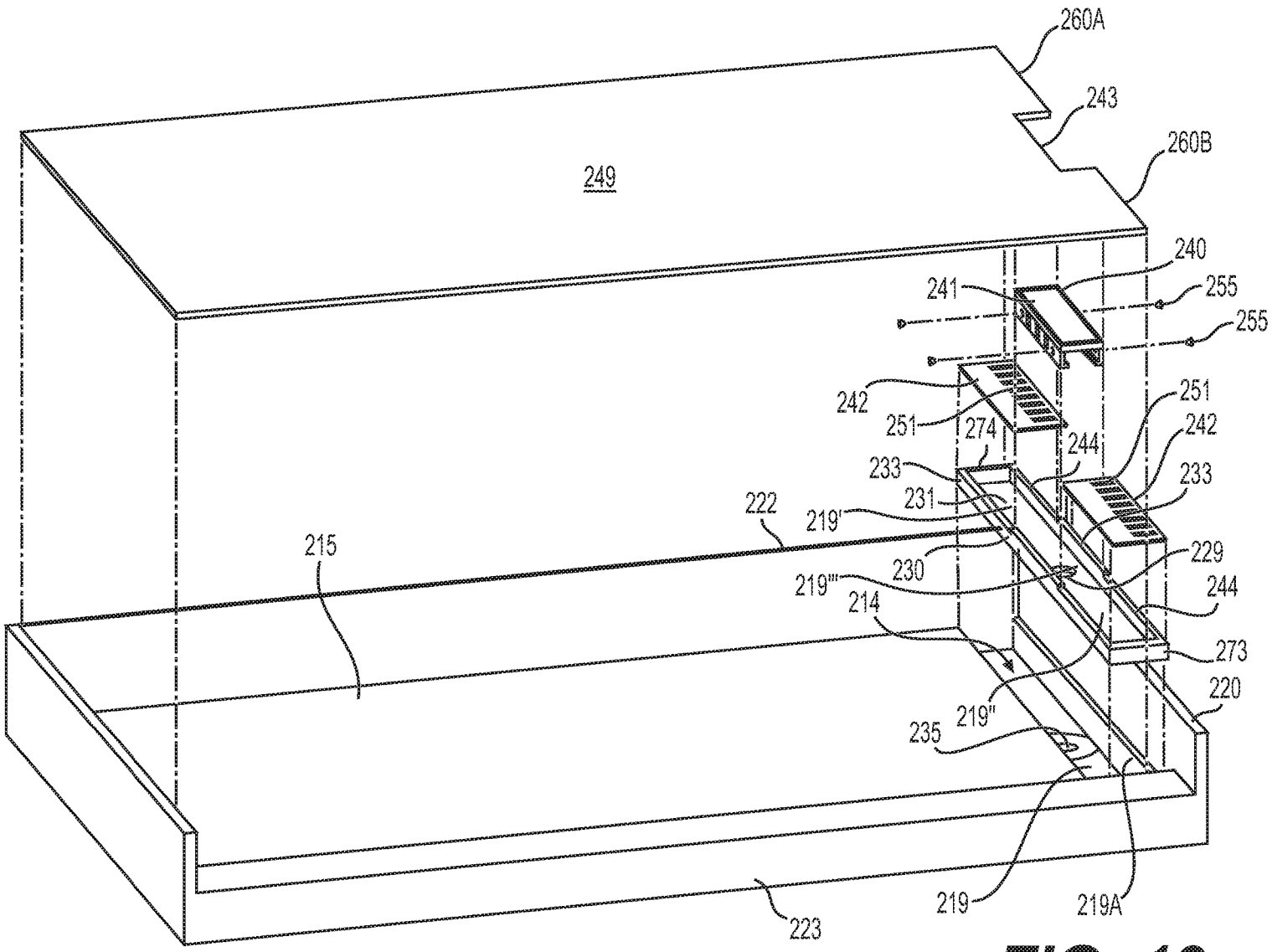
FIG. 19 is a fully exploded perspective view of the third embodiment of the invention.
Figure 20:
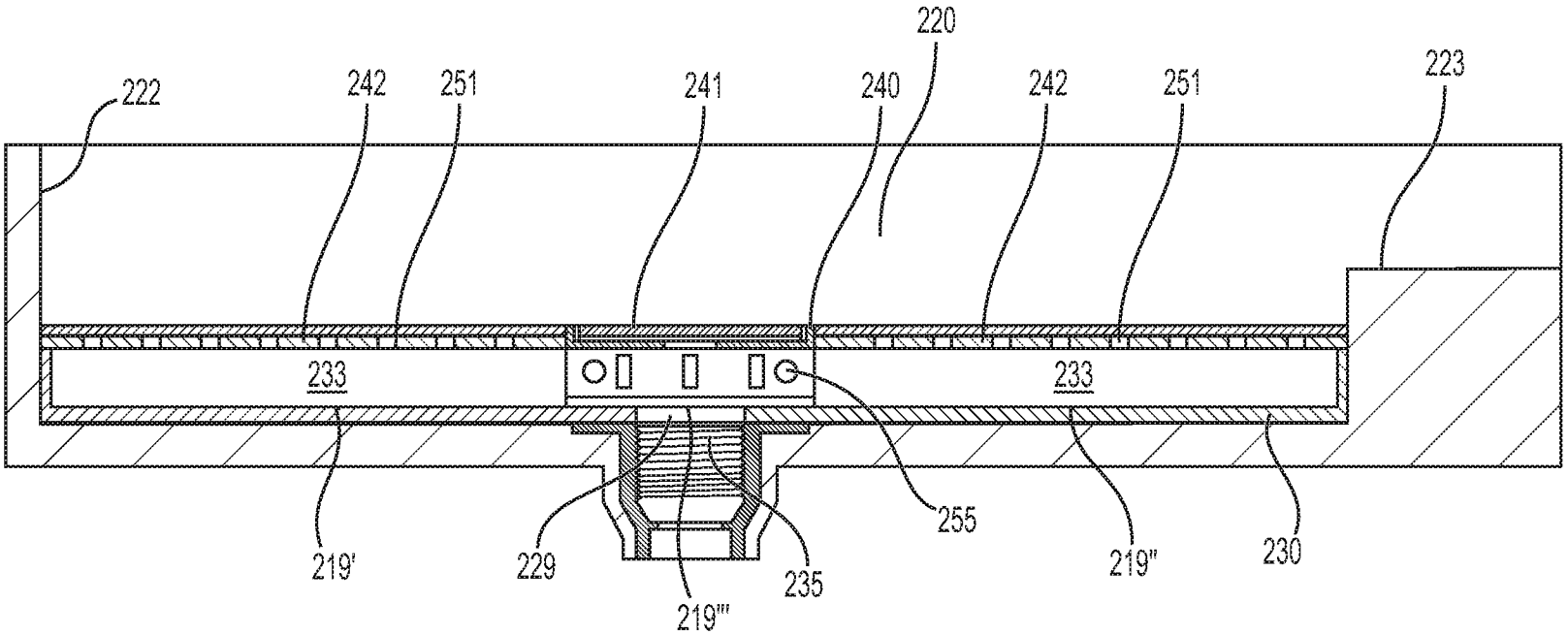
FIG. 20 is a cross-sectional elevational view of the third embodiment taken along lines 20-20 of FIG. 16.

Trench 14 is defined by a trench floor 19 and trench sidewalls 19A. Any one of trench sidewalls 19A may coincide with (i.e., be co-planar with) the inner-facing surface of rear splash wall 22 and/or either of side splash walls 20, or may coincide with any combination of the splash walls, or trench sidewalls 19A may be independent of, and not coincident with (i.e., adjacent), splashwalls 20 or 22. In the configuration shown, which is a type of "center" drain shower, the trench is located away from the splash walls 20 and 22. FIG. 19 shows an example of the trench sidewall 219A being coincident with one of the splashwalls 220. Such a configuration may be employed with any of the embodiments of the invention set forth in this disclosure.

In embodiments, a drain fixture or fitting 35 (or which may simply be a drain aperture defined by trench floor 19 or trench liner floor 31) is defined by and/or integrated with trench floor 19, which may be integrated during manufacture of the pan floor or the trench (which is sometimes the case for prefabricated components or completed prefabricated pans) or created or integrated/installed in situ. The location of drain fixture or aperture 35 relative to the pan floor 15 is usually determined by the location of the wastewater pipe (not shown) in the sub-floor.

As can be seen from FIGS. 4-6 and 8, floor 15, which in the embodiment shown is made up of left and right floor sections 15A, 15B, may be pitched or sloped toward trench 14 on each side of trench 14. A standard slope is ¼ inch per foot, although any pitch which will accomplish the task of causing liquid to drain from floor 15 (or, in embodiments, whatever covering material is situated thereon, such as floor tile panels 49) into trench 14 is deemed to be within the scope of the invention.

Trench 14 may be fitted with a trench liner such as liner 30. Liner 30 preferably fits generally within the contours of trench 14 to provide an extra measure of waterproofing and a smooth drainage surface. Liner 30 defines a liner floor 31, which in turn defines a drain aperture 29 adapted to reside in registry with drain fixture or aperture 35 of trench 14. As will occur to those of skill in the art, a drain fitting such as drain fixture or aperture 35 may be used to sealingly secure the wastewater pipe (not shown) to the trench and/or liner. Liner 30 may have sidewalls 33 generally parallel to sidewalls 19A of trench 14. In embodiments, all or a portion of the height of trench liner sidewalls 33 are slightly shorter than the height of trench sidewalls 19A for reasons to be described hereinafter.

Figure 4:
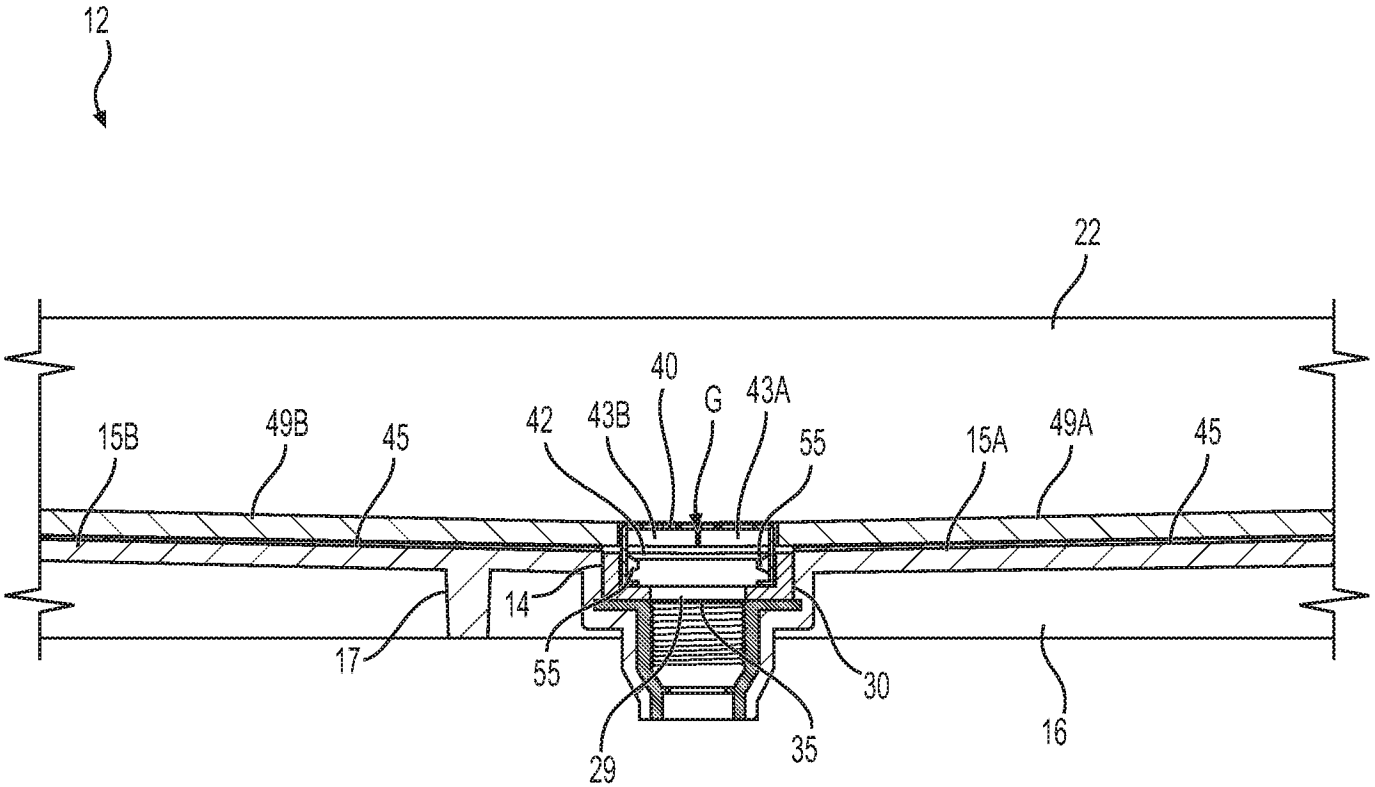
FIG. 4 is a cross-sectional elevational view of the first embodiment taken along lines 4-4 of FIG. 1.
Figure 5A:
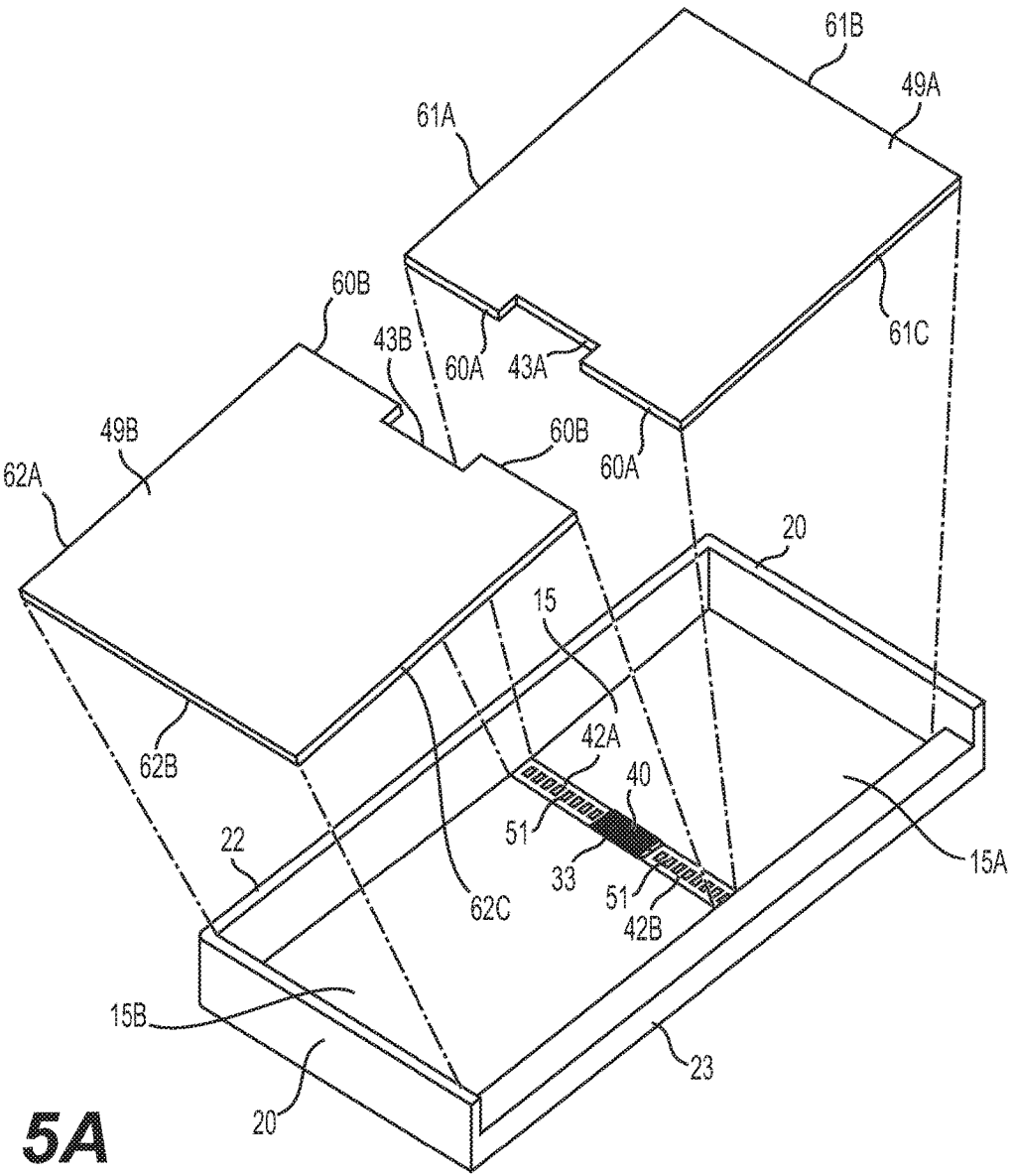
FIG. 5A is a partially exploded perspective view of the first embodiment of the invention.

In embodiments, in situations where a shower trench or trench drain is going to be used other than near the curb or one of the left, right, front or back splash walls (i.e., a "center"-type drain placement), in order to maximize the area on the shower floor that a user can stand on that is not a drain grate and minimize the size of the removable drain grate which allows access to the wastewater pipe, while simultaneously nevertheless providing sufficient drainage flow rate, an arrangement can be used as follows: a waterproof pan such as shower pan 12 shown in FIGS. 1-9 is provided, along with a liner such as trench liner 30. In this particular embodiment, a pair of symmetrical right and left floor covering panels 49A and 49B are provided, which, when placed on pan floor 15, cover essentially the entire surface area of floor 15 other than drainage gaps "G" created between said panels and cutouts for removable drain grates 40 to be discussed in greater detail below. The outer edges 61A, 61B and 61C of panel 49A reside in abutting relation with, or in close proximity to, splash walls and curb 20, 22 and 23 on the left side of the pan as viewed from the perspective of FIGS. 1 and 5, and the outer edges 62A, 62B and 62C of panel 49B reside in abutting relation with, or in close proximity to, splash walls and curb 20, 22 and 23 on the opposite side of pan 12, also as seen in FIGS. 1 and 5. Floor panels 49A and 49B may be ceramic or porcelain tile, stone, marble, polymer-based material, acrylic, solid surface, metal, or any suitable material for covering a floor from which liquid is to drain.

When floor panels 49A and 49B are situated over pan floor 15, respective edges 60A and 60B thereof rest in opposed relationship to each other. Edges 60A and 60B form a pair of relatively small drainage gaps "G1" and "G2" through which water may drain into trench 14 (in applications where no trench liner is used) and/or trench liner 30. Cutouts 43A and 43B form a larger area into which can be placed a removable drainage grate such as grate 40. Using a removable drainage grate such as grate 40 permits access to the interior of trench liner 30 (or trench 14 where no liner 29 is used) for purposes of cleaning and/or maintenance. Any type of cover structure for removable drain cover 40 is contemplated to be within the scope of the invention, such as apertured (a version of which is shown in FIGS. 1-9), solid (i.e., non-apertured), tileable or non-tilable covers.

Figure 40A:
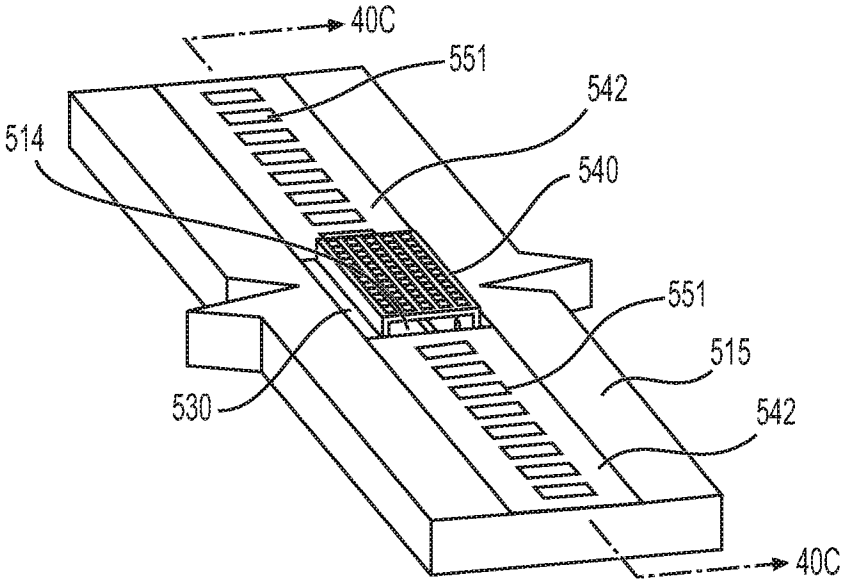
FIG. 40A is an assembled perspective view of a linear drain with separate, modular substrate grate supports.
Figure 40B:
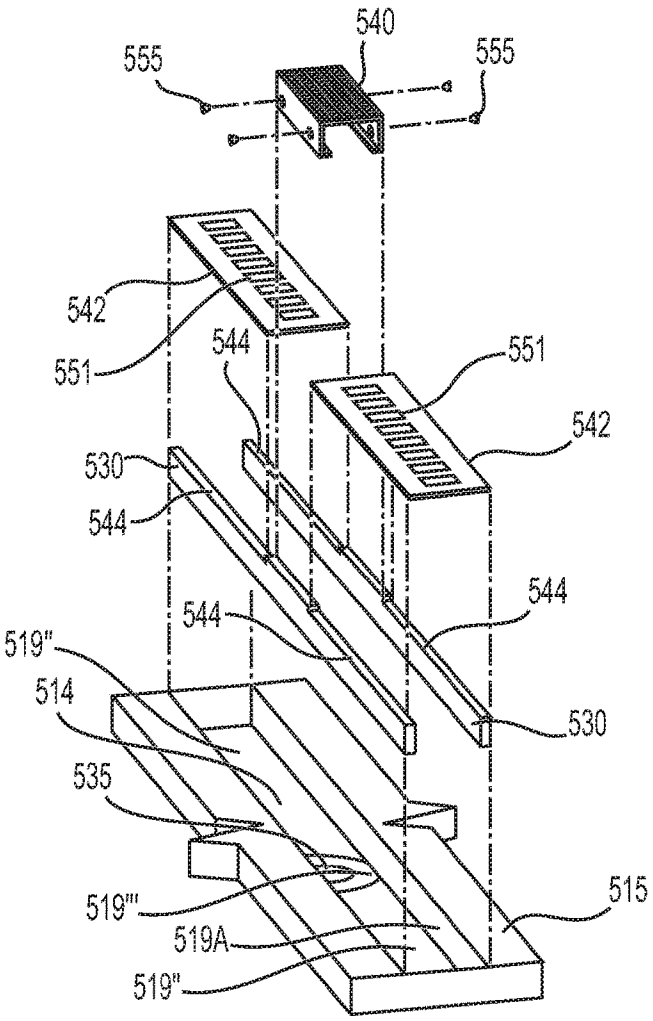
FIG. 40B is an exploded perspective view of the linear drain shown in FIG. 40A.
Figure 40C:
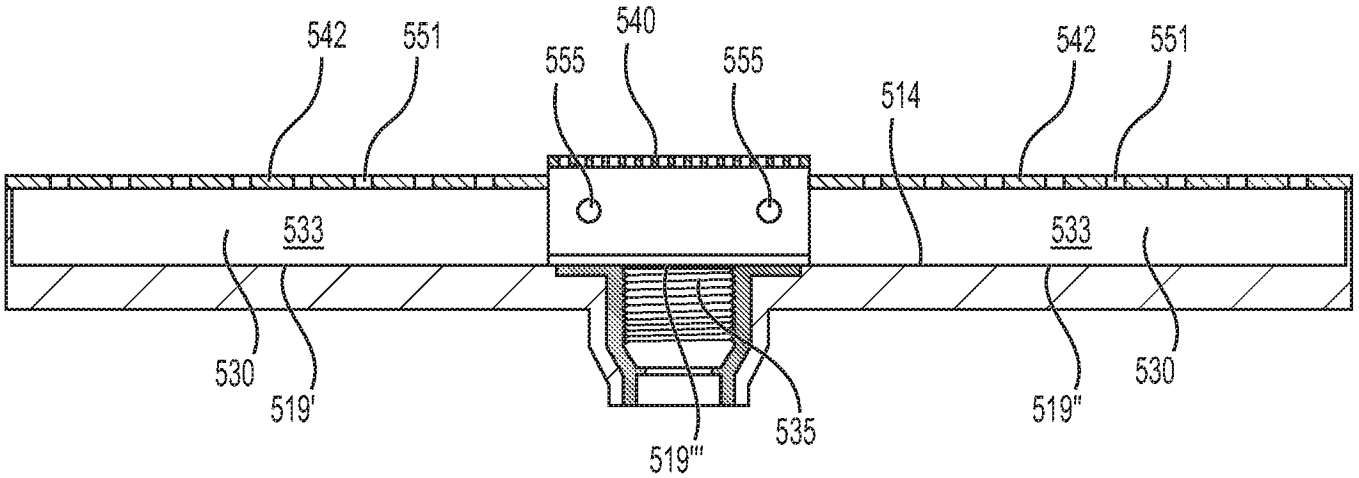
FIG. 40C is a cross-sectional elevational view of the linear drain of FIG. 40A.

In order to provide added support for the portions of floor panels 49A, 49B which sit in registry with trench floor 31 and/or trench liner floor 31, and which therefore are not supported by floor 15, and/or to cover a portion of the trench 14, one or more features, such as substrate grates or panels 42, may be used to span the open area over trench 14 or liner 30. In embodiments, the substrate panels 42 may be one or more slotted or otherwise apertured plates, such as plates 42 shown in FIGS. 2, 4, 5, 7 and 8, or may be ribs, support struts or other supporting structure spanning across the open area over trench 14 and/or liner 30. The support substrate may also, or alternatively, take the form of inserts (such as is shown in FIGS. 40A-40C), columns or pillars supported on trench floor 19 or trench liner floor 31, although any solution which places a drainage obstruction within the trench or trench liner is less desirable.

Figure 5B:
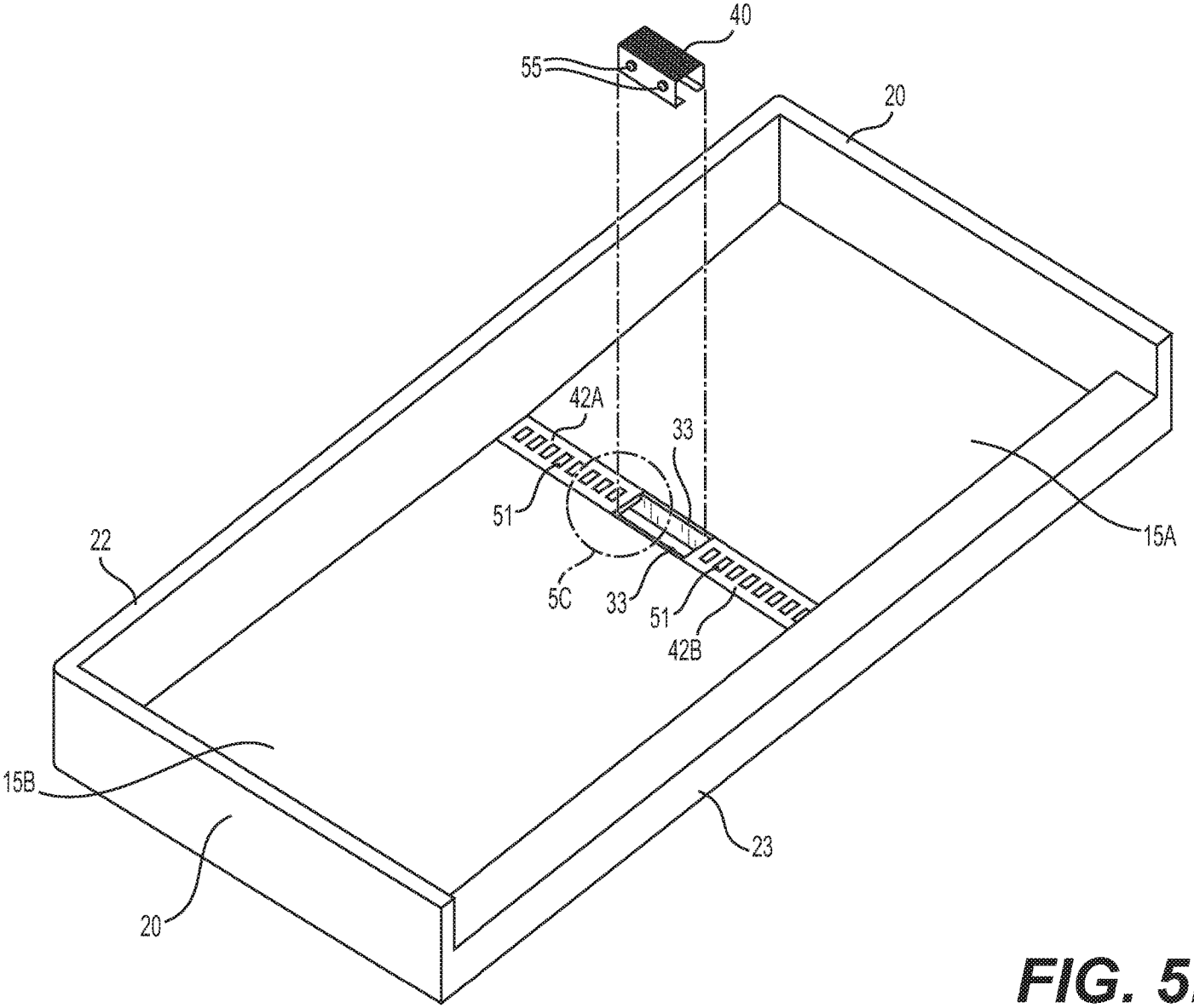
FIG. 5B is a partially exploded perspective view of the first embodiment of the invention with a removable drain grate raised from its in-use position.
Figure 5C:
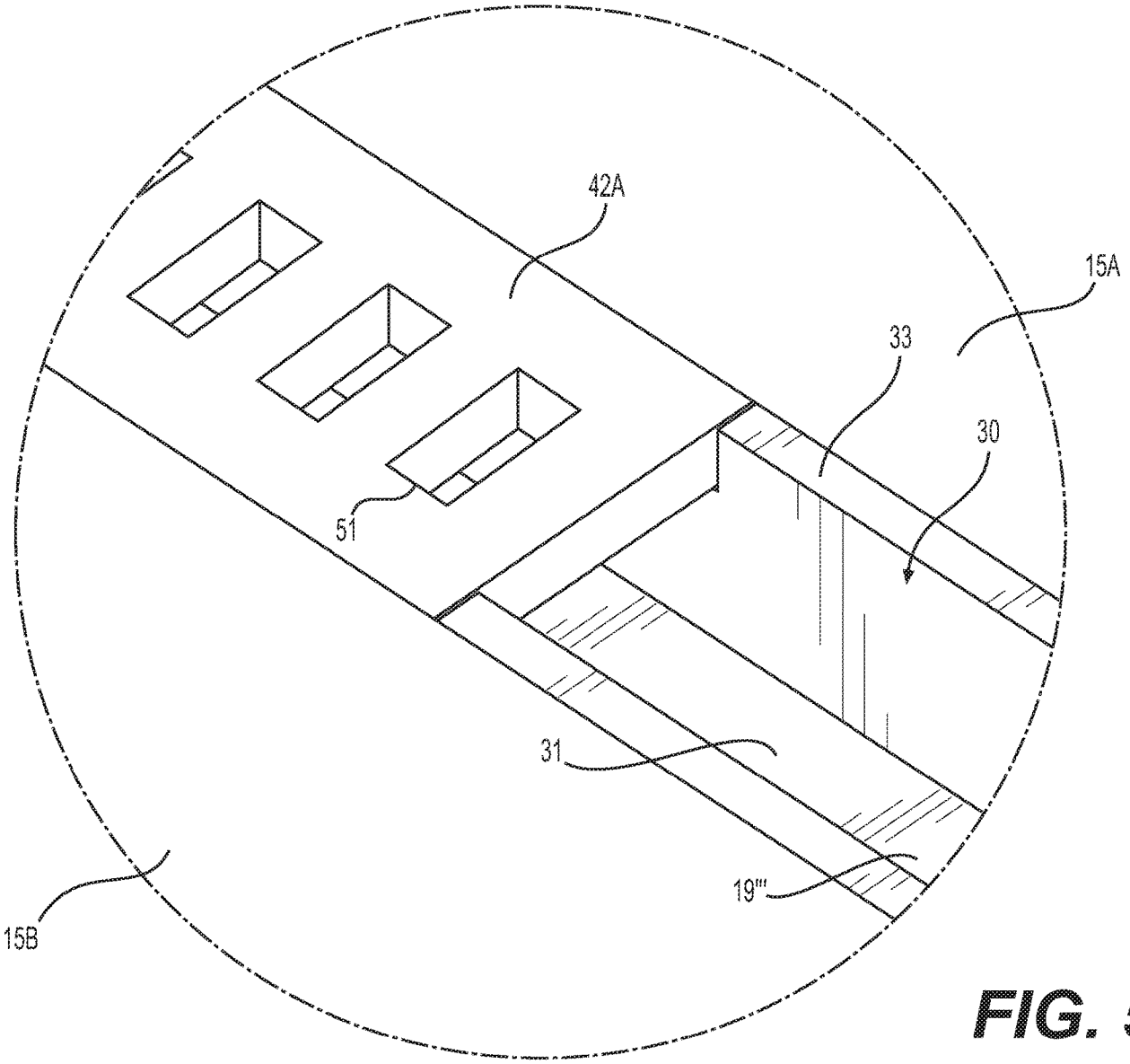
FIG. 5C is a close-up of the area of detail shown in FIG. 5B.

In embodiments, and as particularly shown in FIGS. 5B and 5C, portions of the sidewalls 33 of trench liner 30 are shorter than the sidewalls 19A of trench 14, and the upper horizontal edges of liner sidewalls 19A form a shoulder or ledge 44 upon which substrate panels 42 may be supported. In this way, the panels are held against transverse horizontal movement by the floor sections 15A and 15B against which the panels 42 abut, and against vertical downward movement by shoulder 44. The shoulder 44 retains the substrate panels 42 in supported relationship over trench liner floor 31 while the substrate panels 42 may provide support to the sections of flooring material 49A and 49B that overhang the trench 14. In embodiments, the sidewalls 19A of trench liner 30 may terminate at their upper ends in shoulder 44 at a position that renders the upper surfaces of substrate panels 42 coplanar with the upper surface of the adjacent floor sections 15A and 15B, or non-coplanar therewith, depending upon the needs of the particular application. Other structure for supporting panels 42 will occur to those of skill in the art and are considered to be within the scope of the invention.

Figure 6:
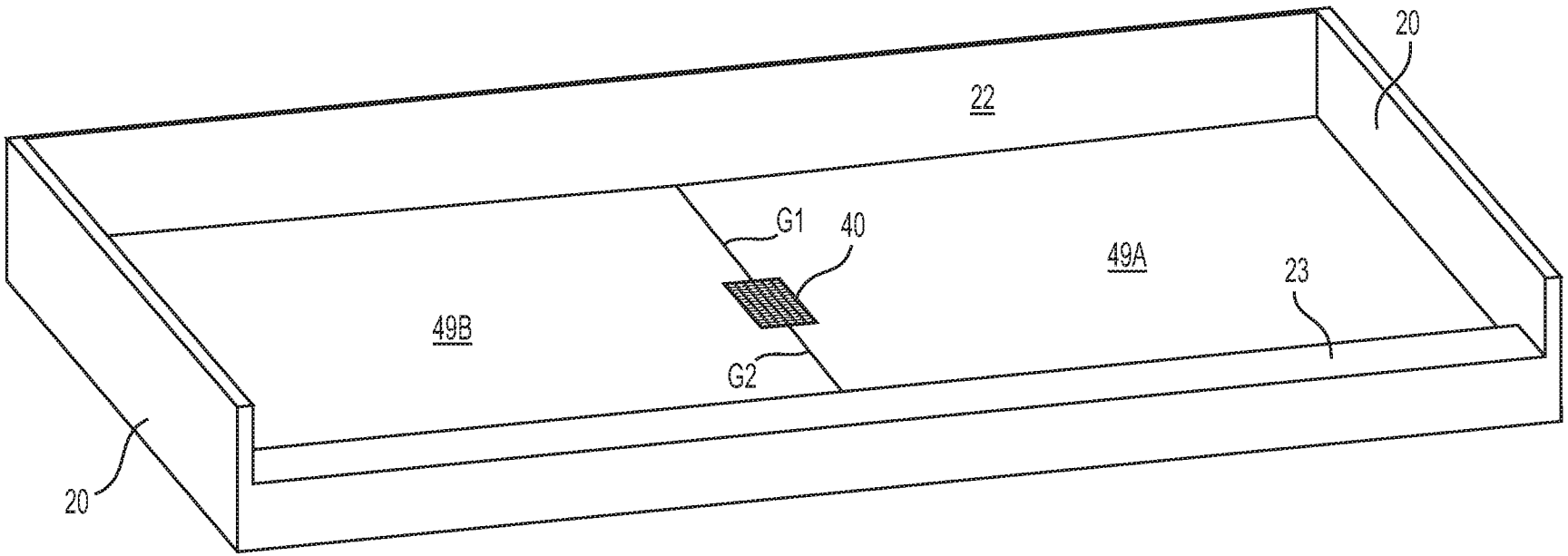
FIG. 6 is an assembled perspective view of the first embodiment of the invention.
Figure 7:
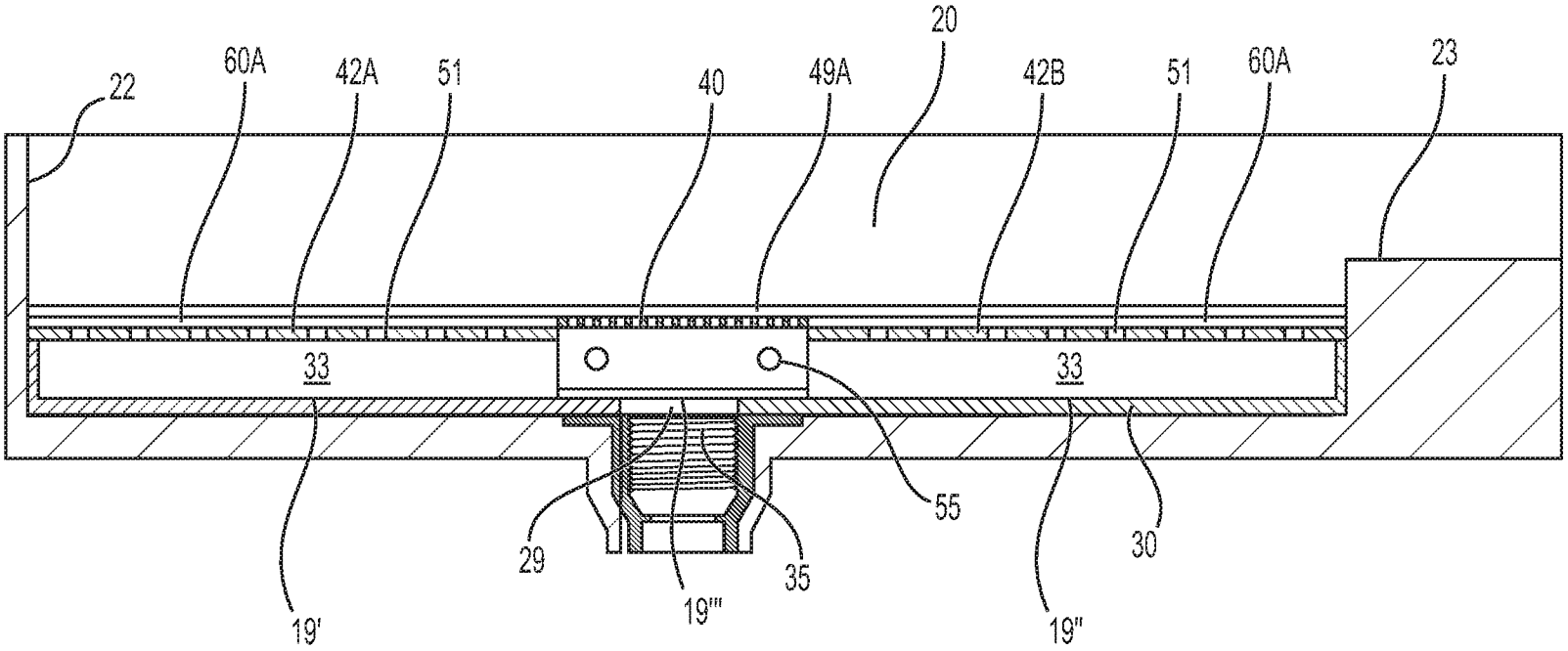
FIG. 7 is a cross-sectional elevational view of the first embodiment taken along lines 7-7 of FIG. 1.
Figure 8:
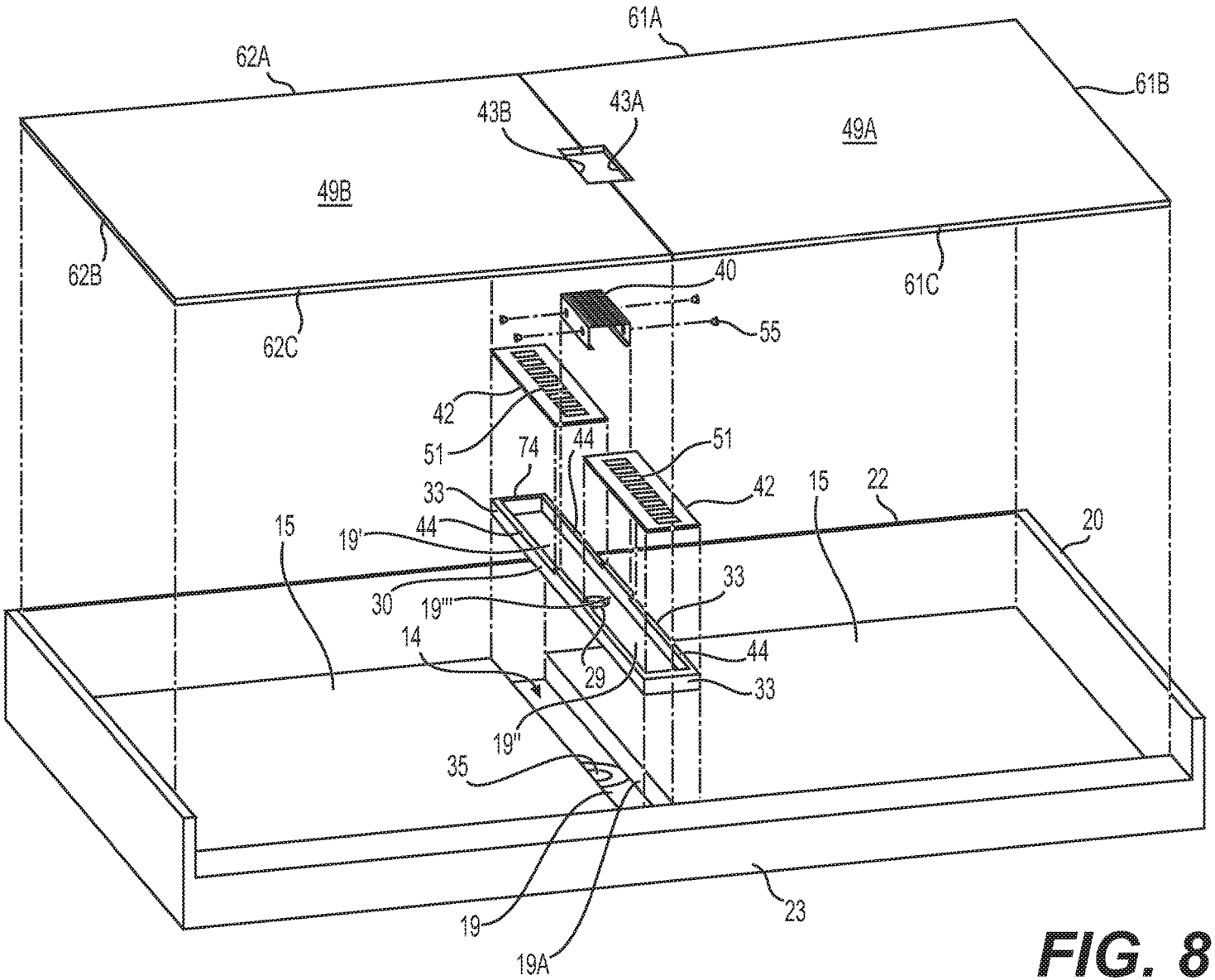
FIG. 8 is an exploded perspective view of the first embodiment of the invention.
Figure 9:
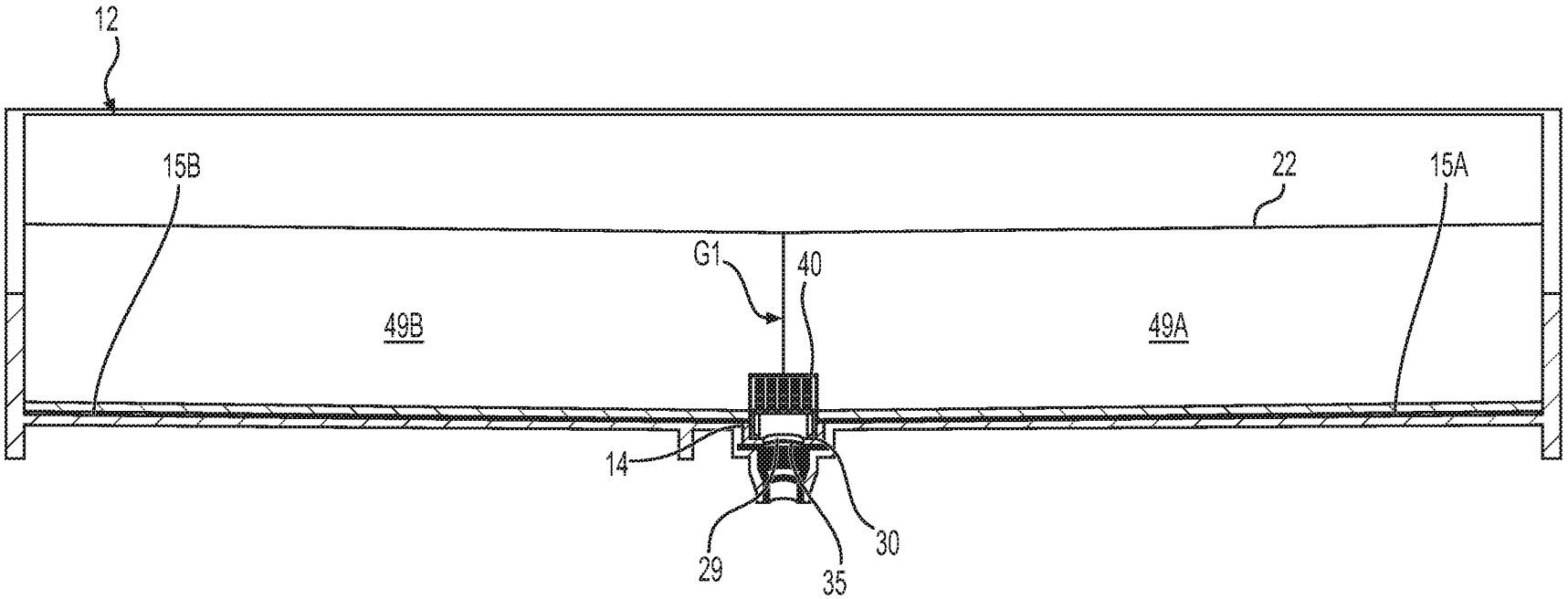
FIG. 9 is a perspective assembled cross-sectional view of the first embodiment of the invention taken along lines 7-7 of FIG. 1.

The first and second floor covering panels 49A, 49B, respectively, define first and second cutouts 43A, 43B to accommodate removable drain grate 40, such that, when the first and second floor covering panels 49A, 49B are associated with the shower pan floor 15 in the manner shown in FIGS. 1, 4 and 6, the first and second cutouts 43A, 43B provide an area in which the removable drain grate 40 may be removably received. Preferably, the removable drain grate is located substantially adjacent the drain 35 to facilitate cleaning the drain or otherwise gaining access to the drain. However, the removable drain grate 40 need not necessarily be positioned adjacent to the drain 35. In some embodiments, as stated above, portions of the upper edges 44 of side walls 19A of trench liner 30 are sized and shaped so that they are lower than the plane in which floor 15 resides at the transition into the trench 14, forming a shoulder 44 around a portion of the top of trench liner side walls 19A and within the opening in floor 15 formed by trench 14, as can be seen in FIG. 5B. In this way, substrate panels 42 or other support structure can be supported thereon. As such, by installing flooring material such as floor panels 49A and 49B over the substrate plates 42, the substrate plates become firmly held in place and may provide support over the otherwise cantilevered sections of floor panels 49A and 49B which extend out over the opening in floor 15 formed by trench 14.

In the embodiment shown in FIGS. 1-9, although the removable drain cover 40 appears as the only drainage area for the shower, the entirety of gaps "G1" and "G2" also create significant water drainage area but do not present as areas that one would be reluctant to place one's feet on and permit the use of smaller removable drain grate 40, which in turn results in a removable drain grate that is lighter and easier to remove and manipulate. Such innovative constructions create a unique visual effect and permit ample drainage from the shower, while simultaneously permitting a supplier of showers to offer a wide range of products without having to manufacture and store unique product components for each individual offering.

It can be seen, therefore, that, in some embodiments, a combination shower pan, linear drain and linear drain concealment arrangement is provided, comprised of: a prefabricated shower pan comprising a shower pan floor 15, which may or may not be bounded on one or more sides by upstanding sidewalls 20 and/or 22 and/or curb 23; a recessed linear drain 14 integrally formed within the shower pan floor 15, the trench 14 comprising upstanding trench sidewalls 19A and a trench floor 19; a first substrate drain grate 42A positioned in registry with a first portion 19' of the trench floor 19 (or trench liner floor 31 where a trench liner 30 is employed), a second substrate drain grate 42B positioned in registry with a second portion 19" of the trench floor 19 (or trench liner floor 31 where a trench liner 30 is employed), and a first removable drain grate 40 positioned in registry with a third portion 19''' of trench floor 19 (or trench liner floor 31 where a trench liner 30 is employed) (FIG. 3); a first floor covering panel 49A placed in registry with a first portion 15A of the shower pan floor, the first floor covering panel 49A defining first and second first panel edges 60A; a second floor covering panel 49B placed in registry with a second portion 15B of the shower pan floor 15, the second panel defining first and second second panel edges 60B; the first and second first panel edges 60A being spaced from the first and second second panel edges 60B, respectively, to form first and second drainage gaps G1 and G2 there between; the first substrate drain grate 42A being disposed in registry below the first drainage gap G1, and the second substrate drain grate 42B being in registry below the second drainage gap G2, when the shower pan 12 is in an in-use orientation such as that shown in FIGS. 1 and 6.

In embodiments, substrate drain panels 42 may be dispensed with, such that the sections of floor panels 49A and 49B that overhang trench 14 or liner 30 are unsupported or supported by structure other than said substrate panels 42.

Shower pans come in a wide array of shapes and sizes. The pan featured in FIGS. 1-9 is representative of a typical prefabricated shower pan configuration, and includes a trench that spans from one wall (in the case shown, splash wall 22) to the opposite wall (in the case shown, curb 23). Other embodiments are contemplated in which the trench does not span the entire width of pan floor 15 but, rather, spans less than the width of pan floor 15. If, for example, another customer wants a pan that is wider than the pan shown in FIGS. 1-9, the same trench (or manufacturing tool) could be used for the trench, obviating the need for a separate product SKU, while the size of the pan can be increased in whatever dimensions are desired.

Referring now to FIGS. 10-15, there is shown an embodiment in accordance with certain of the teachings of the invention. This embodiment comprises a one-piece prefabricated shower pan 112 with an integrally molded trench 114. The pan 112 is comprised of a pitched floor 115 (which is preferably planar on either side of the trench 114) defining bottom surface 116 thereof, whether with or without ribs 117, and may include such additional features as one or more curbs 118, one or more side splash walls 120, and one or more rear splash walls 122. Accessory features of shower pans are well known, and it is contemplated that such features may or may not be used in connection with the embodiments disclosed herein. In addition, other known accessory features (such as barrier-free entrances) may be employed without departing from the spirit and scope of the invention.

Trench 114 is defined by a trench floor 119 and trench sidewalls 119A. Any one of trench sidewalls 119A may coincide with (i.e., be co-planar with) the inner-facing surface of rear splash wall 122 and/or either of side splash walls 120, or may coincide with any combination of the splash walls, or trench sidewalls 119A may be independent of, and not coincident with (i.e., adjacent), splashwalls 120 or 122. In the configuration shown, which is a type of "center" drain shower, the trench is located away from the splash walls 120 and 122.

In embodiments, a drain fixture or fitting 135 (or which may simply be a drain aperture defined by trench floor 119 or trench liner floor 131) is defined by and/or integrated with trench floor 119A, which may be integrated during manufacture of the pan floor or the trench (which is sometimes the case for prefabricated components or completed prefabricated pans) or created or integrated/installed in situ. The location of drain fixture or aperture 135 relative to the pan floor 115 is usually determined by the location of the wastewater pipe (not shown) in the sub-floor.

Figure 12A:
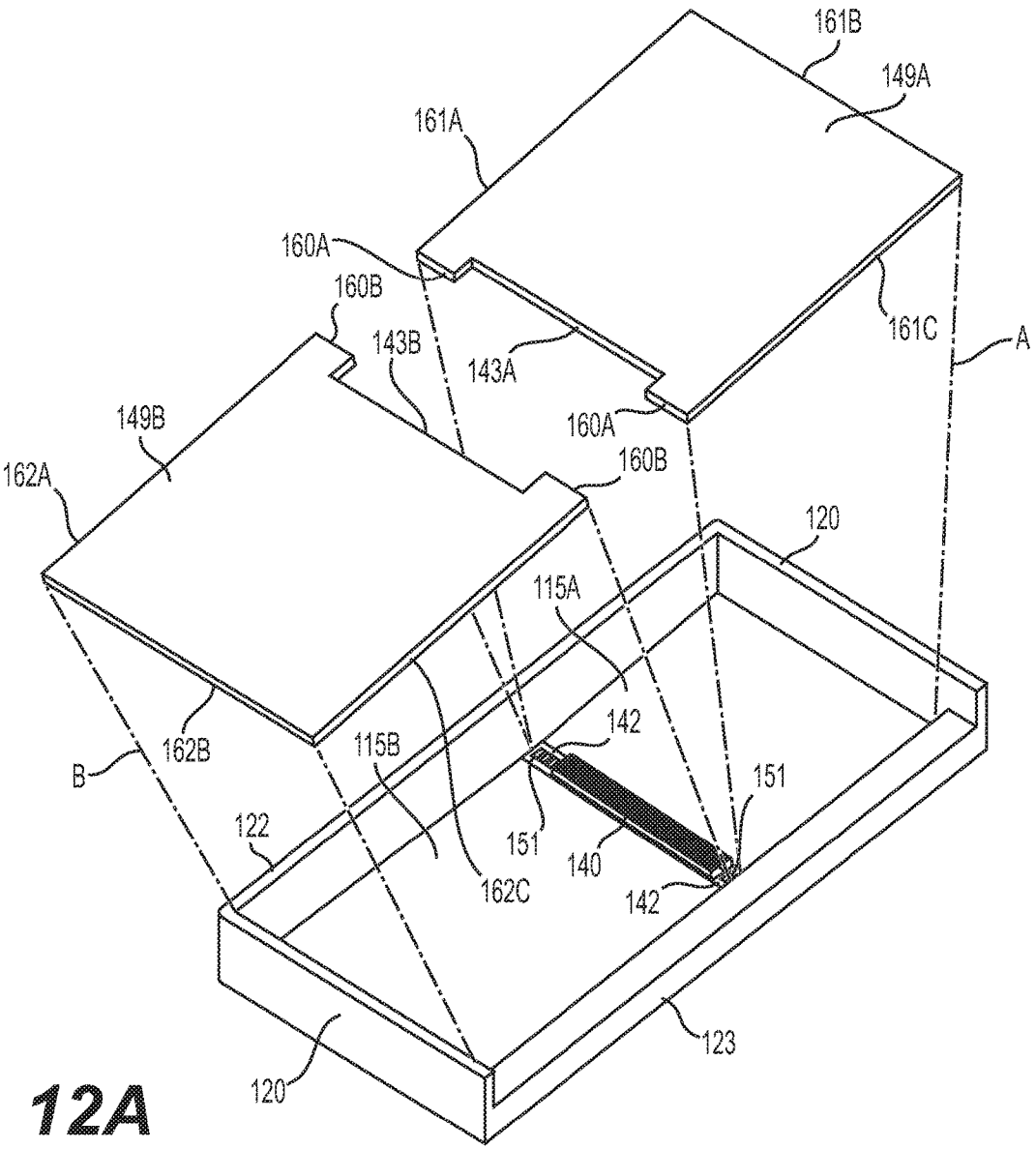
FIG. 12A is a partially exploded perspective view of the second embodiment of the invention.
Figure 12B:
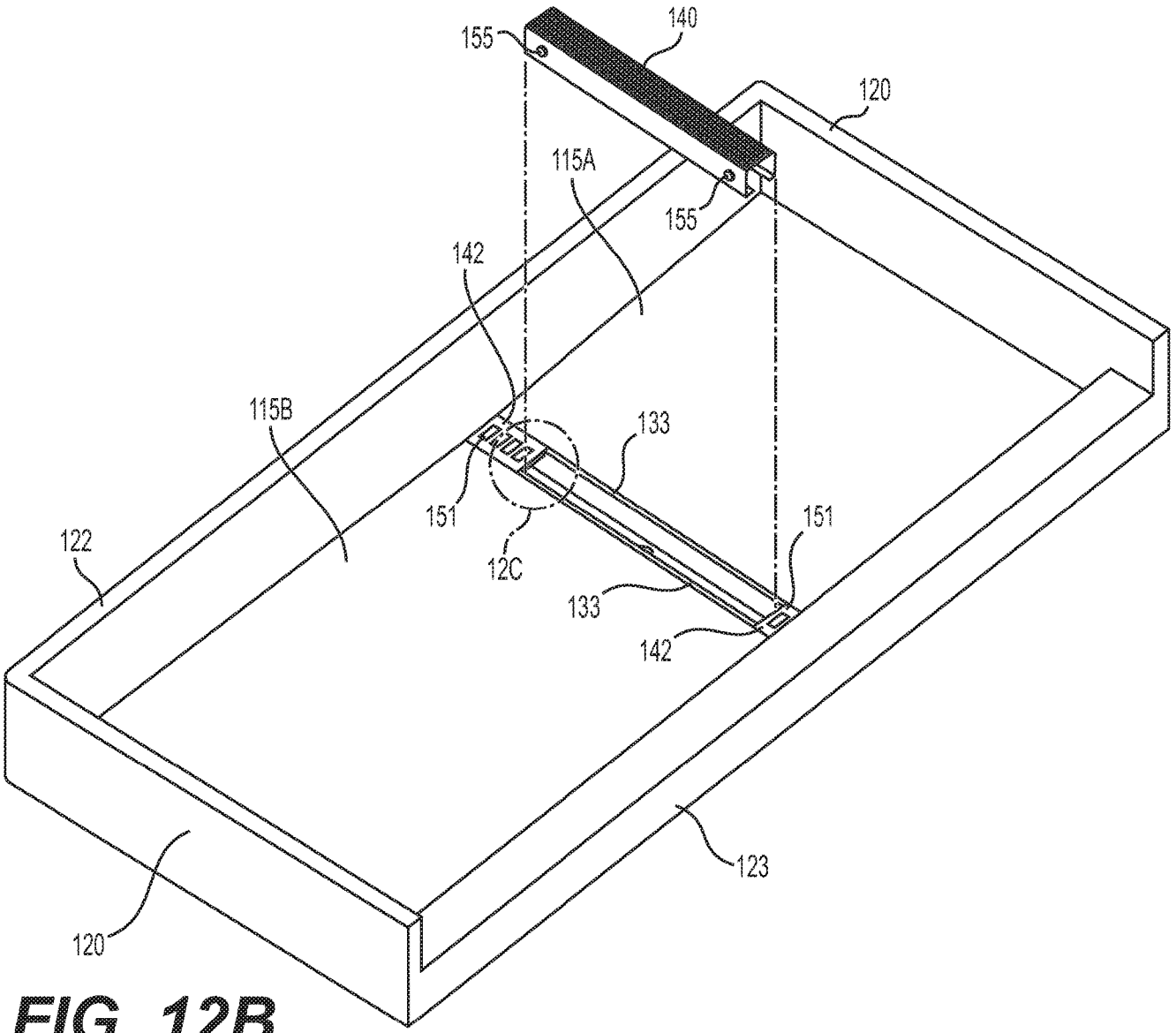
FIG. 12B is a partially exploded perspective view of the second embodiment of the invention with a removable drain grate raised from its in-use position.
Figure 12C:
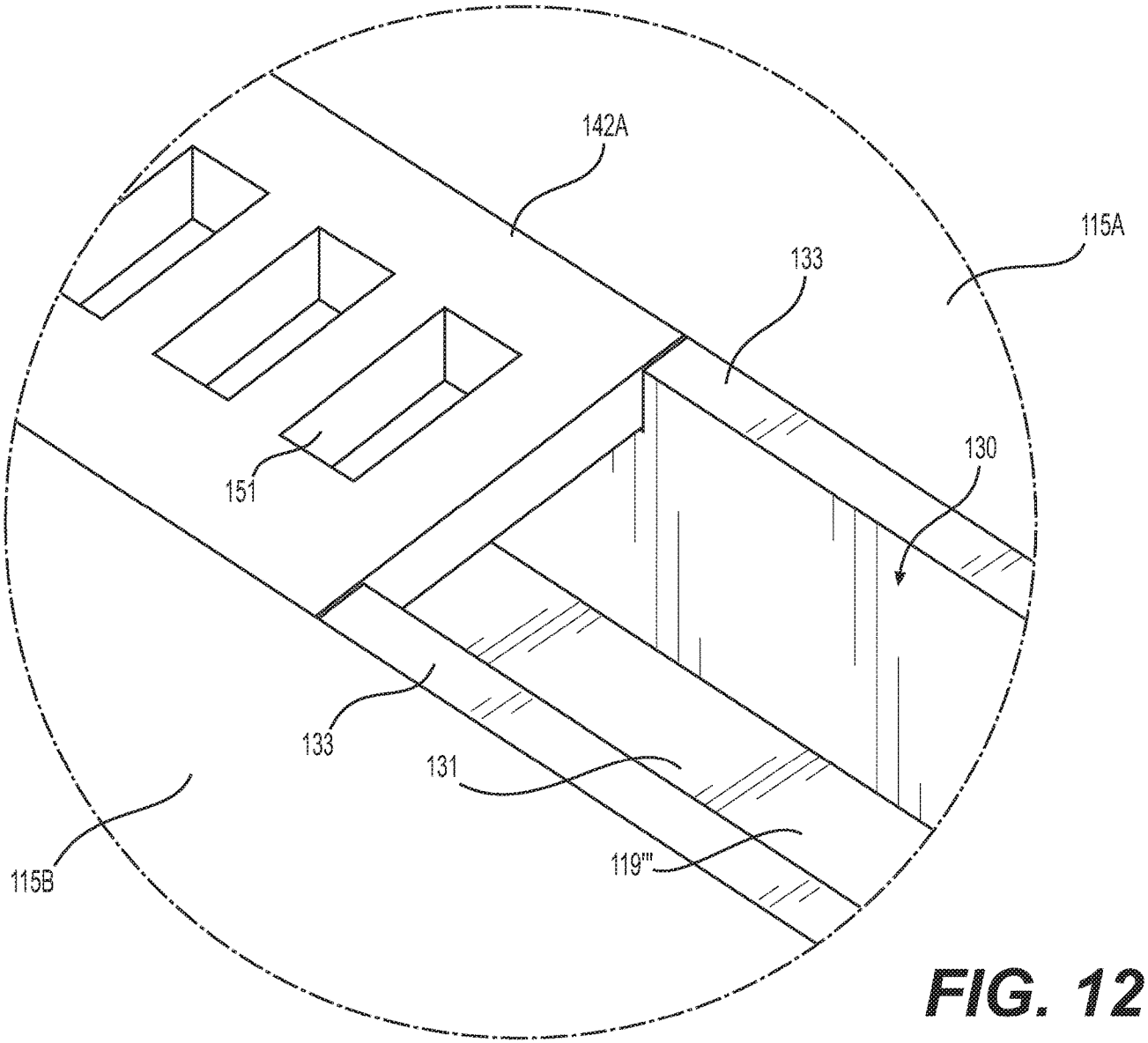
FIG. 12C is a close-up of the area of detail shown in FIG. 12B.
Figure 13:
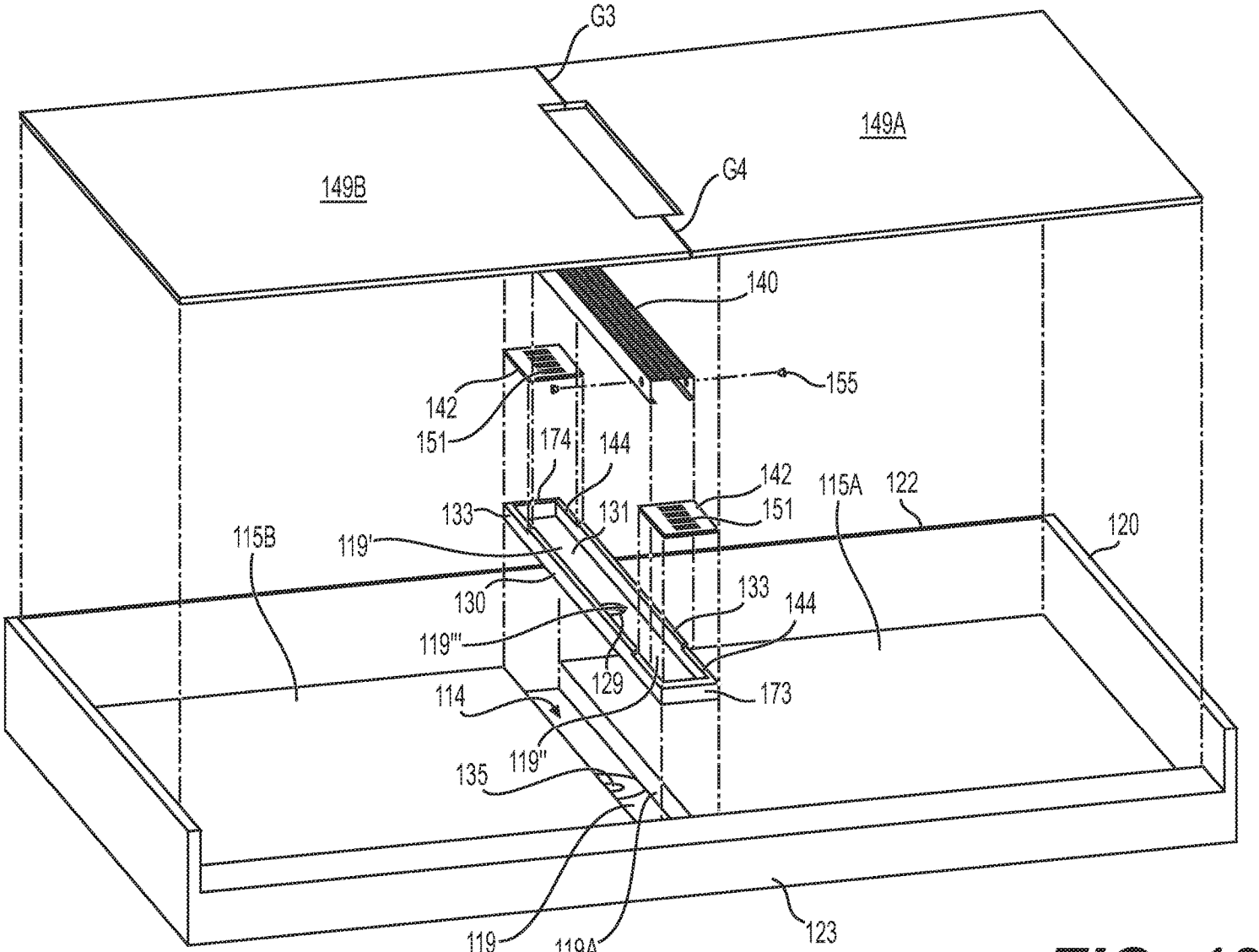
FIG. 13 is an exploded perspective view of the second embodiment of the invention.
Figure 14:
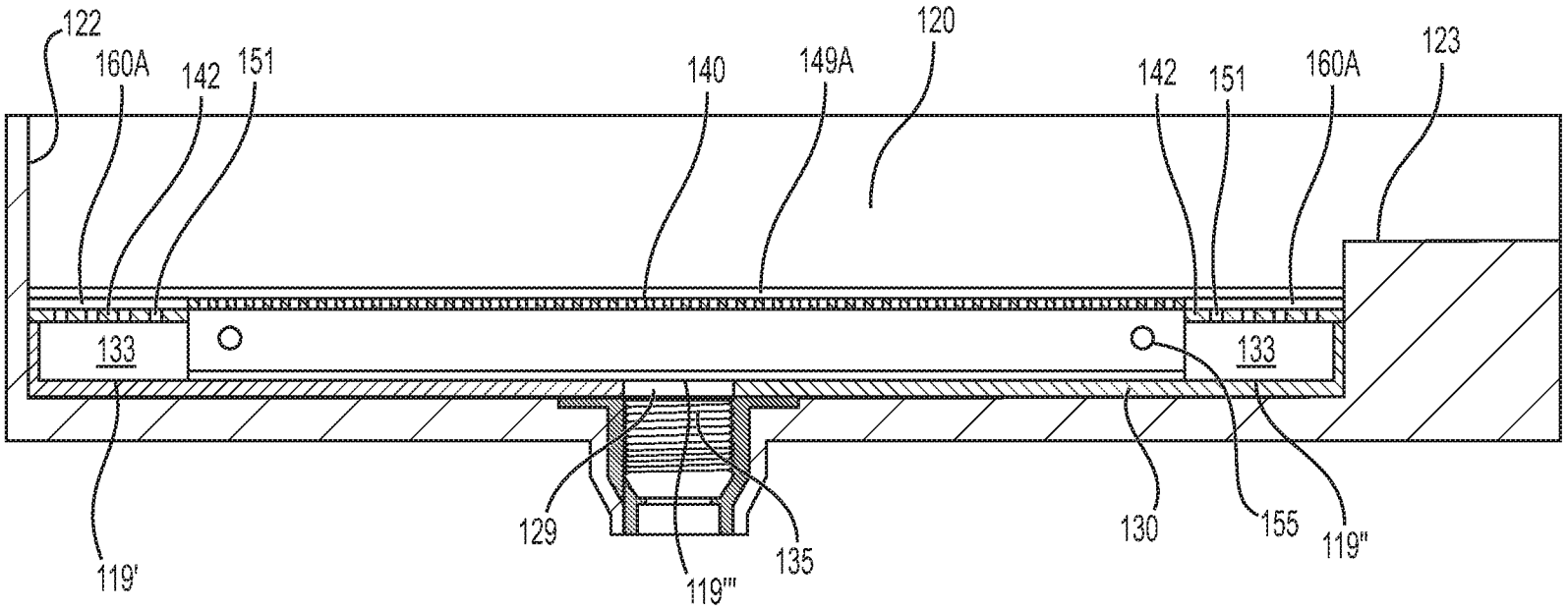
FIG. 14 is a cross-sectional elevational view of the second embodiment taken along lines 14-14 of FIG. 10.
Figure 15:
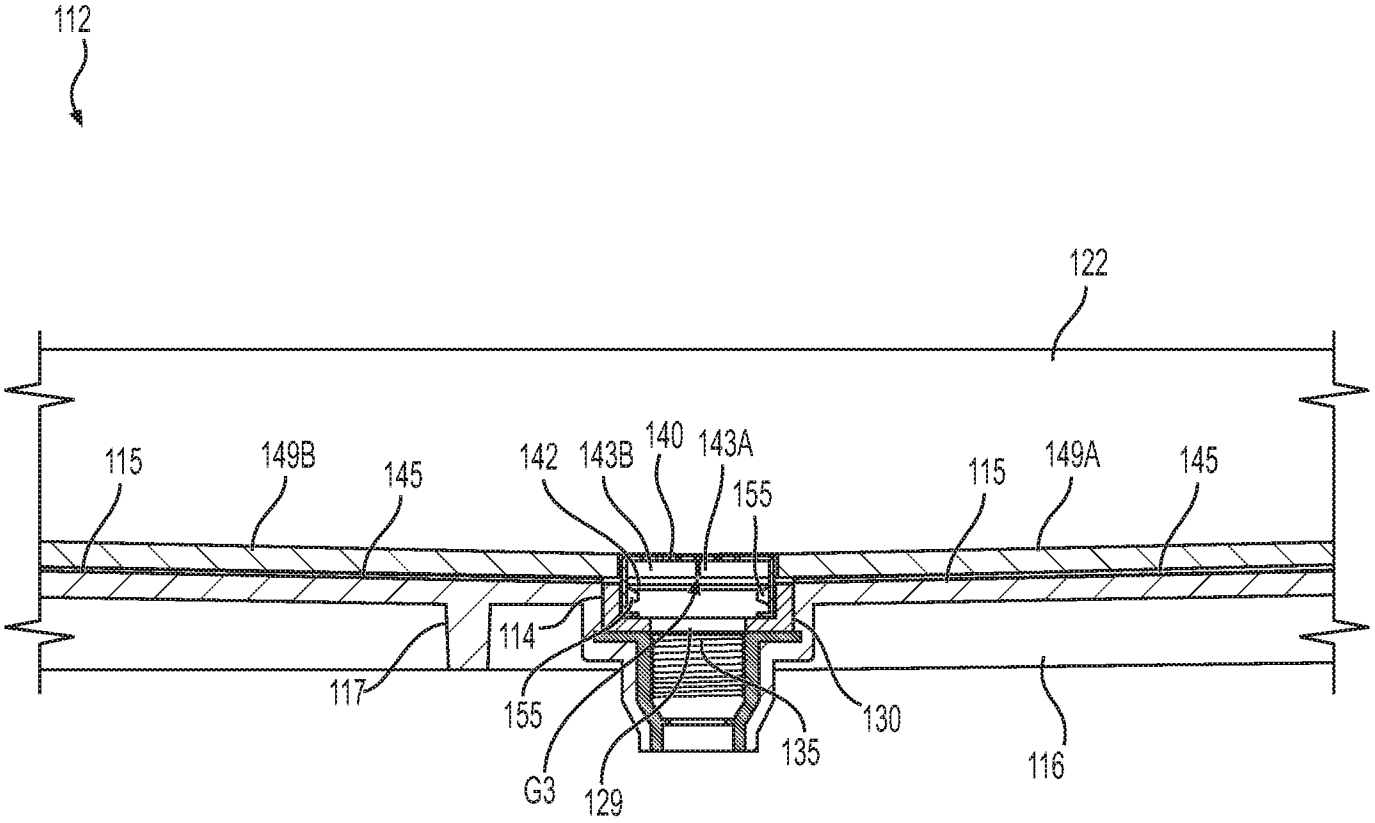
FIG. 15 is a cross-sectional elevational view of the second embodiment taken along lines 15-15 of FIG. 10.

As can be seen from FIGS. 12, 13 and 15, floor sections 115A and 115B may be pitched or sloped toward trench 114 on each side of trench 114.

Trench 114 may be fitted with a trench liner such as liner 130. Liner 130 preferably fits generally within the contours of trench 114 to provide an extra measure of waterproofing and a smooth drainage surface. Liner 130 defines a liner floor 131, which in turn defines a drain aperture 129 adapted to reside in registry with drain fixture or aperture 135 of trench 114. As will occur to those of skill in the art, a drain fitting such as drain fixture or aperture 135 may be used to sealingly secure the wastewater pipe (not shown) to the trench and/or liner. Liner 130 may have sidewalls 133 generally parallel to sidewalls 119A of trench 114. In embodiments, all or a portion of the height of trench liner sidewalls 133 are slightly shorter than the height of trench sidewalls 119A for reasons to be described hereinafter.

Figure 10:
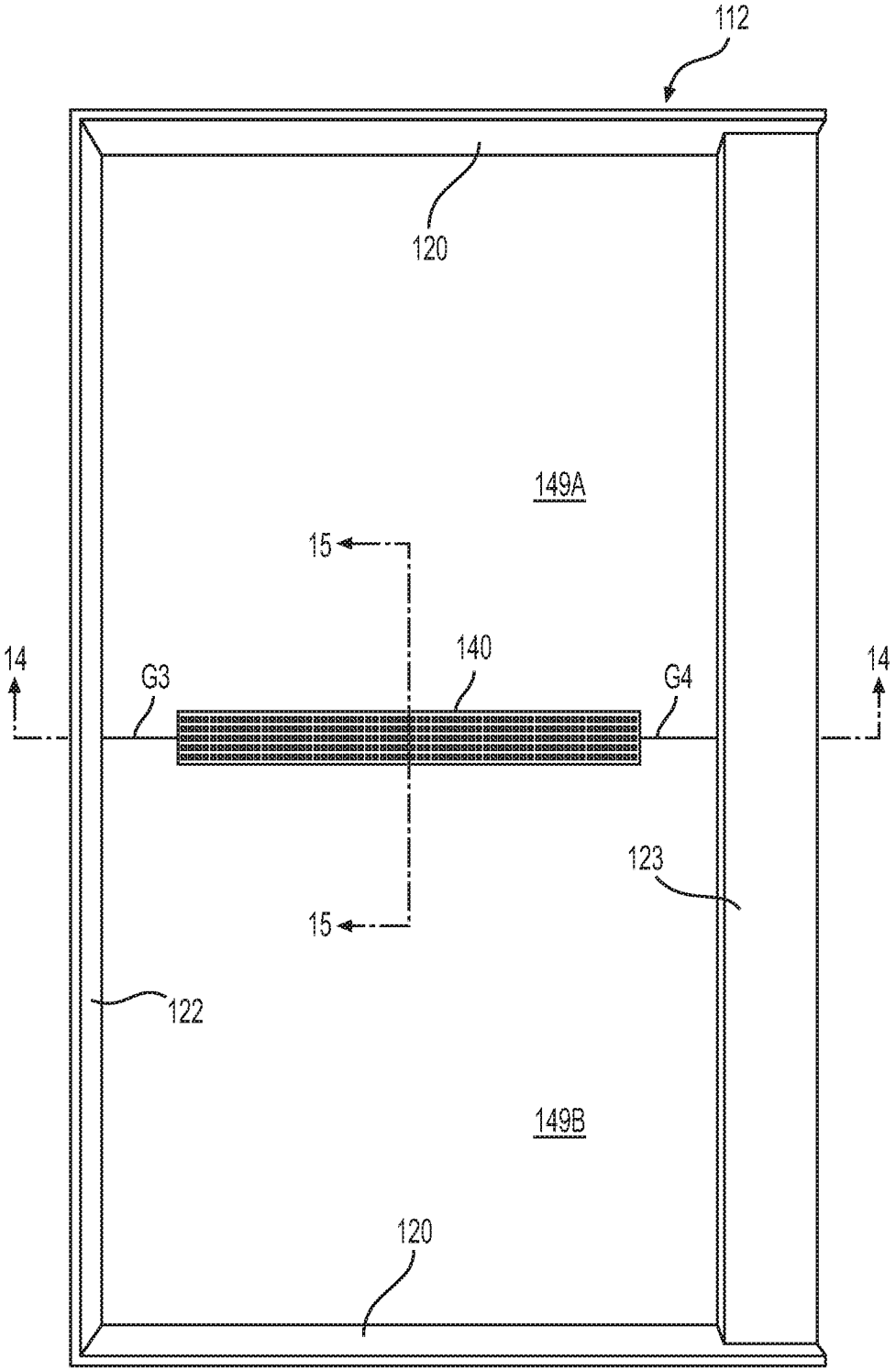
FIG. 10 is an assembled top plan view of a second embodiment of the invention.
Figure 11:
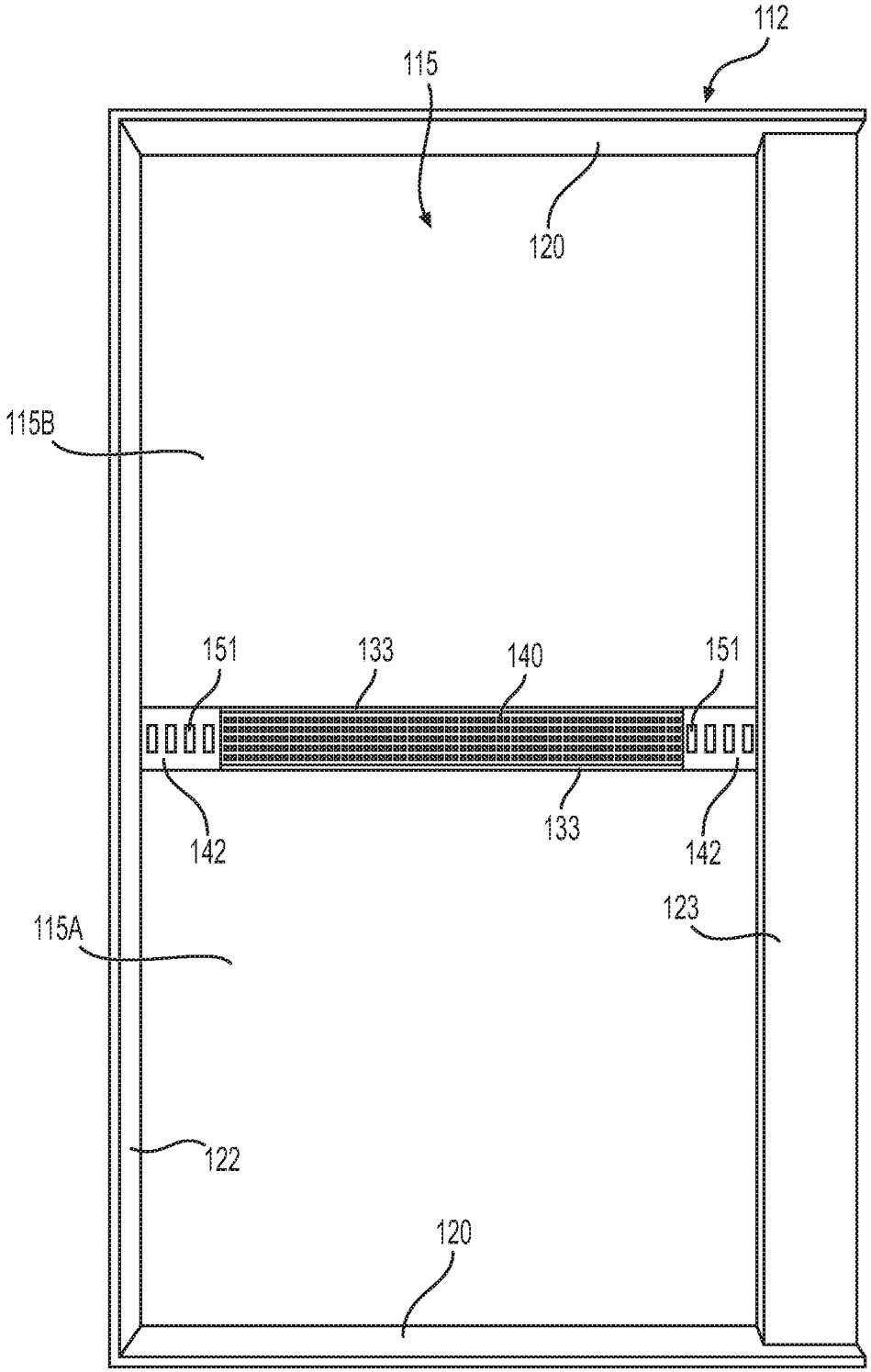
FIG. 11 is top plan view of the second embodiment of the invention with flooring removed.

In embodiments, in situations where a shower trench or trench drain is going to be used other than near the curb or one of the left, right, front or back splash walls (i.e., a "center"-type drain placement), in order to maximize the area on the shower floor that a user can stand on that is not a drain grate, an arrangement can be used as follows: a waterproof pan such as shower pan 112 shown in FIGS. 10-15 is provided, along with a liner such as trench liner 130. In this particular embodiment, a pair of symmetrical right and left floor covering panels 149A and 149B are provided, which, when placed on pan floor 115, cover essentially the entire surface area of floor 115 and trench 114 other than drainage gaps "G3" and "G4" created between said panels and cutouts for the removable drain grates 140 to be discussed in more detail below. The outer edges 161A, 161B and 161C of panel 149A reside in abutting relation with, or in close proximity to, splash walls and curb 120, 122 and 123 on the left side of the pan as viewed from the perspective of FIGS. 10 and 15, and the outer edges 162A, 162B and 162C of panel 149B reside in abutting relation with, or in close proximity to, splash walls and curb 120, 122 and 123 on the opposite side of pan 112, as seen in FIGS. 10 and 15. Floor panels 149A and 149B may be any shower floor covering material including ceramic or porcelain tile, stone, marble, polymer-based material, acrylic, solid surface, metal, or any suitable material for covering a floor from which liquid is to drain.

When floor panels 149A and 149B are situated over pan floor 115, respective edges 160A and 160B thereof rest in opposed relationship to each other. Edges 160A and 160B form two relatively small drainage gaps "G1" and "G2" through which water may drain into trench 114 (in applications where no trench liner is used) and/or trench liner 130. Cutouts 143A and 143B form a larger area into which can be placed a removable drainage grate such as grate 140. Using a removable drainage grate such as grate 140 permits access to the interior of trench liner 130 (or trench 114 where no liner 129 is used) for purposes of cleaning and/or maintenance. Any type of cover structure for removable drain cover 140 is contemplated to be within the scope of the invention, such as apertured (a version of which is shown in FIGS. 10-15), solid (i.e., non-apertured) tileable or non-tilable covers.

In order to provide added support for the portions of floor panels 149A, 149B which sit in registry with trench floor 131 and/or trench liner floor 131, and which therefore are not supported by floor 115, and/or to cover a portion of the trench 114, one or more features, such as substrate grates or panels 142, may be used to span the open area over trench 114 or liner 130. In embodiments, the substrate grates may be one or more slotted or otherwise apertured plates, such as substrate panels 142 shown in FIGS. 11-15, or may be ribs, support struts or other supporting structure spanning across the open area over trench 114 and/or liner 130. The support substrate may also, or alternatively, take the form of columns or pillars supported on trench floor 119 or trench liner floor 131, although any solution which places a drainage obstruction within the trench or trench liner is less desirable.

In embodiments, and as particularly shown in FIG. 12B, the sidewalls 133 of trench liner 130 are shorter than the sidewalls 119A of trench 114, and at least a portion of the upper horizontal edges of liner sidewalls 119A form a shoulder or ledge 144 upon which substrate panels 142 may be supported. In this way, the panels are held against transverse horizontal movement by the sidewalls 119A against which the panels 142 abut, and against vertical downward movement by shoulder 144. The shoulder 144 retains the substrate panels 142 in supported relationship over trench liner floor 131 while the substrate panels 142 may provide support to the sections of flooring material 149A and 149B that overhang the trench 114. In embodiments, the sidewalls 119A of trench liner 130 may terminate at their upper ends in shoulder 144 at a position that renders the upper surfaces of substrate panels 142 coplanar with the upper surface of floor 115, or non-coplanar, depending upon the needs of the particular application. Other structure for supporting panels 142 will occur to those of skill in the art and are considered to be within the scope of the invention.

The first and second floor covering panels 149A, 149B, respectively, define first and second cutouts 143A, 143B to accommodate removable drain grate 140, such that, when the first and second floor covering panels 149A, 149B are associated with the shower pan floor 115 in the manner shown in FIG. 10, the first and second cutouts 43A, 43B provide an area in which the removable drain grate 40 may be removably received. Preferably, the removable drain grate is located substantially adjacent the drain 135 to facilitate cleaning the drain or otherwise gaining access to the drain. However, the removable drain grate 140 need not necessarily be positioned adjacent to the drain 135. In some embodiments, as stated above, the upper edges 144 of side walls 119A of trench liner 130 are sized and shaped so that they are lower than the plane in which floor 115 resides at the transition onto the trench 114, forming a shoulder 144 around a portion of the top of trench liner side walls 119A and within the opening in floor 115 formed by trench 114, as can be seen in FIG. 12B. In this way, substrate panels 142 or other support structure can be supported thereon. As such, by installing flooring material such as floor panels 149A and 149B over the substrate plates 142, the substrate plates become firmly held in place and provide support over the otherwise cantilevered sections of floor panels 149A and 149B which extend out over the opening in floor 115 formed by trench 114.

In the embodiment shown in FIGS. 10-15, although the removable drain cover 140 appears as the only drainage area for the shower, the entirety of gaps "G3" and "G4" also create significant water drainage area but do not present as areas that one would be reluctant to place one's feet on. Such innovative constructions create a unique visual effect and permit ample drainage from the shower, while simultaneously permitting a supplier of showers to offer a wide range of products without having to manufacture and store unique product components for each individual offering.

It can be seen, therefore, that, in some embodiments, a combination shower pan, linear drain and linear drain concealment arrangement is provided, comprised of: a prefabricated shower pan comprising a shower pan floor 115, which may or may not be bounded on one or more sides by upstanding sidewalls 120 and/or 122 and/or curb 123; a recessed linear drain 114 integrally formed within the shower pan floor 115, the trench 114 comprising upstanding trench sidewalls 119A and a trench floor 119; a first substrate drain grate 142A positioned in registry with a first portion 119' of the trench floor 119 (or trench liner floor 131 where a trench liner 130 is employed), a second substrate drain grate 142B positioned in registry with a second portion 119" of the trench floor 119 (or trench liner floor 131 where a trench liner 130 is employed), and a first removable drain grate 140 positioned in registry with a third portion 119''' of trench floor 119 (or trench liner floor 131 where a trench liner 130 is employed) (FIGS. 7-8); a first floor covering panel 149A placed in registry with a first portion 115A of the shower pan floor, the first floor covering panel 149A defining first and second first panel edges 160A; a second floor covering panel 149B placed in registry with a second portion 115B of the shower pan floor 115, the second panel defining first and second second panel edges 160B; the first and second first panel edges 160A being spaced from the first and second second panel edges 160B, respectively, to form first and second drainage gaps G1 and G2 there between; the first substrate drain grate 142A being disposed in registry below the first drainage gap G1, and the second substrate drain grate 142B being in registry below the second drainage gap G2, when the shower pan 112 is in an in-use orientation such as that shown in FIG. 10.

As is evident by a comparison of the embodiment shown in FIGS. 1-9 with the embodiment shown in FIGS. 10-15, the length of the uncovered linear drain (and associated drains covers 40 and 140) may be varied as desired for aesthetic reasons, as can the location of the drainage gaps "G1," "G2," "G3" and "G4" relative to the position of the removable drain covers 41, 140. The openings 51 and 151 in the substrate panels 42, 142, respectively, are shown oriented in a manner as to position as much open area beneath the gaps "G1," "G2," "G3" and "G4" as possible, or at least enough to permit free drainage of water therethrough. However, drainage openings 51 and/or 151 may be oriented, shaped and sized in any desirable manner without departing from the spirit and scope of the invention. For example, the openings may be rectangular and oriented parallel to the elongate length of the linear drains, or may be oriented and/or shaped in any manner.

In other embodiments, the concealed portion of the linear drain may be broken up into more than two sections. In such embodiments, a substrate drain grate may be used under each section of mated floor covering panels which define a drainage gap therebetween, and removable drain grates used in the areas where drain grate cutouts are formed by the respective floor panels as disclosed above. Any configuration of drainage gaps and drain grate cutouts may be employed within the scope of the invention.

Referring now to FIGS. 16-21, there is shown an embodiment in accordance with certain of the teachings of the invention. This embodiment comprises a one-piece prefabricated shower pan 212 with an integrally molded trench 214. The pan 212 is comprised of a pitched floor 215 (which is preferably planar and pitched toward trench 214) defining bottom surface 216 thereof, whether with or without ribs 217, and may include such additional features as one or more curbs 218, one or more side splash walls 220, and one or more rear splash walls 222. Accessory features of shower pans are well known, and it is contemplated that such features may or may not be used in connection with the embodiments disclosed herein. In addition, other known accessory features (such as barrier-free entrances) may be employed without departing from the spirit and scope of the invention.

Trench 214 is defined by a trench floor 219 and trench sidewalls 219A. Any one of trench sidewalls 219A may coincide with (i.e., be co-planar with) the inner-facing surface of rear splash wall 222 and/or either of side splash walls 220, or may coincide with any combination of the splash walls, or trench sidewalls 219A may be independent of, and not coincident with (i.e., adjacent), splashwalls 220 or 222. In the configuration shown, which is a type of "side" drain shower, the trench is located adjacent the right splashwall 220.

In this embodiment, a drain fixture or fitting 235 (or which may simply be a drain aperture defined by trench floor 219 or trench liner floor 331) is defined by and/or integrated with trench floor 219A, which may be integrated during manufacture of the pan floor or the trench (which is sometimes the case for prefabricated components or completed prefabricated pans) or created or integrated/installed in situ. The location of drain fixture or aperture 235 relative to the pan floor 215 is usually determined by the location of the wastewater pipe (not shown) in the sub-floor.

As can be seen from FIGS. 12A and 13-15, floor 215 may be pitched or sloped toward trench 214.

Trench 214 may be fitted with a trench liner such as liner 230. Liner 230 preferably fits generally within the contours of trench 214 to provide an extra measure of waterproofing and a smooth drainage surface. Liner 230 defines a liner floor 231, which in turn defines a drain aperture 229 adapted to reside in registry with drain fixture or aperture 235 of trench 214. As will occur to those of skill in the art, a drain fitting such as drain fixture or aperture 235 may be used to sealingly secure the wastewater pipe (not shown) to the trench and/or liner. Liner 230 may have sidewalls 233 generally parallel to sidewalls 219A of trench 214. In embodiments, at least a portion of the height of trench liner sidewalls 233 are slightly shorter than the height of trench sidewalls 219A for reasons to be described hereinafter.

In embodiments, an arrangement can be used as follows: a waterproof pan such as shower pan 212 shown in FIGS. 16-21 is provided, along with a liner such as trench liner 230. In this particular embodiment, a floor covering panel 249 is provided, which, when placed on pan floor 215, covers essentially the entire surface area of floor 215 other than drainage gaps "G5" and "G6," created between edges 260 of said floor panels and splashwall 220, and by the cutouts for removable drain grate 240 to be discussed in greater detail below. The outer edges 262A, 262B and 262C of panel 249 reside in abutting relation with, or in close proximity to, splash walls and curb 220, 222 and 223 on the rear, left side and front of the pan as viewed from the perspective of FIG. 16. Floor panel 249 may be any shower floor covering material including ceramic or porcelain tile, stone, marble, polymer-based material, acrylic, solid surface, metal, or any suitable material for covering a floor from which liquid is to drain.

When floor panel 249 is situated over pan floor 215, edges 260 thereof rest in opposed relationship to portions of right splashwall 220. Edges 260 and right splashwall 220 form two relatively small drainage gaps "G5" and "G6" through which water may drain into trench 214 (in applications where no trench liner is used) and/or trench liner 230. Cutout 243 forms an area into which can be placed a removable drainage grate such as drain cover 240. Any type of cover structure for removable drain cover 240 is contemplated to be within the scope of the invention, such as apertured, non-apertured, tileable (a version of which is shown in FIGS. 16-21) or non-tilable covers.

In order to provide added support for the portions of floor panel 249 which sit in registry with trench floor 231 and/or trench liner floor 231, and which therefore are not supported by floor 215, and/or to cover a portion of the trench 214, one or more features, such as substrate grates or panels 242, may be used to span the open area over trench 214 or liner 230. In embodiments, the support panels may be one or more slotted or otherwise apertured plates, such as plates 242, or may be ribs, support struts or other supporting structure spanning across the open area over trench 214 and/or liner 230. The support substrate may also, or alternatively, take the form of columns or pillars supported on trench floor 219 or trench liner floor 231, although any solution which places a drainage obstruction within the trench or trench liner is less desirable.

In embodiments, and as particularly shown in FIGS. 18A, 18B, 18C and 19, at least a portion of the sidewalls 233 of trench liner 230 are shorter than the sidewalls 219A of trench 214, and the upper horizontal edges of liner sidewalls 233 form a shoulder or ledge 244 upon which substrate panels 242 may be supported. In this way, the panels are held against transverse horizontal movement by the sidewalls 219A against which the panels 242 abut, and against vertical downward movement by shoulder 244. The shoulder 244 retains the substrate panels 242 in supported relationship over trench liner floor 231 while the substrate panels 242 may provide support to the sections of flooring material 249 that overhang the trench 214. In embodiments, the sidewalls 233 of trench liner 230 may terminate at their upper ends in shoulder 244 at a position that renders the upper surfaces of substrate panels 242 coplanar with the upper surface of floor 215, or non-coplanar, depending upon the needs of the particular application. Other structure for supporting panels 242 will occur to those of skill in the art and are considered to be within the scope of the invention.

The floor covering panel 249 defines a cutout 243 to accommodate removable drain grate 240, such that, when the floor covering panels 249 is associated with the shower pan floor 215, the cutout 243 provides an area in which the removable drain grate 240 may be removably received. Preferably, the removable drain grate is located substantially adjacent the drain 235 to facilitate cleaning the drain or otherwise gaining access to the trench and wastewater pipe. As stated previously, in some embodiments, portions of the upper edges 244 of side walls 233 of trench liner 230 are sized and shaped so that they are lower than the plane in which floor 215 resides at the transition into the trench 214, forming a shoulder 244 around a portion of the top of trench liner side walls 233 and within the opening in floor 215 formed by trench 214. In this way, substrate panels 242 or other support structure can be supported thereon. Then, by installing flooring material such as floor panel 249 over the substrate plates 242, the substrate plates become firmly held in place and may provide support over the otherwise cantilevered sections of floor panels 249 which extend out over the opening in floor 25 formed by trench 214.

In the embodiment shown in FIGS. 16-21, although the removable drain cover 240 appears as the only drainage area for the shower, the entirety of gaps "G5" and "G6" also create significant water drainage area but do not present as areas that one would be reluctant to place one's feet on, and permit the use of smaller removable drain grate 240, which in turn results in a removable drain grate that is lighter and easier to remove and manipulate. Such innovative constructions create a unique visual effect and permit ample drainage from the shower, while simultaneously permitting a supplier of showers to offer a wide range of attractive products without having to manufacture and store unique product components for each individual offering.

Figure 16:
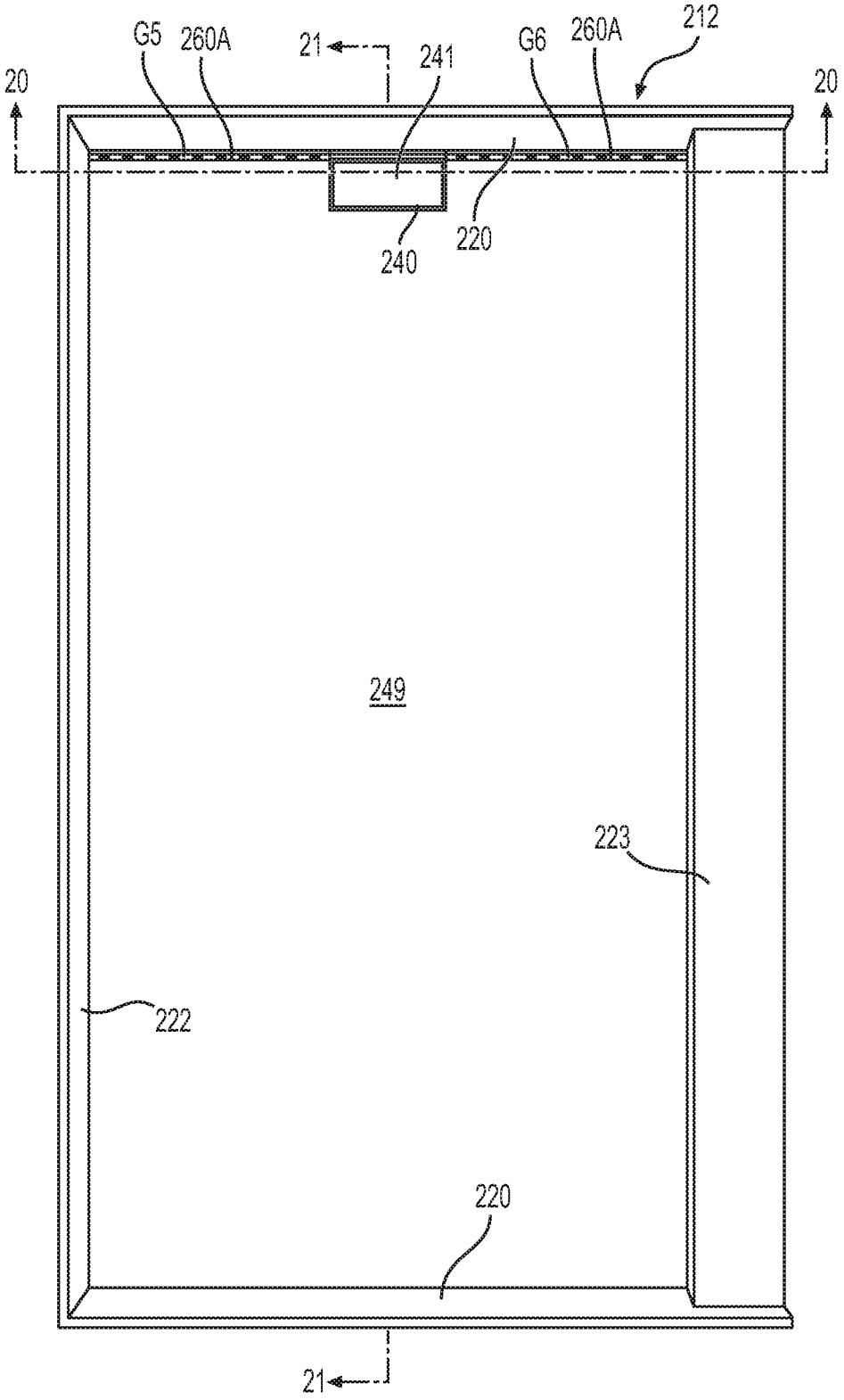
FIG. 16 is an assembled top plan view of a third embodiment of the invention.
Figure 17:
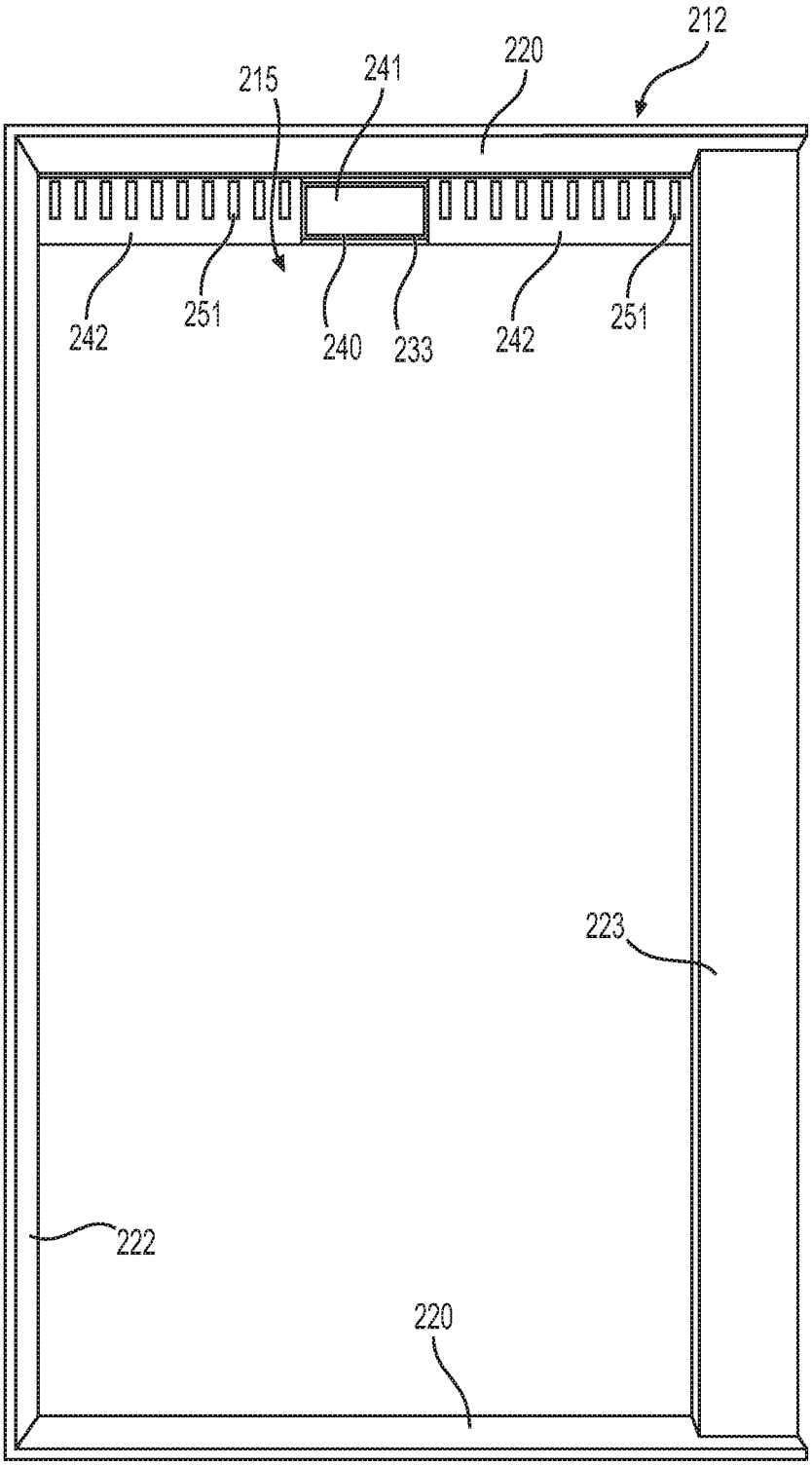
FIG. 17 is top plan view of the third embodiment of the invention with flooring removed.
Figure 18A:
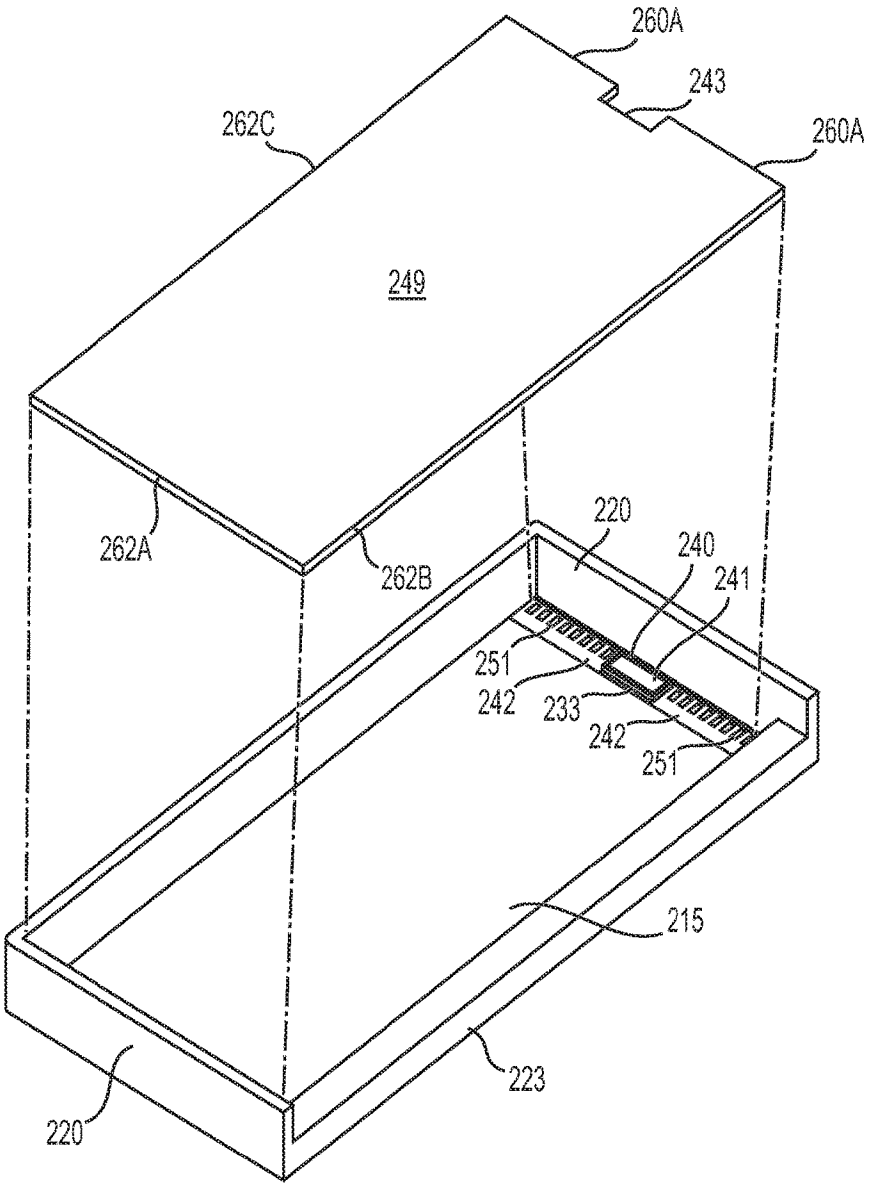
FIG. 18A is a partially exploded perspective view of the third embodiment of the invention.
Figure 18B:
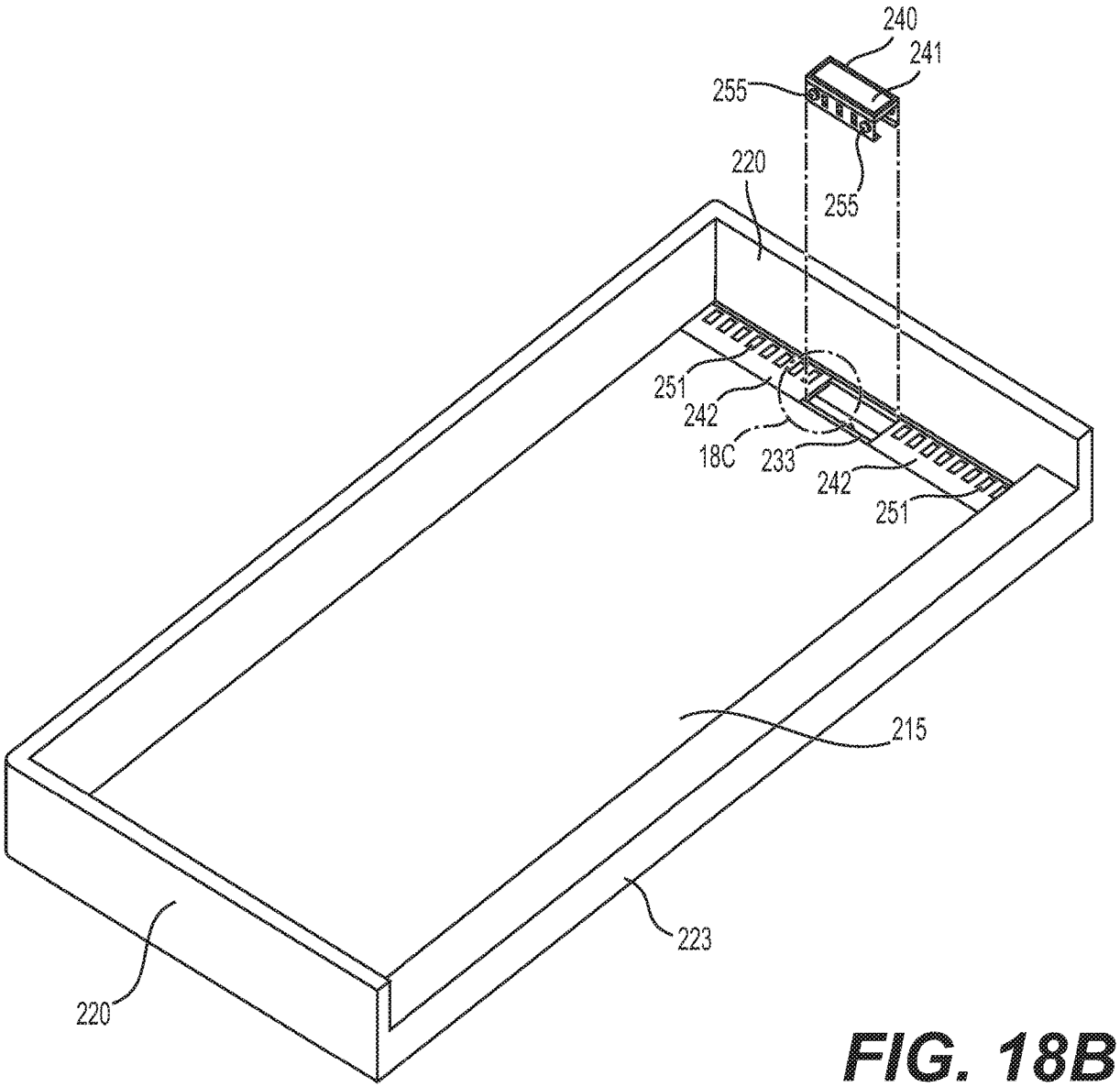
FIG. 18B is a partially exploded perspective view of the third embodiment of the invention with a removable drain grate raised from its in-use position.
Figure 18C:
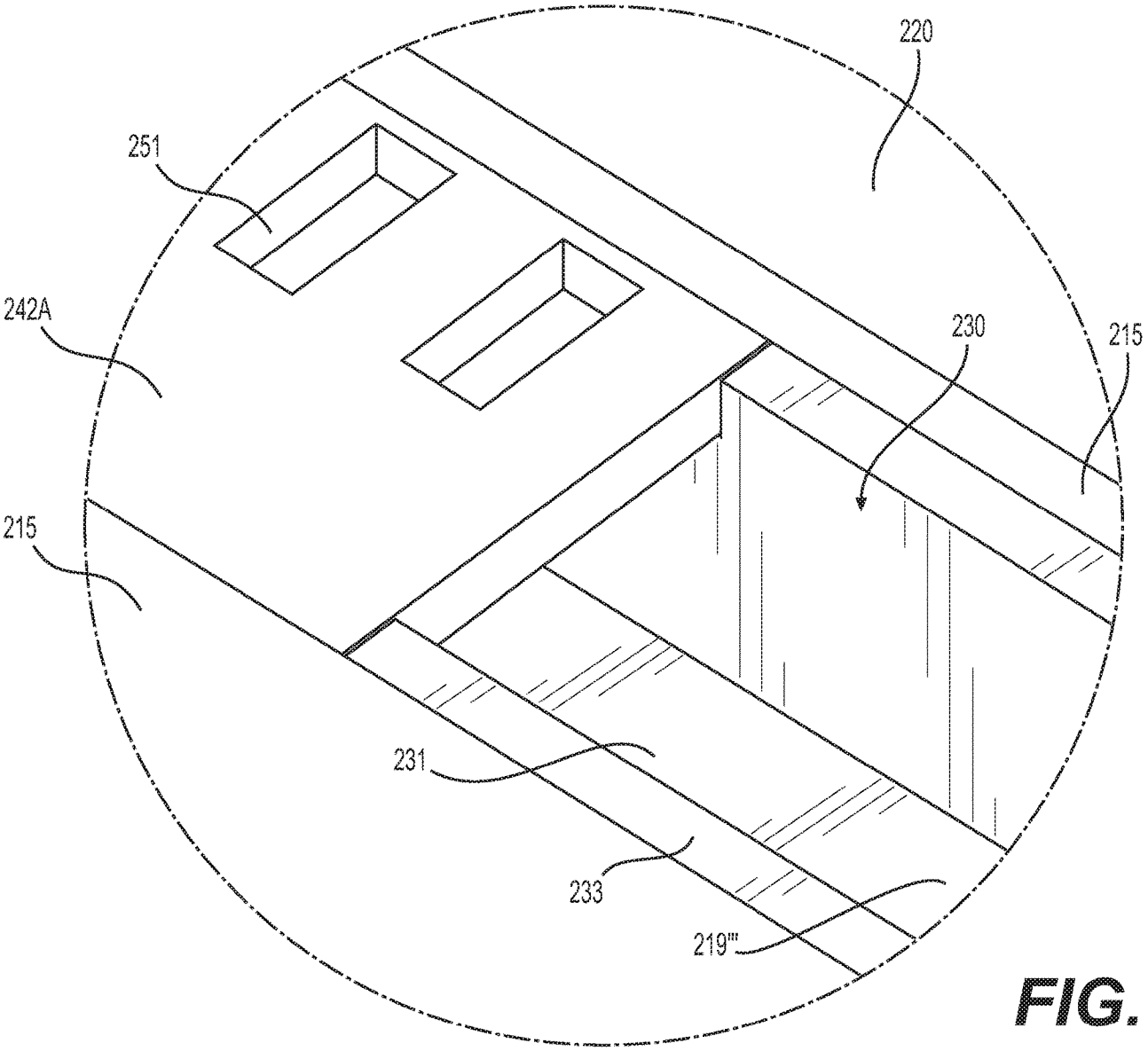
FIG. 18C is a close-up of the area of detail shown in FIG. 18B.
Figure 21:
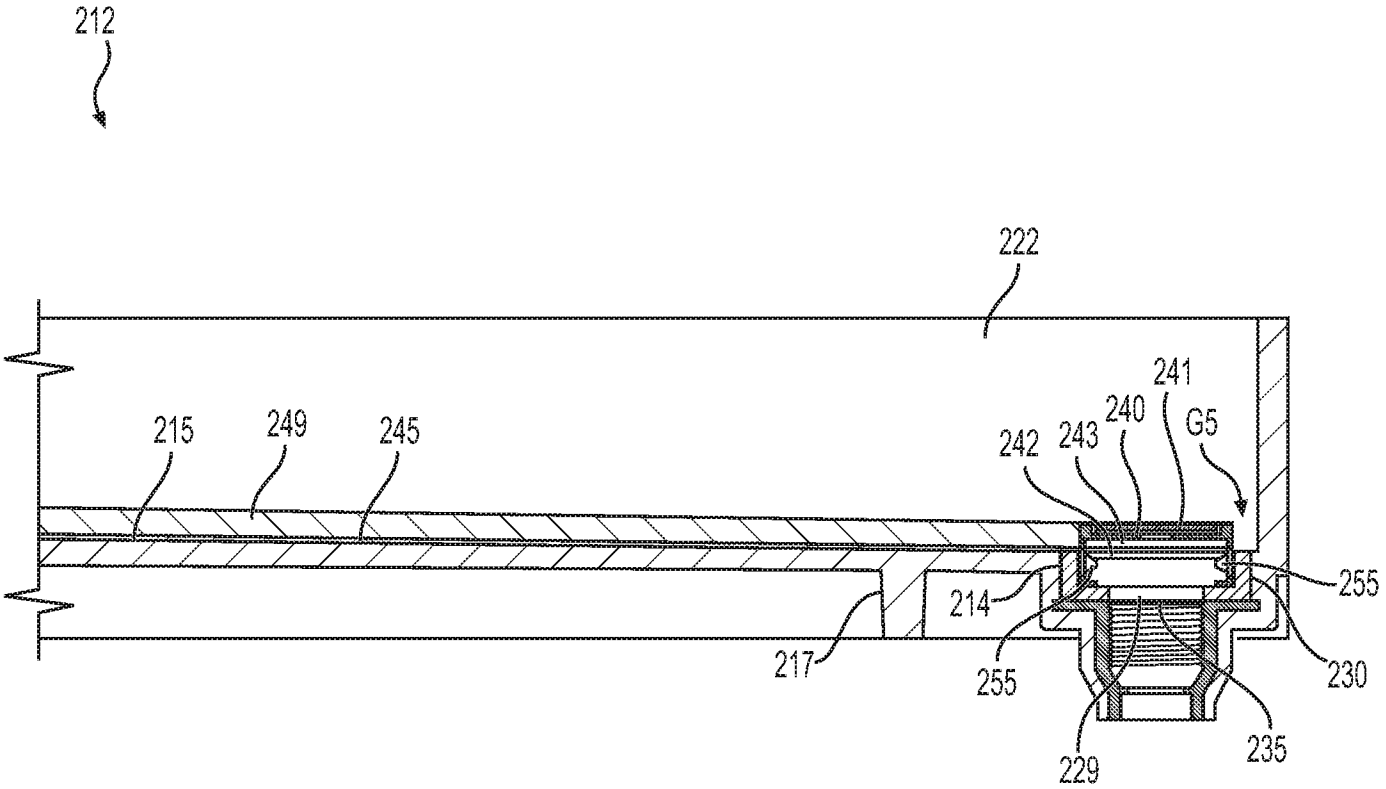
FIG. 21 is a cross-sectional elevational view of the third embodiment taken along lines 21-21 of FIG. 16.

It can be seen, therefore, that, in some embodiments, a combination shower pan, linear drain and linear drain concealment arrangement is provided, comprised of: a prefabricated shower pan comprising a shower pan floor 215, which is bounded on at least one or more sides by an upstanding splashwall 220 (and potentially additionally rear splashwall 222 and/or curb 223); a recessed linear drain 214 integrally formed within the shower pan floor 215, the linear drain 214 comprising upstanding trench sidewalls 219A and a trench floor 219; a first substrate drain grate 242A positioned in registry with a first portion 219' of the trench floor, a second substrate drain grate 242B positioned in registry with a second portion 219" of the trench floor, and a removable drain grate 240 positioned in registry with a third portion 219'" of trench floor 219; a floor covering panel 249 placed in registry with the shower pan floor 215, the floor covering panel 249 defining first and second first panel edges 260; the first and second first panel edges 260 being spaced from the upstanding splashwall to form first and second drainage gaps "G5" and "G6" there between; the first substrate drain grate 242A being disposed in registry below the fifth drainage gap G5, the second substrate drain grate 242B being in registry below the sixth drainage gap G6 when the shower pan 212 is in an in-use orientation such as that shown in FIGS. 16 and 21.

In addition, the flooring panel 249 defines a cutout 243 which defines an open area in the flooring panel 249 which is adapted to receive the removable drain grate 240.

As discussed above, substrate drain panels may be dispensed with altogether, or other support structure such as ribs or struts may be used to support the sections of floor covering material which overhangs the trench floor or trench liner floor.

Removable drain grates 40, 140 and 240 may be removably retained in position in the respective floor panel cutouts by friction fit or by mechanical retention structure such as resilient tabs 55, 155 and 255, respectively.

FIGS. 22-30 depict a further, fourth, embodiment of the invention in which a portion of a drainable surface 312 is provided and into which has been associated a linear drain such as integrated trench 314. Auxiliary features such as splashwalls and curbs shown in connection with other embodiments are not depicted as they are unnecessary to this embodiment. This embodiment comprises a one-piece prefabricated shower floor member 315 with an integrally molded trench 314. The floor 315 is comprised of first and second pitched floor sections 315A, 315B (which are preferably planar on either side of the trench 314) and defines a bottom surface 316 thereof, whether with or without ribs 317.

Trench 314 is defined by a trench floor 319 which defines a drain opening or aperture into which may be fitted a drain fitting 335, either in the field, during manufacturing, or otherwise. Trench 314 defines sidewalls 319A as well.

Floor 315 may be pitched or sloped toward trench 314 on each side of trench 314. A standard slope is ¼ inch per foot, although any pitch which will accomplish the task of causing liquid to drain from floor 315 (or, in embodiments, whatever covering material is situated thereon, such as floor tile panels 349) into trench 314 is deemed to be within the scope of the invention.

Trench 314 may be fitted with a trench liner such as liner 330. Liner 330 preferably fits generally within the contours of trench 314 to provide an extra measure of waterproofing and a smooth drainage surface. Liner 330 defines a liner floor 331, which in turn defines a drain aperture 329 adapted to reside in registry with drain fixture or aperture 335 of trench 314. As will occur to those of skill in the art, drain fitting such as drain fixture or aperture 335 may be used to sealingly secure the wastewater pipe (not shown) to the trench and/or liner. Liner 330 may have sidewalls 333 generally parallel to sidewalls 319A of trench 314. In embodiments, at least a portion of the height of trench liner sidewalls 333 are slightly shorter than the height of trench sidewalls 319A for reasons to be described hereinafter.

In embodiments, in situations where a linear drain is going to be used other than near the curb or one of the left, right, front or back splash walls (i.e., a "center"-type drain placement), in order to maximize the area on the shower floor that a user can stand on that is not a drain grate, an arrangement can be used as follows: a waterproof surface such as shower floor 312 shown in FIGS. 22-30 is provided, along with a linear drain 314 and liner therefore such as trench liner 330. In this particular embodiment, a pair of symmetrical floor covering panels 349A and 349B are provided, which, when placed on pan floor 312, cover essentially the entire surface area of floor sections 315A and 315B other than drainage gaps "G9" and "G10" created between said panels and cutouts for removable drain grates 340 to be discussed in greater detail below. Floor panels 349A and 349B may be any shower floor covering material including ceramic or porcelain tile, stone, marble, polymer-based material, acrylic, solid surface, metal, or any suitable material for covering a floor from which liquid is to drain.

When floor panels 349A and 349B are situated over pan floor 312, respective edges 360A and 360B thereof rest in opposed relationship to each other. Edges 360A and 360B form a pair of relatively small drainage gaps "G9" and "G10" through which water may drain into trench 314 (in applications where no trench liner is used) and/or trench liner 330. Cutouts 343A and 343B form a larger area into which can be placed a removable drainage grate such as grate 340. Using a removable drainage grate such as grate 340 permits access to the interior of trench liner 330 (or trench 314 where no liner 330 is used) for purposes of cleaning and/or maintenance. Any type of cover structure for removable drain cover 340 is contemplated to be within the scope of the invention, such as apertured (a version of which is shown in FIGS. 22-30), tileable or non-tilable covers.

In order to provide added support for the portions of floor panels 349A, 349B which sit in registry with trench floor 319 and/or trench liner floor 331, and which therefore are not supported by floor 312, and/or to cover a portion of the trench 314, one or more features, such as substrate grates or panels 342, may be used to span the open area over trench 314 or liner 330. In embodiments, the support panels may be one or more slotted or otherwise apertured plates, such as plates 342 shown in FIGS. 23, 26A and 26B, or may be ribs, support struts or other supporting structure spanning across the open area over trench 314 and/or liner 330. The support substrate may also, or alternatively, take the form of columns or pillars supported on trench floor 319 or trench liner floor 331, although any solution which places a drainage obstruction within the trench or trench liner is less desirable.

Figure 26A:
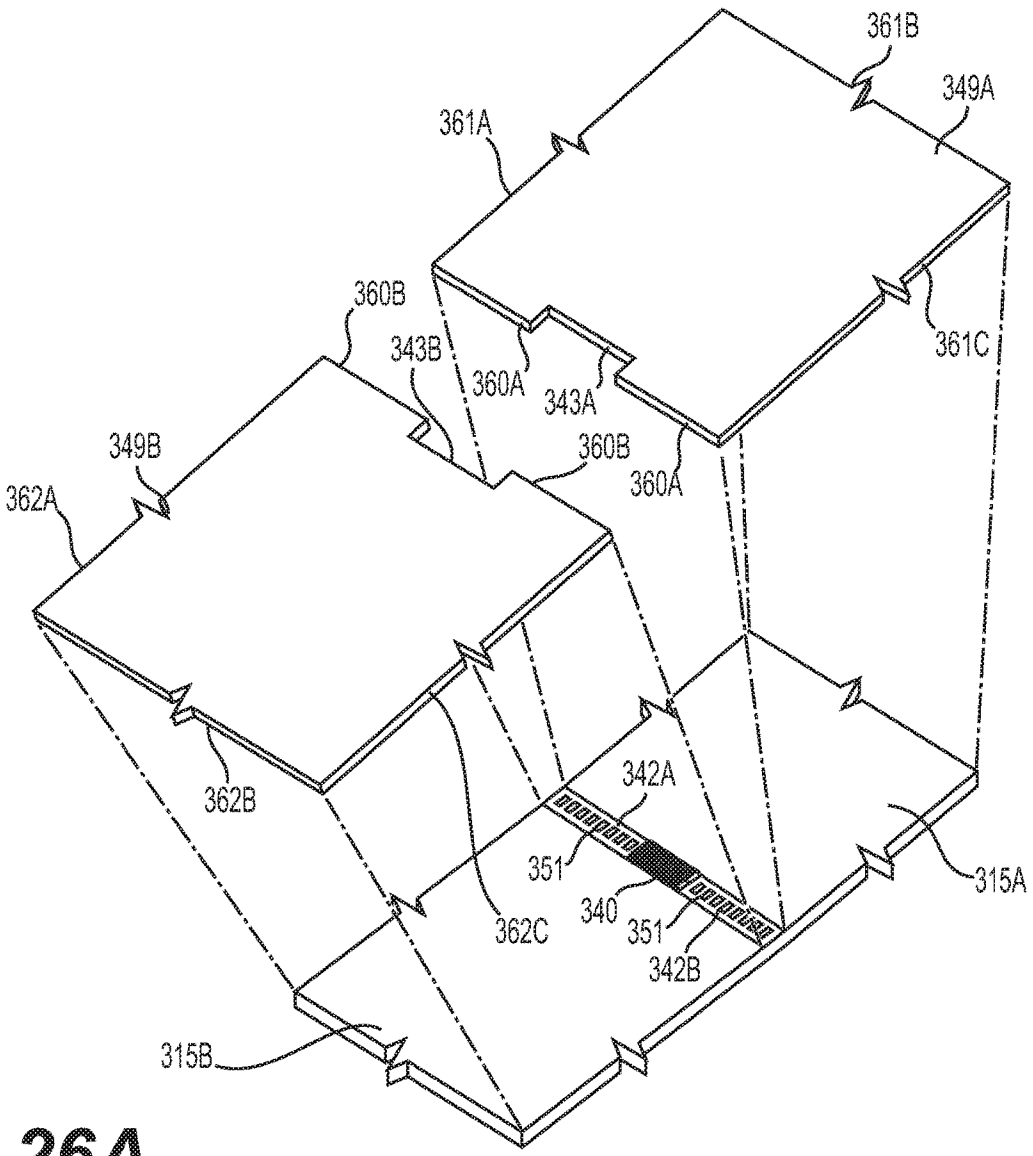
FIG. 26A is a partially exploded view of the fourth embodiment of the invention.
Figure 26B:
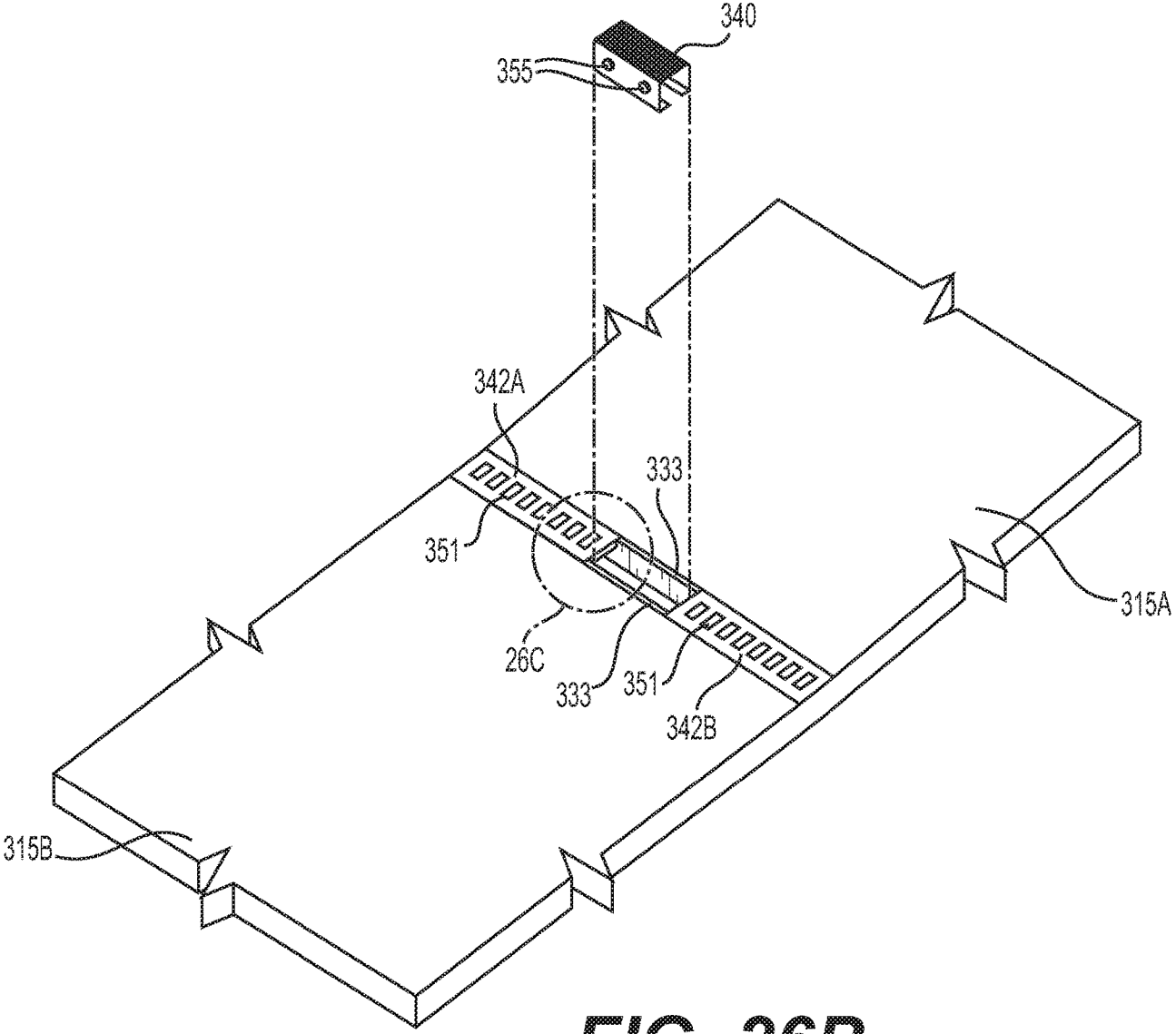
FIG. 26B is a perspective view of the fourth embodiment of the invention with a removable drain grate raised from its in-use position.
Figure 26C:
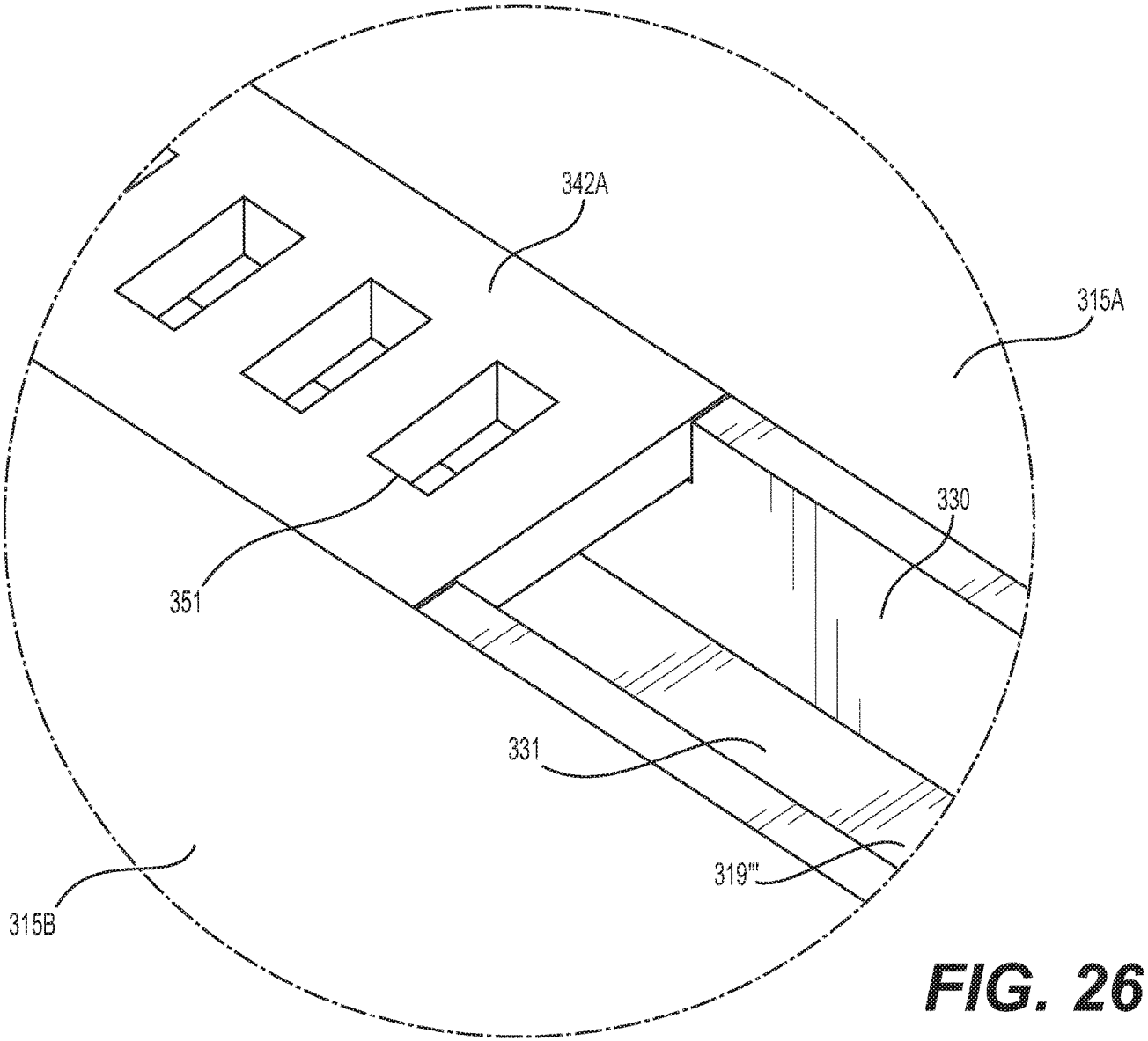
FIG. 26C is an enlargement of the area of detail shown in FIG. 26B.
Figure 27:
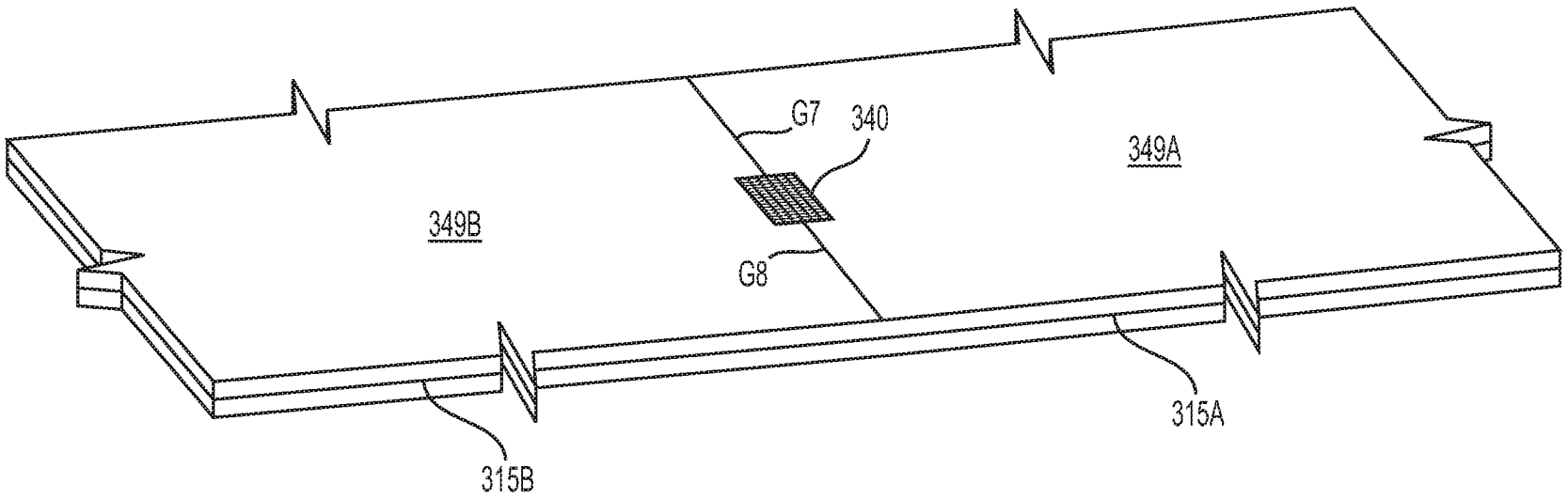
FIG. 27 is a perspective assembled view of the fourth embodiment of the invention.
Figure 28:
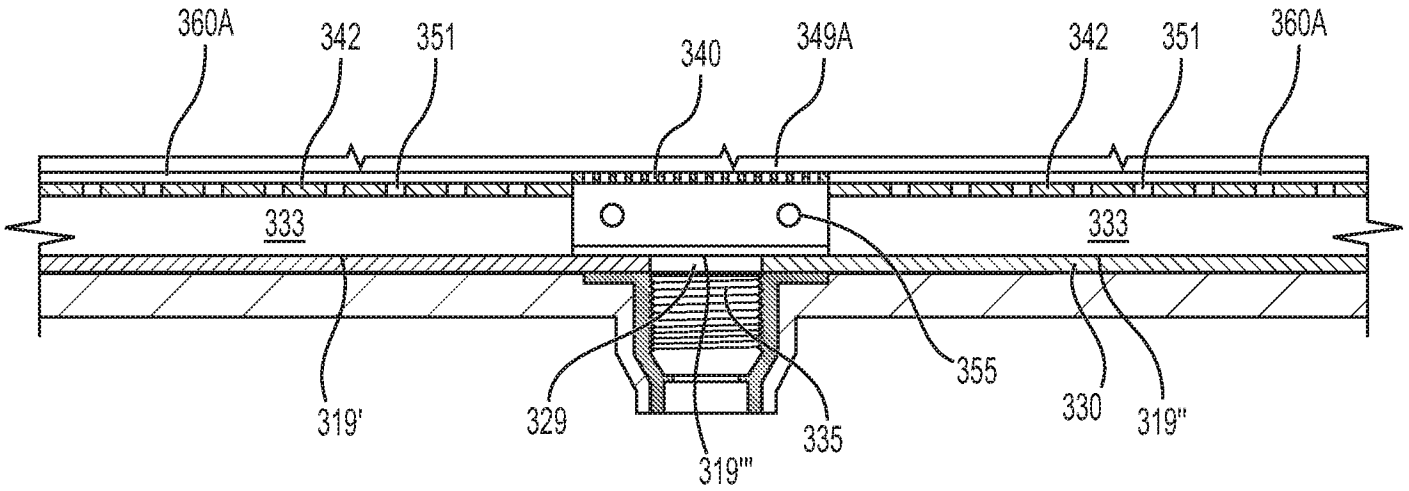
FIG. 28 is a cross-sectional elevational view taken along lines 28-28 of FIG. 22
Figure 29:
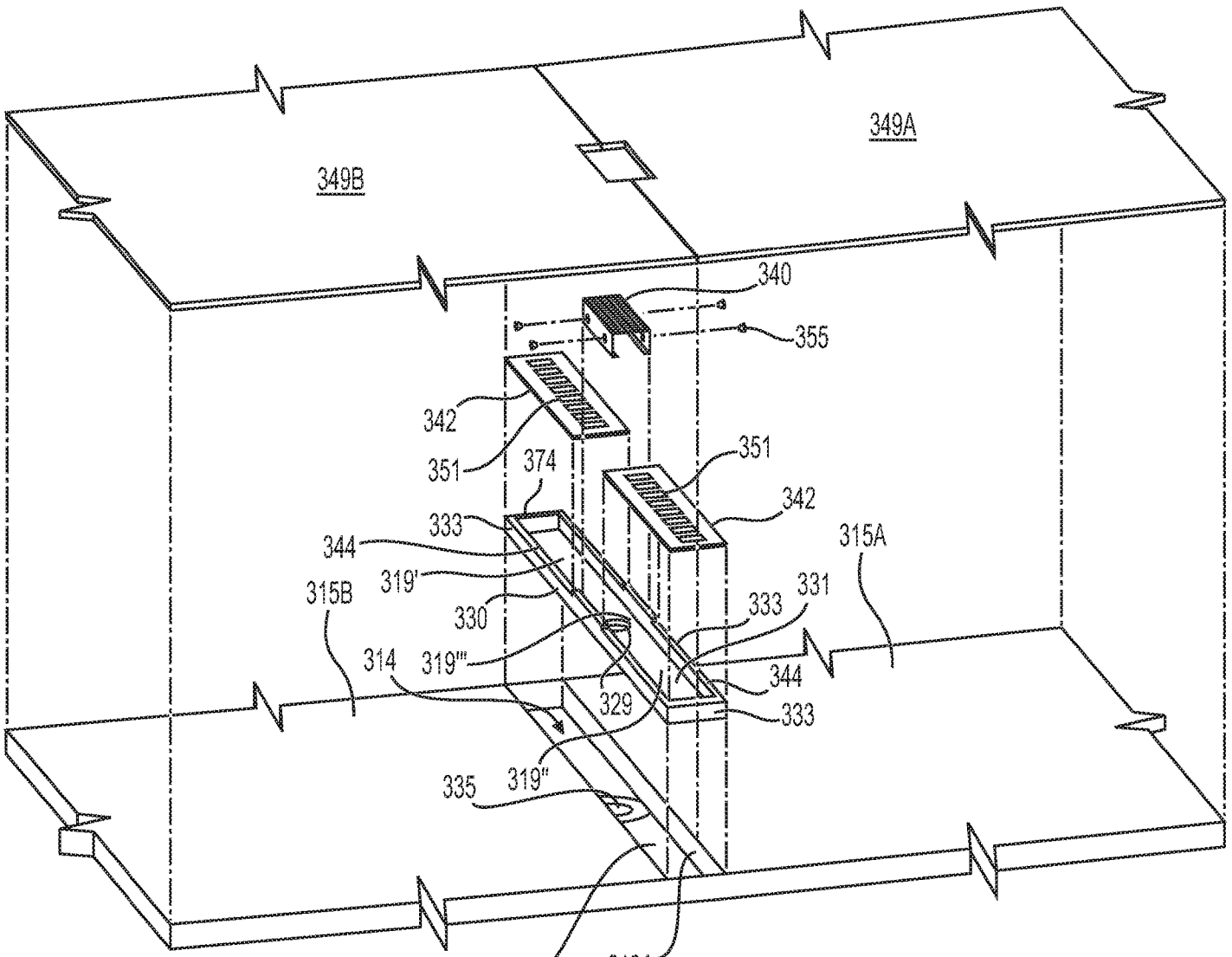
FIG. 29 is an exploded perspective view of the fourth embodiment of the invention.
Figure 30:
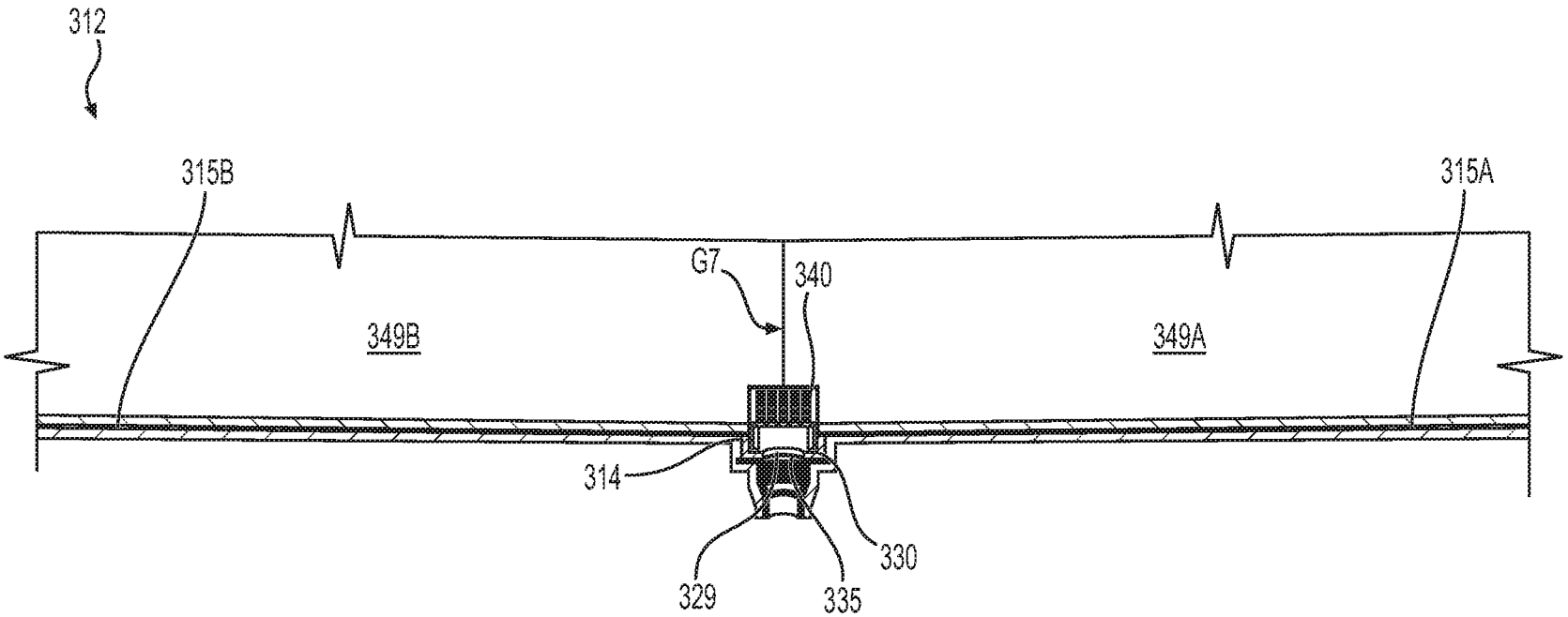
FIG. 30 is a perspective cross-sectional elevation of you of the fourth embodiment of the invention.

In embodiments, and as particularly shown in FIGS. 26B and 26C, at least a portion of the sidewalls of trench liner 330 are shorter than the sidewalls 319A of trench 314, and the upper horizontal edges of liner sidewalls 319A form a shoulder or ledge 344 upon which substrate panels 342 may be supported. In this way, the panels are held against transverse horizontal movement by the sidewalls 319A against which the panels 342 abut, and against vertical downward movement by shoulder 344. The shoulder 344 retains the substrate panels 342 in supported relationship over trench liner floor 3331 while the substrate panels 42 provide support to the sections of flooring material 349A and 349B that overhang the trench 314. In embodiments, the sidewalls 319A of trench liner 330 may terminate at their upper ends in shoulder 344 at a position that renders the upper surfaces of substrate panels 342 coplanar with the upper surface of floor 315, or non-coplanar, depending upon the needs of the particular application. Other structure for supporting panels 342 will occur to those of skill in the art and are considered to be within the scope of the invention.

The first and second floor covering panels 349A, 349B, respectively, define first and second cutouts 343A, 343B to accommodate removable drain grate 340, such that, when the first and second floor covering panels 349A, 349B are associated with the shower pan floor 312 in the manner shown in FIGS. 22-30, the first and second cutouts 343A, 343B provide an area in which the removable drain grate 340 may be removably received. Preferably, the removable drain grate is located substantially adjacent the drain 335 to facilitate cleaning the drain or otherwise gaining access to the drain. However, the removable drain grate 340 need not necessarily be positioned adjacent to the drain 335. In some embodiments, as stated above, the upper edges 344 of side walls 319A of trench liner 330 are sized and shaped so that they are in part lower than the plane in which floor 312 resides at the transition onto the trench 314, forming a shoulder 344 around a portion of the top of trench liner side walls 319A and within the opening in floor 315 formed by trench 314, as can be seen in FIG. 26B. In this way, substrate panels 342 or other support structure can be supported thereon. Then, by installing flooring material such as floor panels 349 over the substrate plates 342, the substrate plates become firmly held in place and provide support over the otherwise cantilevered sections of floor panels 349A and 349B which extend out over the opening in floor 312 formed by trench 314.

In the embodiment shown in FIGS. 22-30, although the removable drain cover 340 appears as the only drainage area for the shower, the entirety of gaps "G9" and "G10" also create significant water drainage area but do not present as areas that one would be reluctant to place one's feet on, and permit the use of smaller removable drain grate 340, which in turn results in a removable drain grate that is lighter and easier to remove and manipulate. Such innovative constructions create a unique visual effect and permit ample drainage from the shower, while simultaneously permitting a supplier of showers to offer a wide range of attractive products without having to manufacture and store unique product components for each individual offering.

Figure 22:
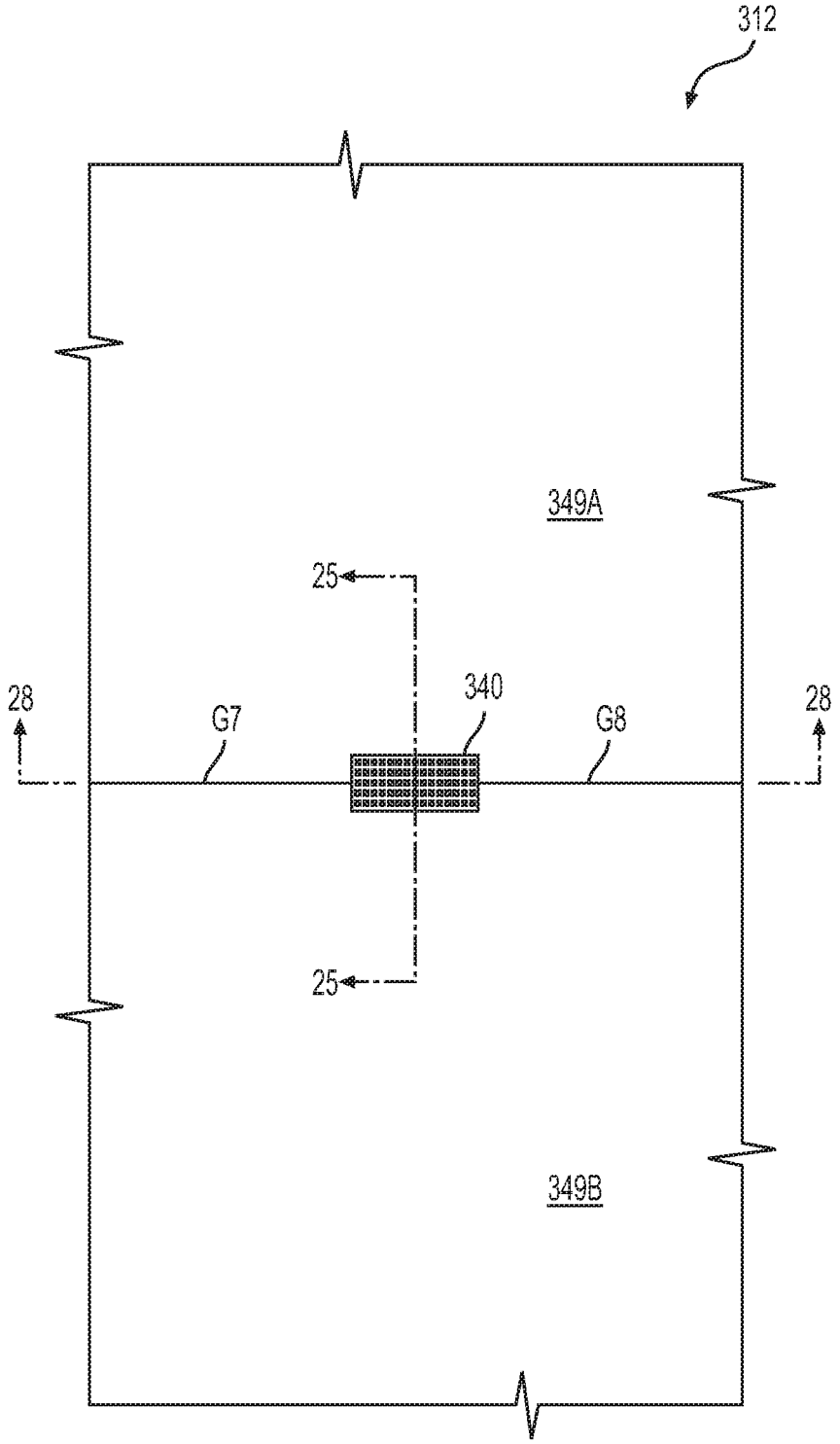
FIG. 22 is a top plan view of a fourth embodiment of the invention.
Figure 23:
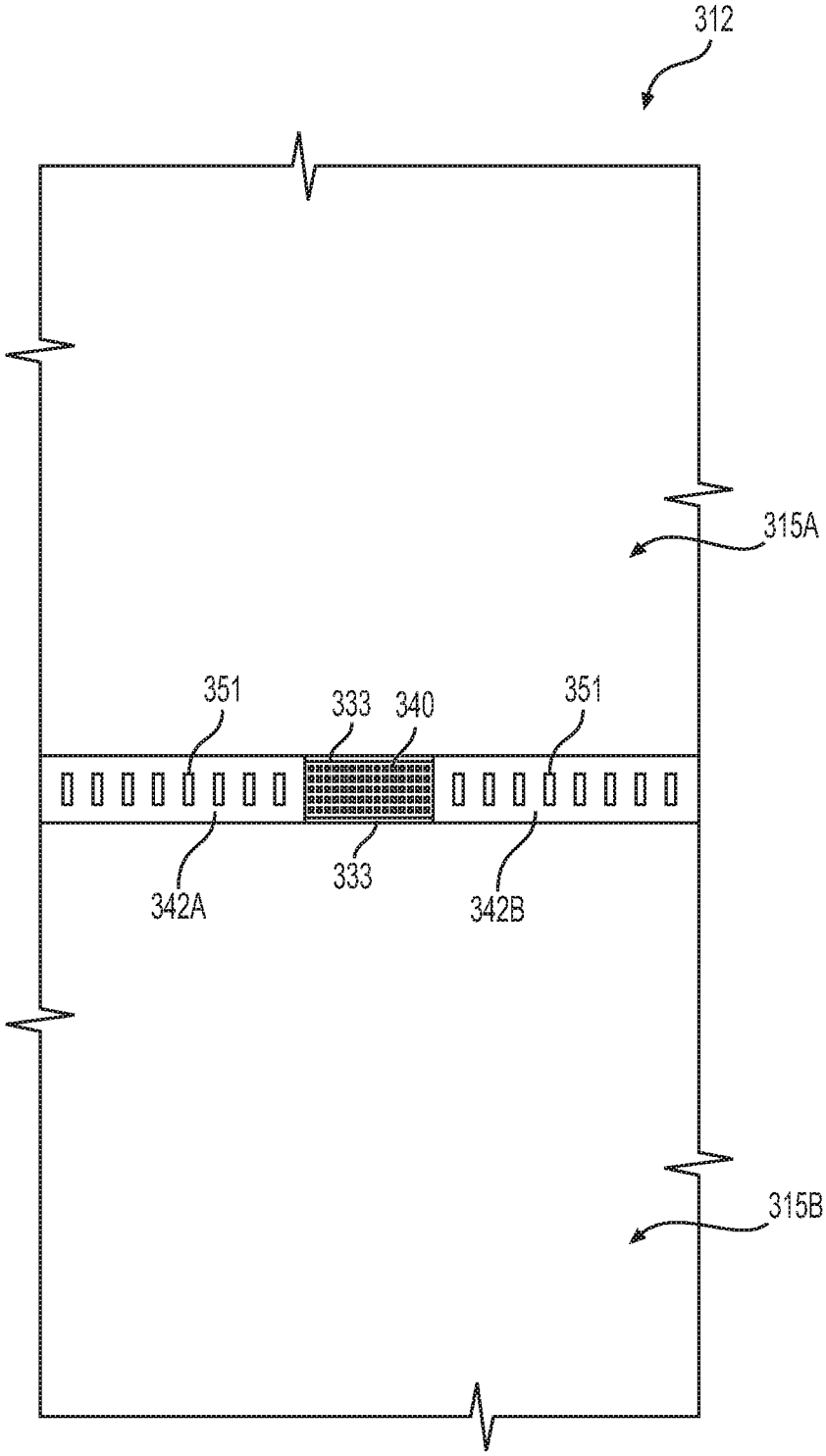
FIG. 23 is a top plan view of the fourth embodiment of the invention with flooring removed.
Figure 24:
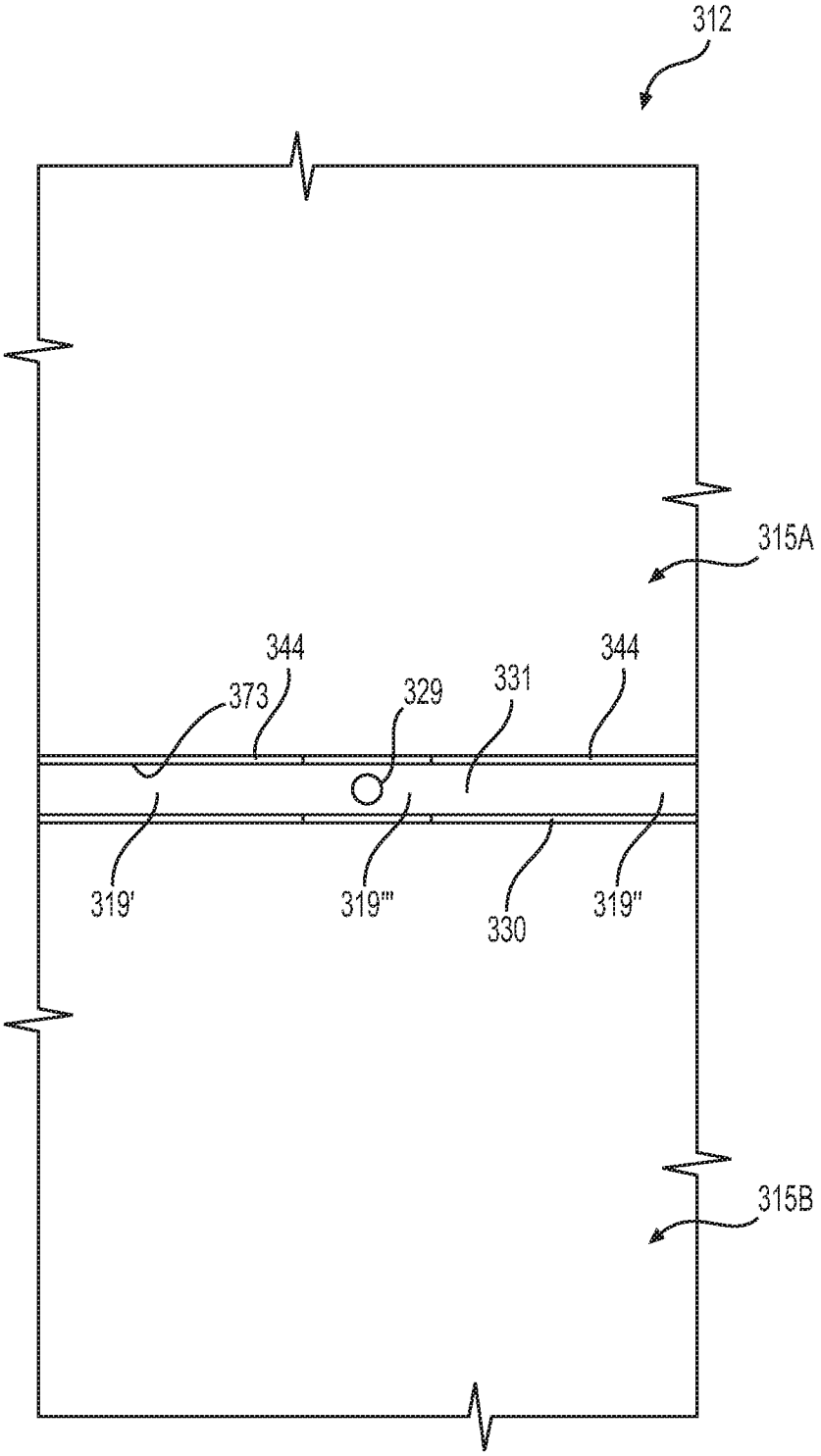
FIG. 24 is a top plan view of the fourth embodiment of the invention with trench covering structure also removed.
Figure 25:
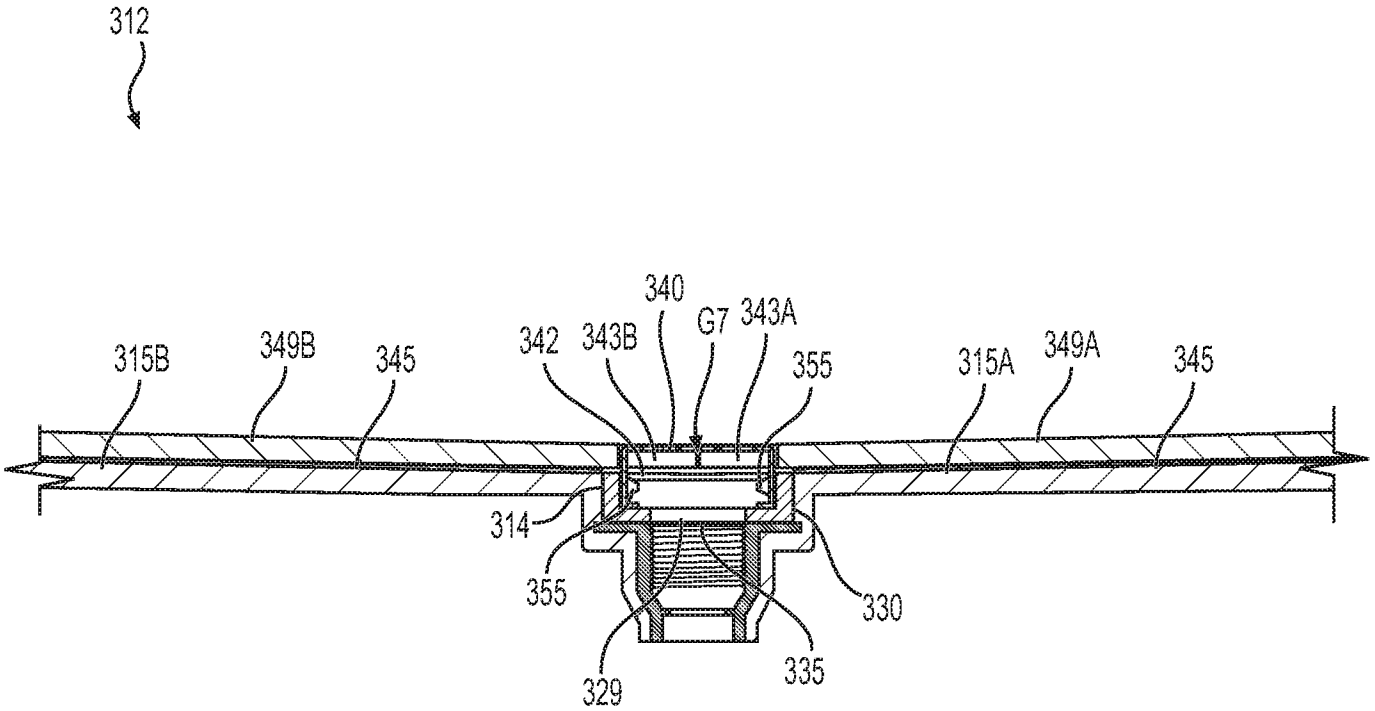
FIG. 25 is a cross sectional elevation of you taken along lines 25-25 of FIG. 22.

It can be seen, therefore, that, in some embodiments, a combination shower pan, linear drain and linear drain concealment arrangement is provided, comprised of: a prefabricated floor member 312 comprising a shower pan floor 315; a recessed linear drain 314 integrally formed within the shower pan floor 315, the trench 314 comprising upstanding trench sidewalls 319A and a trench floor 319; a first substrate drain grate 342A positioned in registry with a first portion 319' of the trench floor, a second substrate drain grate 342B positioned in registry with a second portion 319" of the trench floor, and a first removable drain grate 340 positioned in registry with a third portion 319'" of trench floor 330 (FIG. 24); a first floor covering panel 349A placed in registry with a first portion 315A of the shower pan floor, the first floor covering panel 349A defining first and second first panel edges 360A; a second floor covering panel 349B placed in registry with a second portion 315B of the shower pan floor 312, the second panel defining first and second second panel edges 360B; the first and second first panel edges 360A being spaced from the first and second second panel edges 360B, respectively, to form first and second drainage gaps G7 and G8 there between; the first substrate drain grate 342A being disposed in registry below the first drainage gap G9, and the second substrate drain grate 342B being in registry below the second drainage gap G10, when the shower pan 312 is in an in-use orientation such as that shown in FIGS. 22 and 25.

In embodiments, substrate drain panels 342 may be dispensed with, such that the sections of floor panels 349A and 349B that overhang trench 314 or liner 330 are unsupported, or are supported by structure other than said substrate panels 342.

Drainable floor members come in a wide array of shapes and sizes. The floor featured in FIGS. 22-30 is representative of a typical drainable floor configuration, and includes a trench that spans across at least a portion thereof.

Referring now to FIGS. 31-39, there is shown another embodiment in accordance with certain of the teachings of the invention. This embodiment comprises a portion of a drainable surface 412 with an integrally molded trench 414. The surface 412 is comprised of a pitched floor 415 (which is preferably planar on either side of the trench 414) defining bottom surface 416 thereof, whether with or without ribs 417, and may include such additional features as one or more curbs (not shown), one or more side splash walls (not shown), and one or more rear splash walls (not shown). Accessory features of shower pans are well known, and it is contemplated that such features may or may not be used in connection with the embodiments disclosed herein. In addition, other known accessory features (such as barrier-free entrances) may be employed without departing from the spirit and scope of the invention.

Trench 414 includes a trench floor 419 and trench sidewalls 419A.

In embodiments, a drain fixture or fitting (or which may simply be a drain aperture 429 defined by trench floor 419) is defined by and/or integrated with trench floor 419, which drain fixture or fitting 435 may be integrated during manufacture of the pan floor or the trench (which is sometimes the case for prefabricated components or completed prefabricated pans) or created or integrated/installed in situ. The location of drain fixture or aperture 435 (or drain aperture 429) relative to the pan floor 415 is usually determined by the location of the wastewater pipe (not shown) in the sub-floor.

As can be seen from FIGS. 34-36 and 39, floor 415 may be pitched or sloped toward trench 414 on each side of trench 414. A standard slope is ¼ inch per foot, although any pitch which will accomplish the task of causing liquid to drain from floor 415 (or, in embodiments, whatever covering material is situated thereon, such as floor tile panels 449A and 449B) into trench 414 is deemed to be within the scope of the invention.

Figure 35A:
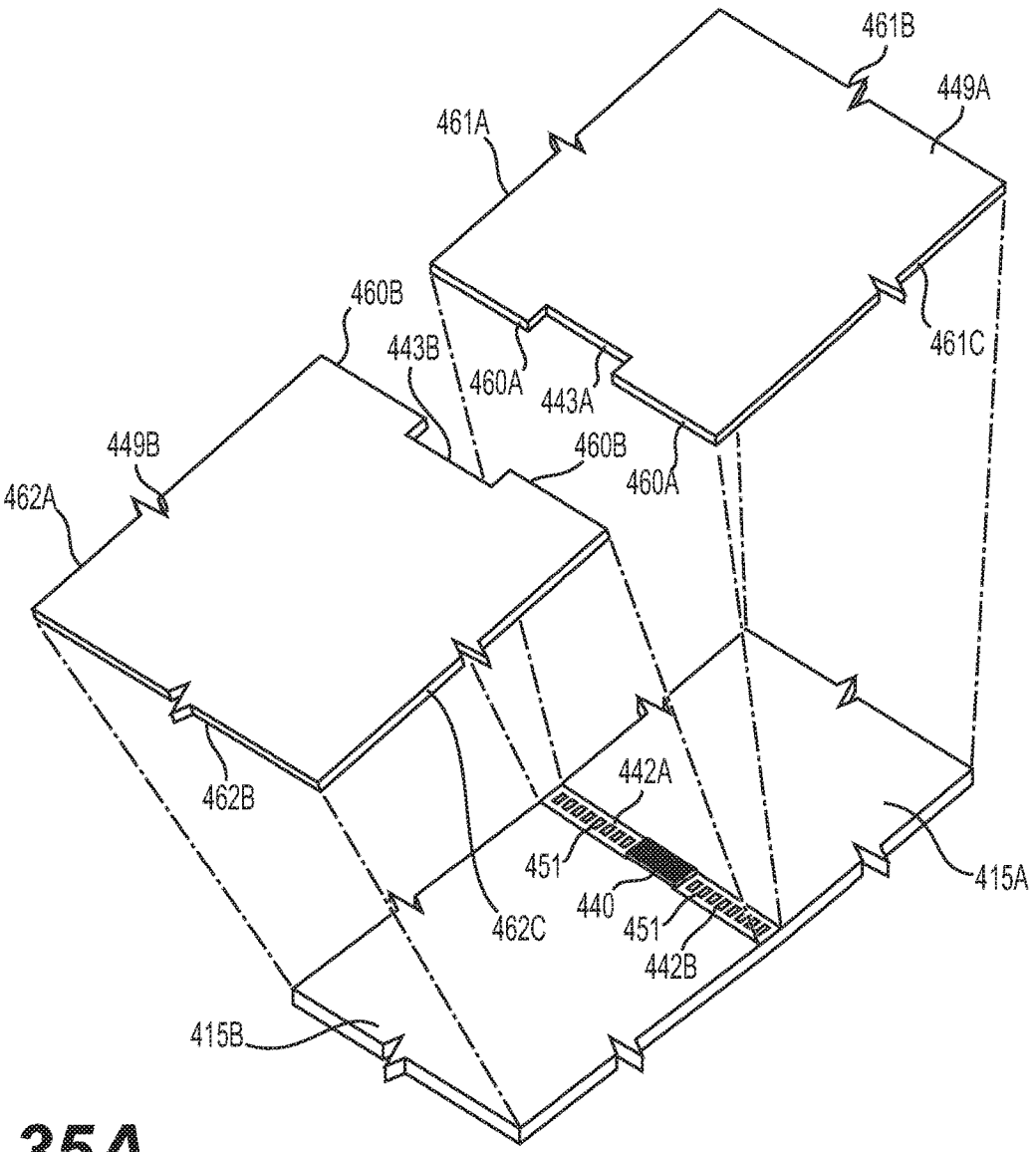
FIG. 35A is a partially exploded perspective view of the fifth embodiment of the invention.
Figure 35B:
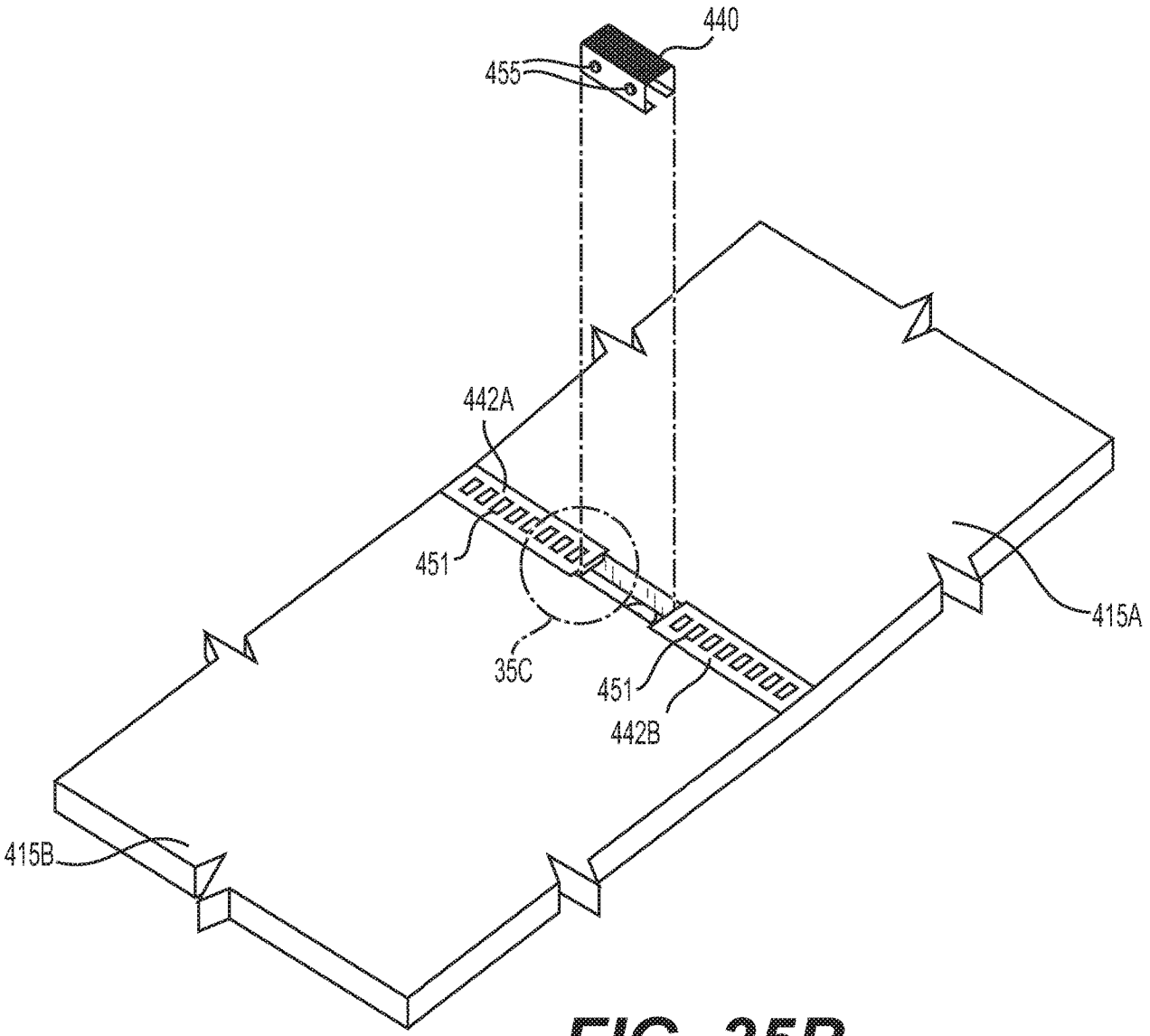
Figure 35C:
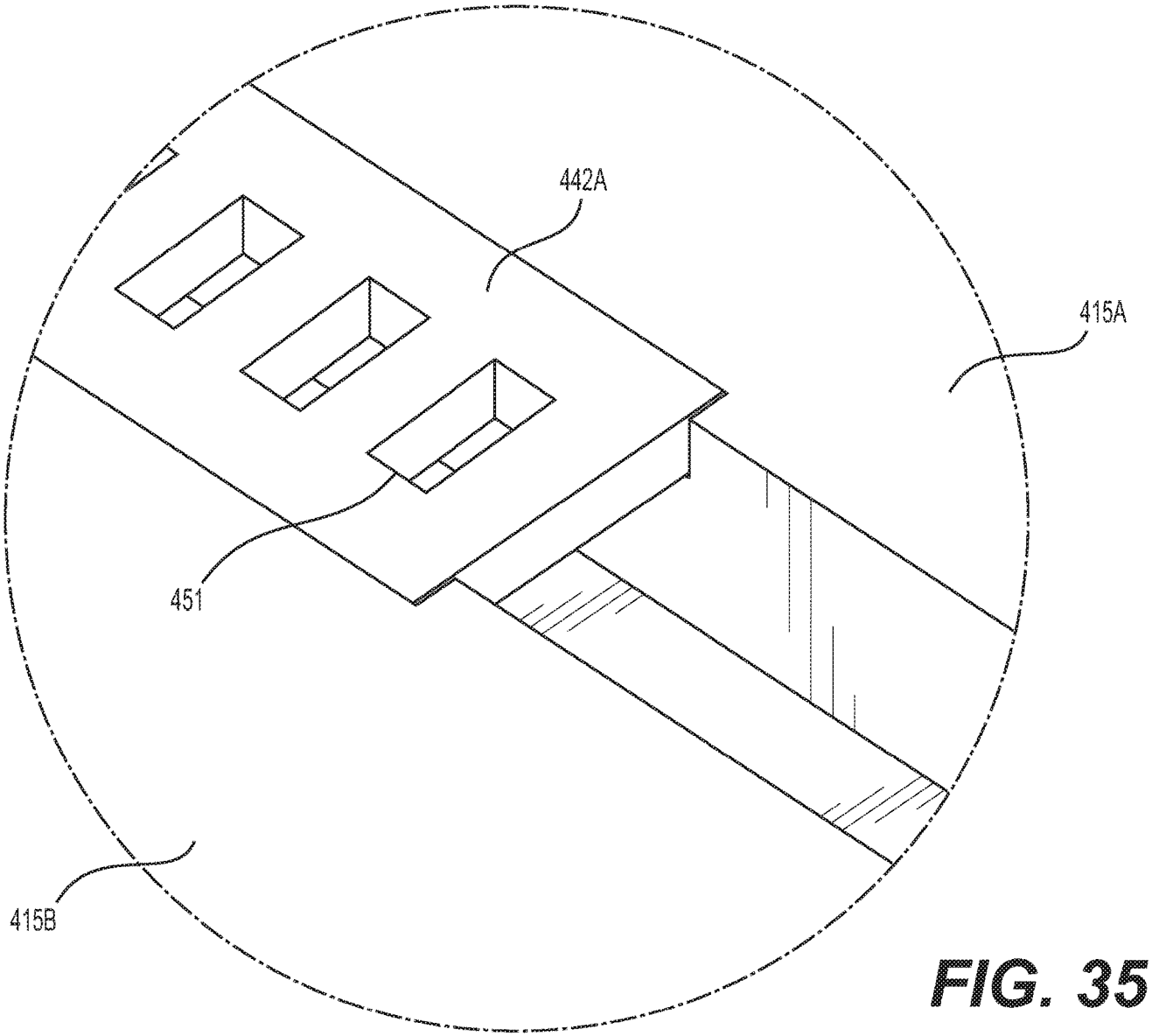
FIG. 35C is an enlargement of the area of detail shown in FIG. 35B.
Figure 38A:
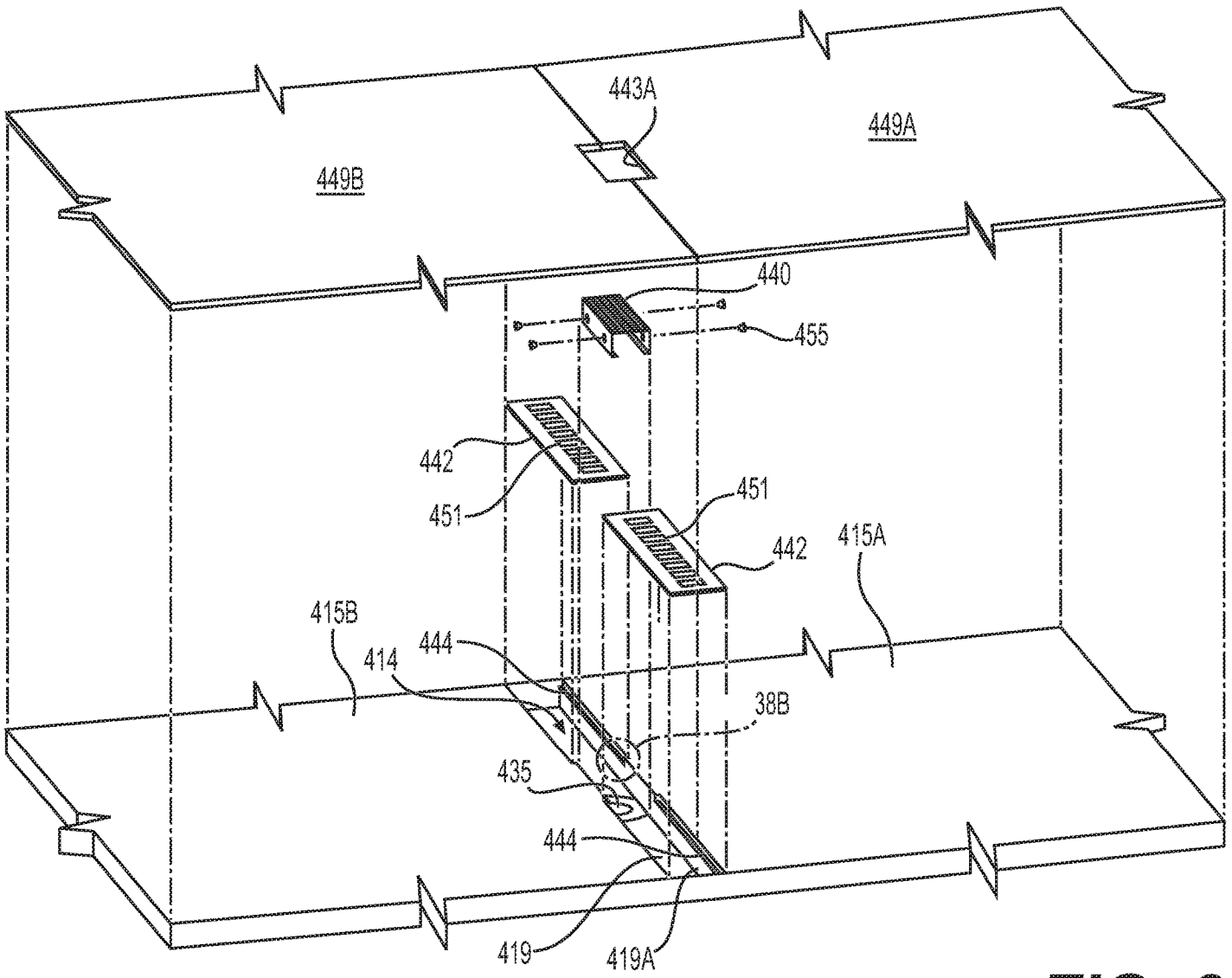
FIG. 38 is an exploded perspective view of the fifth embodiment of the invention.
Figure 38B:
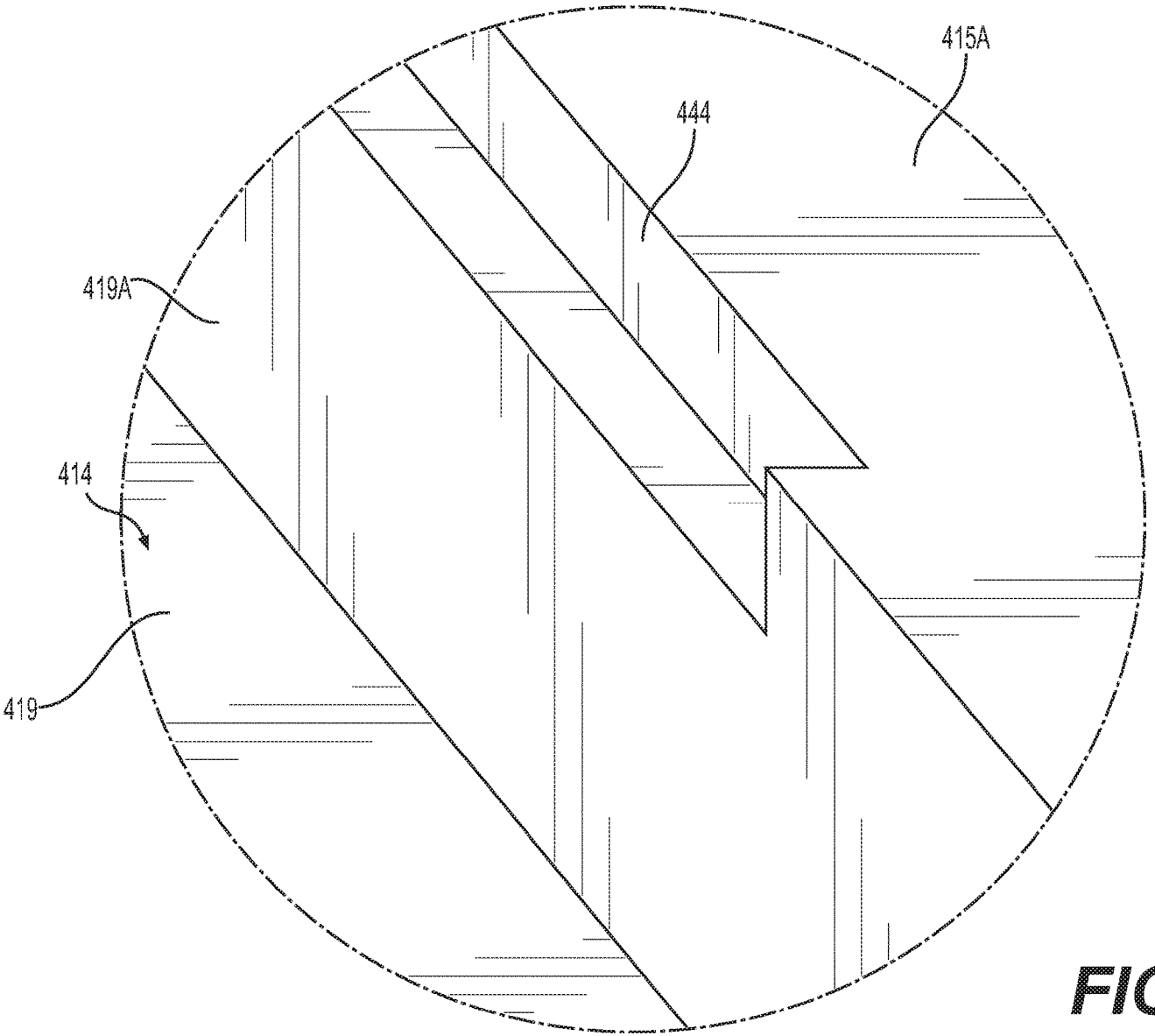
Figure 39:
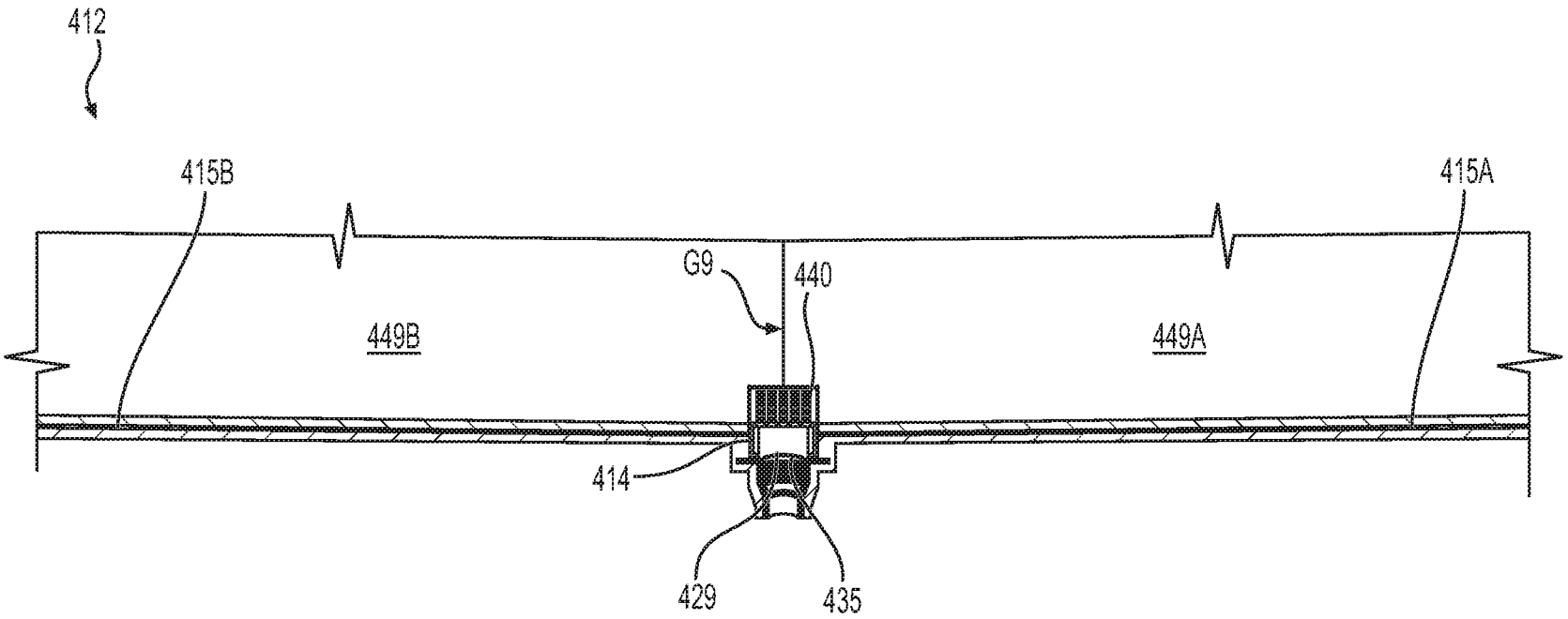
FIG. 39 is a perspective cross-sectional view of the fifth embodiment of the invention.

Trench 414 is not fitted with a trench liner. As will occur to those of skill in the art, a drain fitting such as drain fixture or aperture 435 may be used to sealingly secure the wastewater pipe (not shown) to the trench. In embodiments, such as is shown in FIGS. 35C and 38, at least a portion of the height of trench liner sidewalls 433 are slightly shorter than the height of the trench 414, for reasons to be described hereinafter.

In embodiments, an arrangement can be employed as follows: a waterproof floor member such as shower floor 415 shown in FIGS. 31-39 is provided. In this particular embodiment, a pair of symmetrical floor covering panels 449A and 449B are provided, which, when placed on pan floor sections 415A and 415B, respectively, cover essentially the entire surface area of floor 415 other than drainage gaps "G11" and "G12" created between said panels and cutouts for removable drain grates 440 to be discussed in greater detail below. Floor panels 449A and 449B may be any shower floor covering material including ceramic or porcelain tile, stone, marble, polymer-based material, acrylic, solid surface, metal, or any suitable material for covering a floor from which liquid is to drain.

When floor panels 449A and 449B are situated over floor 415, respective edges 460A and 460B thereof rest in opposed relationship to each other. Edges 460A and 460B form a pair of relatively small drainage gaps "G11" and "G12" through which water may drain into trench 414 (in applications where no trench liner is used). Cutouts 443A and 443B form a larger area into which can be placed a removable drainage grate such as grate 440. Using a removable drainage grate such as grate 440 permits access to the interior of trench 414 for purposes of cleaning and/or maintenance. Any type of cover structure for removable drain cover 440 is contemplated to be within the scope of the invention, such as apertured (a version of which is shown in FIGS. 31-39), tileable or non-tilable covers.

In order to provide added support for the portions of floor panels 449A, 449B which sit in registry with trench floor 419, and which therefore are not supported by floor 415, and/or to cover a portion of the trench 414, one or more features, such as substrate grates or panels 442A and 442B, may be used to span the open area over trench 414. In embodiments, the support panels may be one or more slotted or otherwise apertured plates, such as plates 442A and 442B shown in FIGS. 32, 34, 35, 37 and 38, or may be ribs, support struts or other supporting structure spanning across the open area over trench 414. The support substrate may also, or alternatively, take the form of columns or pillars supported on trench floor 419, although any solution which places a drainage obstruction within the trench or trench liner is less desirable.

In embodiments, and as particularly shown in FIGS. 35C and 38, at least portions of the sidewalls 419A of trench 414 where the substrate panels 442 are supported are shorter than the height of trench 414, and form one or more shoulders or ledges 444 upon which substrate panels 442 may be supported. In this way, the panels are held against transverse horizontal movement by the sidewalls 419A against which the panels 442 abut, and against vertical downward movement by shoulders 444. The shoulders 444 retain the substrate panels 442 in supported relationship over trench floor 419 while the substrate panels 442 provide support to the sections of flooring material 449A and 449B that overhang the trench 414. In embodiments, the sidewalls 419A of trench 414 may terminate at their upper ends in shoulder 444 at a position that renders the upper surfaces of substrate panels 442 coplanar with the upper surface of floor 415, or non-coplanar, depending upon the needs of the particular application. Other structure for supporting panels 442 will occur to those of skill in the art and are considered to be within the scope of the invention.

Figure 31:
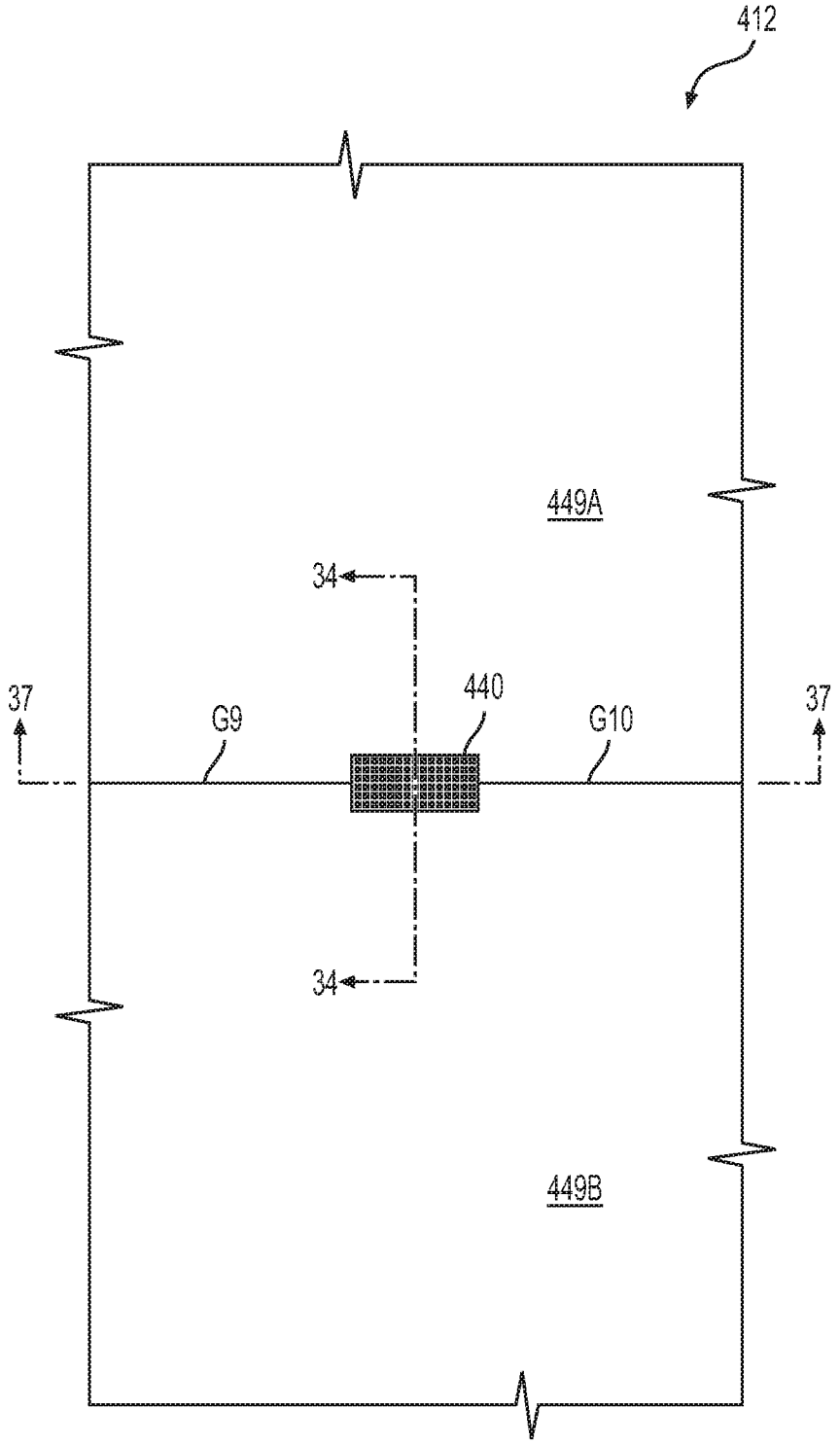
FIG. 31 is a top plan view of a fifth invention embodiment of the invention.
Figure 32:
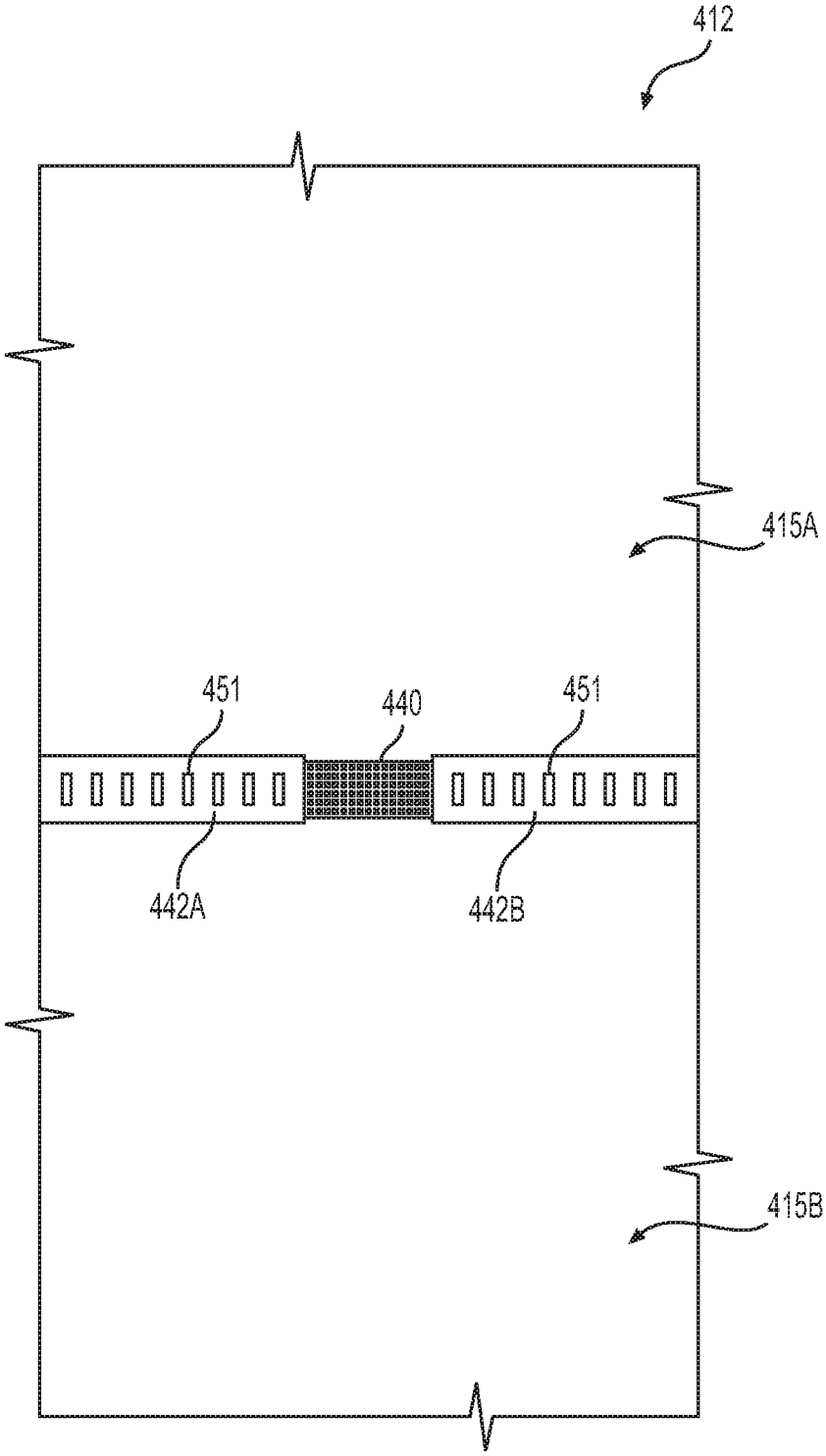
FIG. 32 is a top plan view of the fifth embodiment of the invention with flooring removed.
Figure 33:
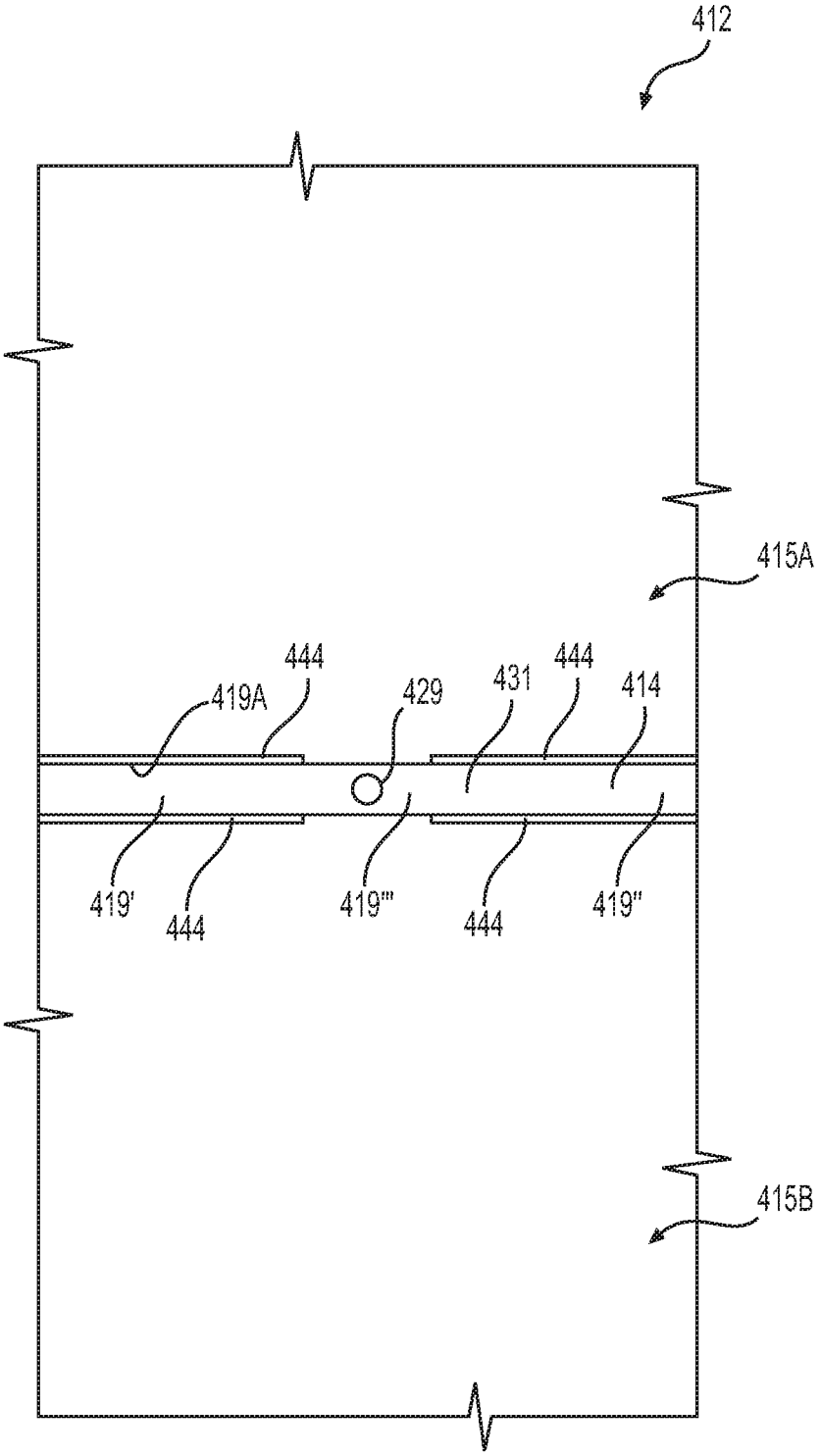
FIG. 33 is a top plan view of the fifth embodiment of the invention with dredge covering structure also removed.
Figure 34:
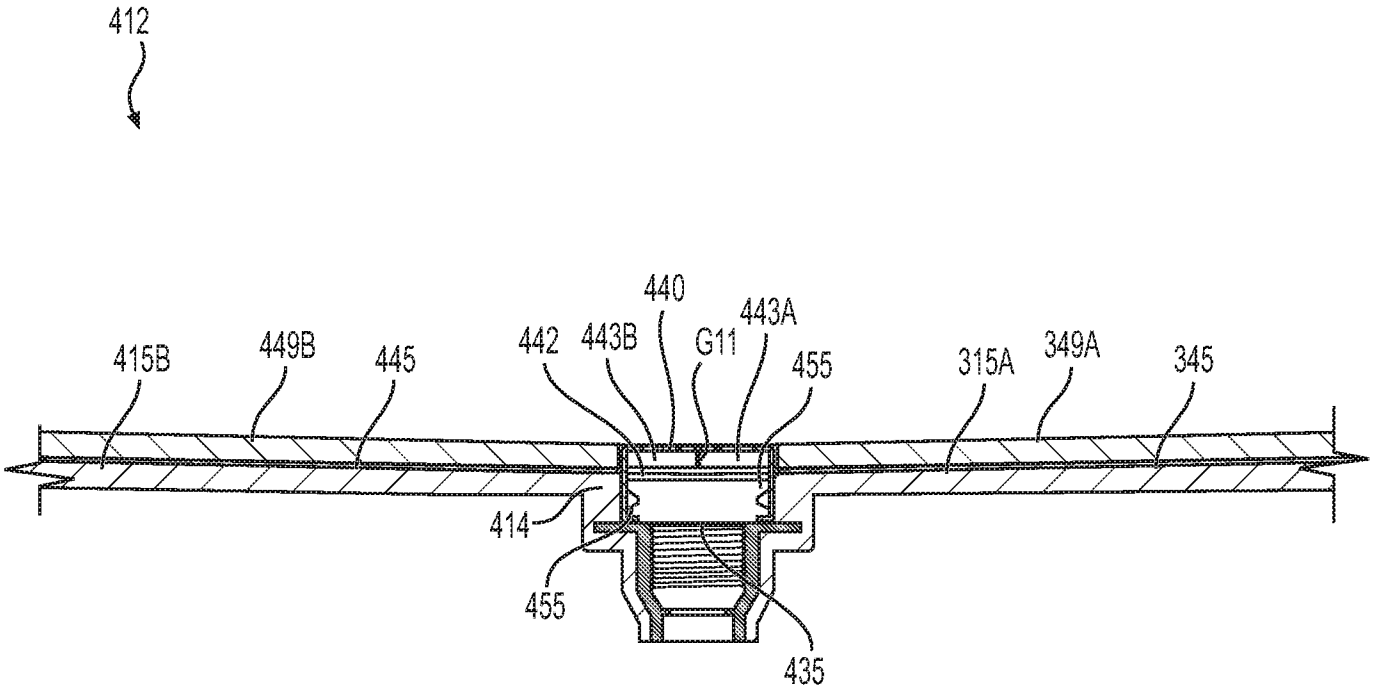
FIG. 34 is a cross-sectional elevation view taken along lines 34-34 of FIG. 31.
Figure 36:
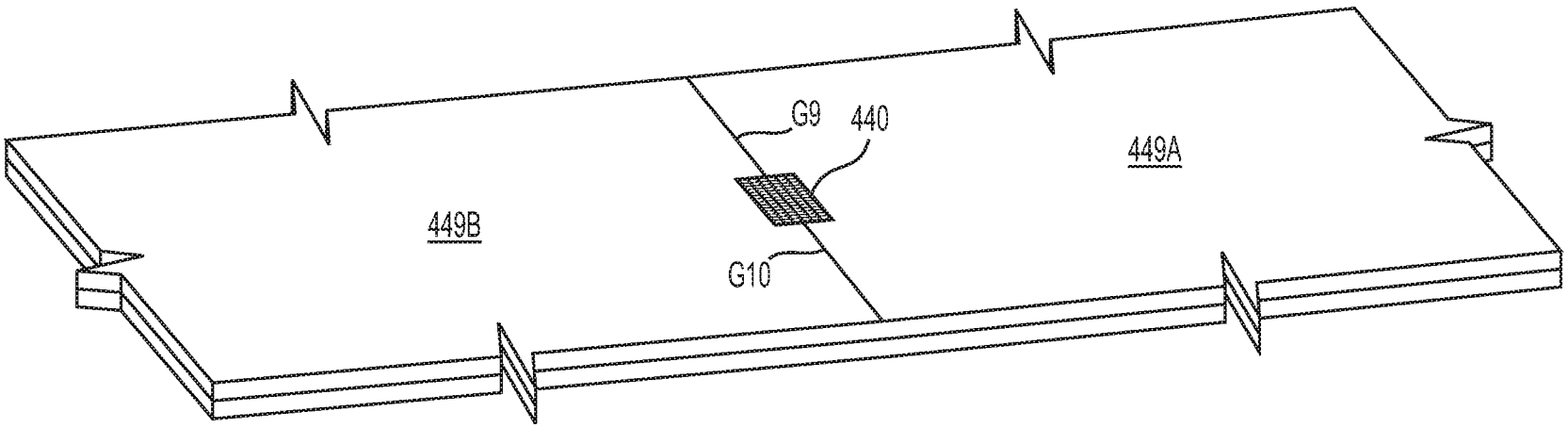
FIG. 36 is a perspective view of the fifth embodiment of the invention.
Figure 37:
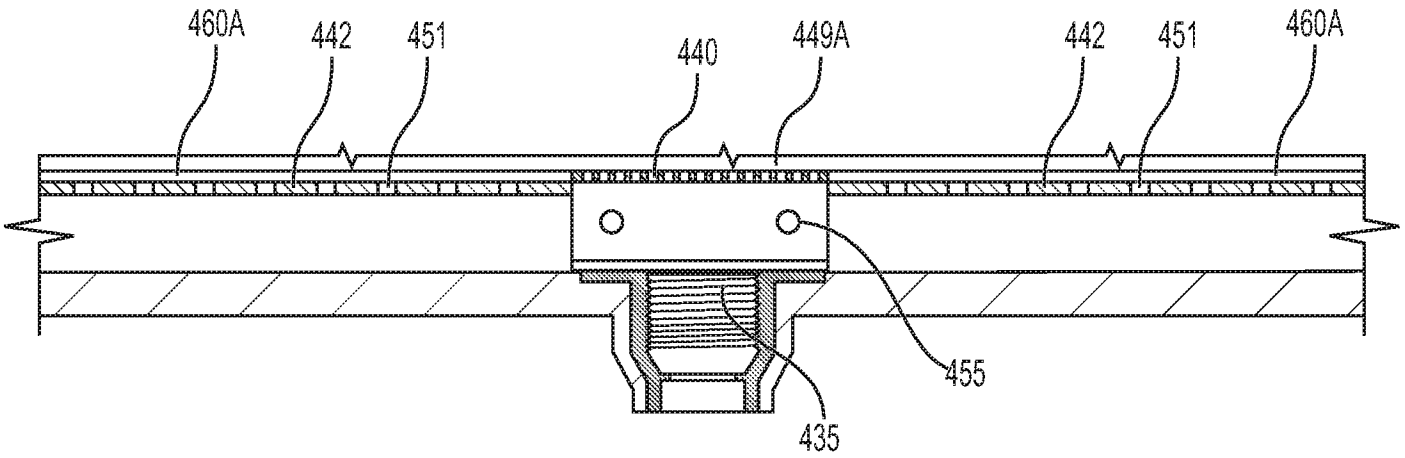
FIG. 37 is a cross-sectional elevational view of the fifth embodiment of the invention taken along line 37-37 of FIG. 31.

The first and second floor covering panels 449A, 449B, respectively, define first and second cutouts 443A, 443B to accommodate removable drain grate 440, such that, when the first and second floor covering panels 449A, 449B are associated with the floor member 415 in the manner shown in FIGS. 31, 34 and 36, the first and second cutouts 443A, 443B provide an area in which the removable drain grate 440 may be removably received. Preferably, the removable drain grate is located substantially adjacent the drain 435 to facilitate cleaning the drain or otherwise gaining access to the drain. However, the removable drain grate 440 need not necessarily be positioned adjacent to the drain 435. In some embodiments, as stated above, the upper edges 444 of side walls 419A of trench 414 are sized and shaped so that they are lower than the plane in which the adjacent portion of floor 415 resides at the transition into the trench 414, forming a shoulder 444 around a portion of the top of trench sidewalls 419A and within the opening in floor 415 formed by trench 414, as can be seen in FIGS. 35C and 38. In this way, substrate panels 442 or other support structure can be supported thereon. Then, by installing flooring material such as floor panels 449 over the substrate panels 442, the substrate panels become firmly held in place and provide support over the otherwise cantilevered sections of floor panels 449A and 449B which extend out over the opening in floor 415 formed by trench 414.

In the embodiment shown in FIGS. 31-39, although the removable drain cover 440 appears as the only drainage area for the shower, the entirety of gaps "G11" and "G12" also create significant water drainage area but do not present as areas that one would be reluctant to place one's feet on, and permit the use of smaller removable drain grate 440, which in turn results in a removable drain grate that is lighter and easier to remove and manipulate. Such innovative constructions create a unique visual effect and permit ample drainage from the shower, while simultaneously permitting a supplier of showers to offer a wide range of attractive products without having to manufacture and store unique product components for each individual offering.

It can be seen, therefore, that, in some embodiments, a combination floor member, linear drain and linear drain concealment arrangement is provided, comprised of: a shower floor comprising a floor member 415, which may or may not be bounded on one or more sides by upstanding sidewalls (not shown) and/or curb (not shown); a recessed linear drain 414 integrally formed within the floor 415, the trench 414 comprising upstanding trench sidewalls 419A and a trench floor 419; a first substrate drain grate 442A positioned in registry with a first portion 419' of the trench floor, a second substrate drain grate 442B positioned in registry with a second portion 419" of the trench floor, and a first removable drain grate 440 positioned in registry with a third portion 419'" of trench floor 430 (FIG. 33); a first floor covering panel 449A placed in registry with a first portion 415A of the shower pan floor, the first floor covering panel 449A defining first and second first panel edges 460A; a second floor covering panel 449B placed in registry with a second portion 415B of the shower pan floor 415, the second panel defining first and second second panel edges 460B; the first and second first panel edges 460A being spaced from the first and second second panel edges 460B, respectively, to form first and second drainage gaps G9 and G10 there between; the first substrate drain grate 442A being disposed in registry below the first drainage gap G11, and the second substrate drain grate 442B being in registry below the second drainage gap G12, when the shower pan 412 is in an in-use orientation such as that shown in FIGS. 31 and 36.

In embodiments, substrate panels 442 may be dispensed with, such that the sections of floor panels 449A and 449B that overhang trench 414 are unsupported or supported by structure other than said substrate panels 442.

Alternative structure to support substrate panels 42, 142, 242, 342, 442 and 542 in the desired position relative to floors 15, 115, 215, 315, 415 and 514 may be employed. FIGS. 40A-40C depict an alternative substrate support structure that can be employed with any embodiment of the invention. In this embodiment of the substrate support structure, inserts such as one or more vertically oriented support ribs 530 may be placed in trench 514. In embodiments, ribs 530 may be oriented parallel to and adjacent to the sidewalls 533 of trench 514. Rib or ribs 530 may be provided in any shape or size that will permit it or them to support substrate panels such as panels 42, 142, 242, 342, 442 and 542 in the desired position relative to floors 15, 115, 215, 315, 415 and 514. As can be seen in the rendition of support ribs 533 shown in FIGS. 40A-40C, a substrate panel support shoulder or ledge 544 may be provided so that panels 542 may be recessed relative to floor 515 in order that the upper surface of panels 542 be held at the desired height relative to floor 515. That orientation may be coplanar with the adjacent section(s) of floor 515, on non-coplanar, depending upon the needs of the particular application.

A still further implementation of the invention is shown in FIGS. 41-48. In this embodiment, the previously disclosed substrate grates 42, 142, 242, 342, 442 and 542 can be modified to comprise two or more independent panels, such as a pair of first substrate panels 642A and a pair of second substrate panels 642B, respectively adapted to be positioned on either side of trench 614, whether with a liner 630 or not. In this construction, the gaps G defined by the floor covering panel or panels (or the floor covering panels and splashwalls or curbs) permit water to flow directly through to the interior of the trench or trench liner, without impediment, and without the portions of the previously described substrate grates 42, 142, 242, 342, 442 and 542 which define the drainage slots 51 creating a source for clogging of hair and other debris present in the water which passes through the gaps G. In embodiments, panel pairs 642A and 642B are sized and shaped to be situated in or on shoulders 644 (or shoulders 44, 144, 244, 344, 444 or 544 if used in the other embodiments set forth herein) and to overhang the trench or trench liner but be spaced from one another to form gaps G13 and G14 therebetween which, preferably, reside substantially in registry with gaps G11 and G12, respectively. Substrate panel pairs 642A and 642B may be mechanically fixed in association with shoulders 644, such as by adhesive connection, or may be positioned in place and held there by flooring panels 649A and 649B (or whatever floor covering structure is used in a particular application).

Therefore, the first substrate drain grate can be viewed as the first pair of substrate panels 642A, and the second substrate drain grate can be viewed as the second pair of substrate panels 642B.

Figure 41:
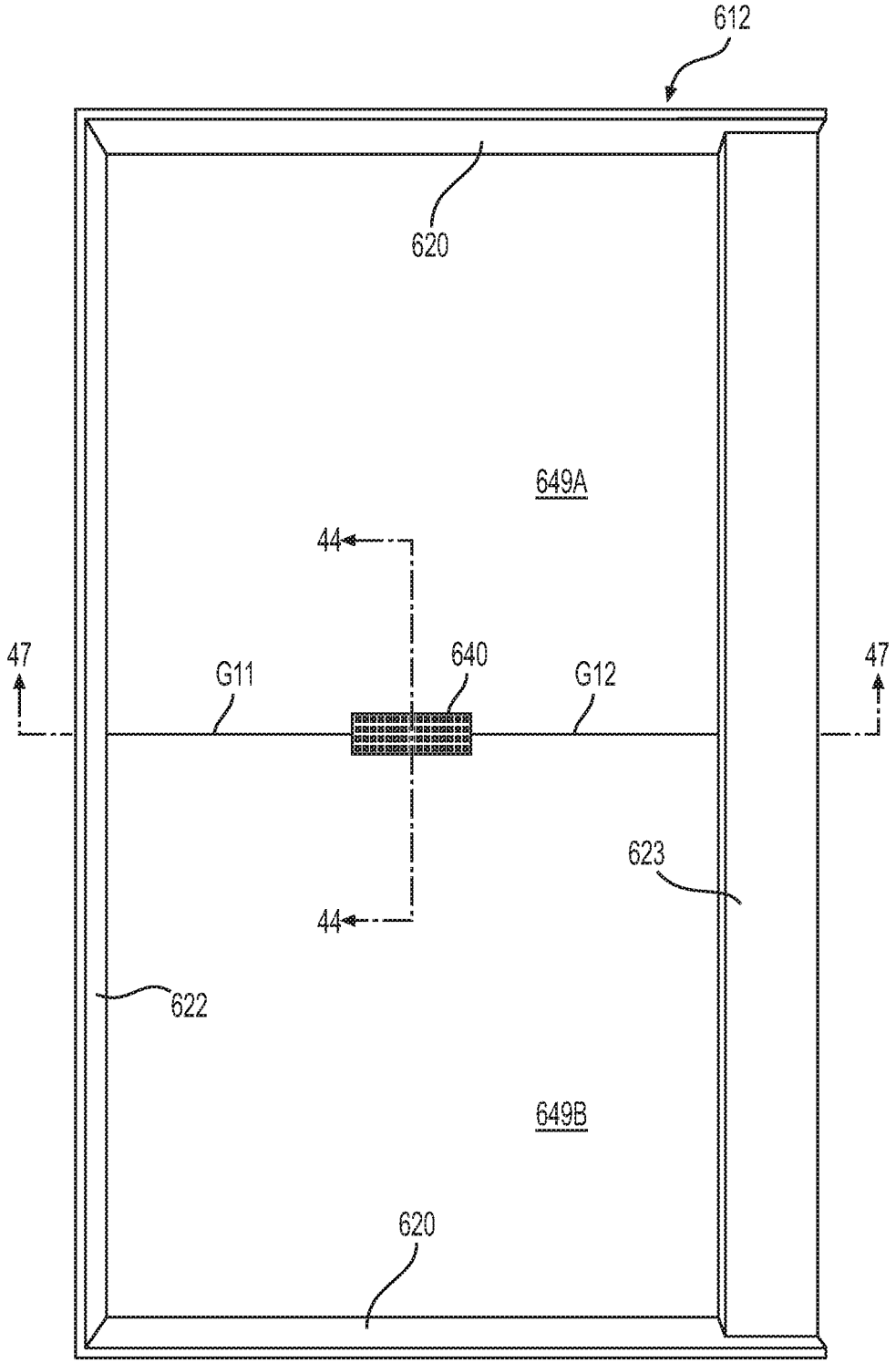
FIGS. 41-48 show an implementation of the invention with modified substrate grates.
Figure 42:
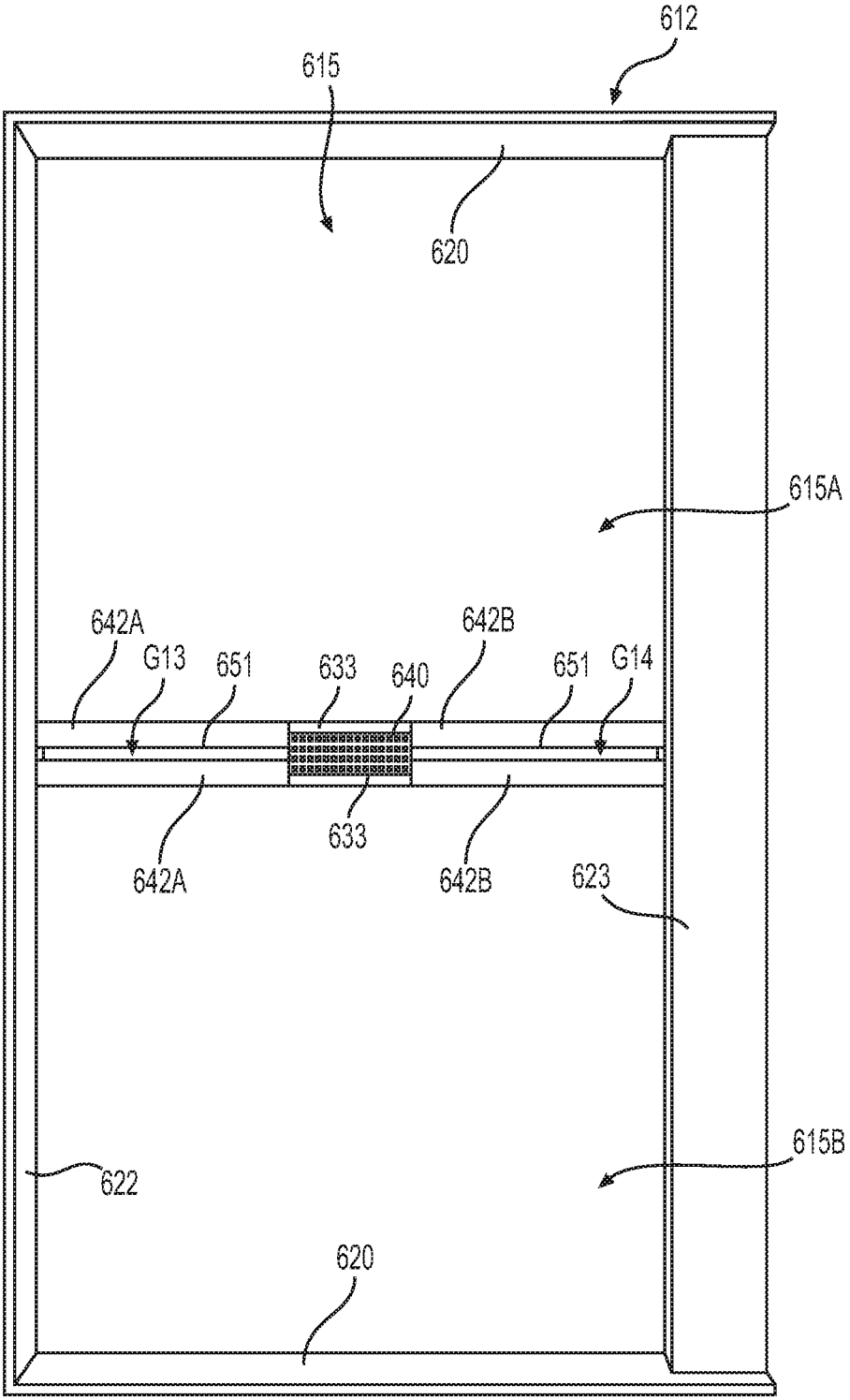
Figure 43:
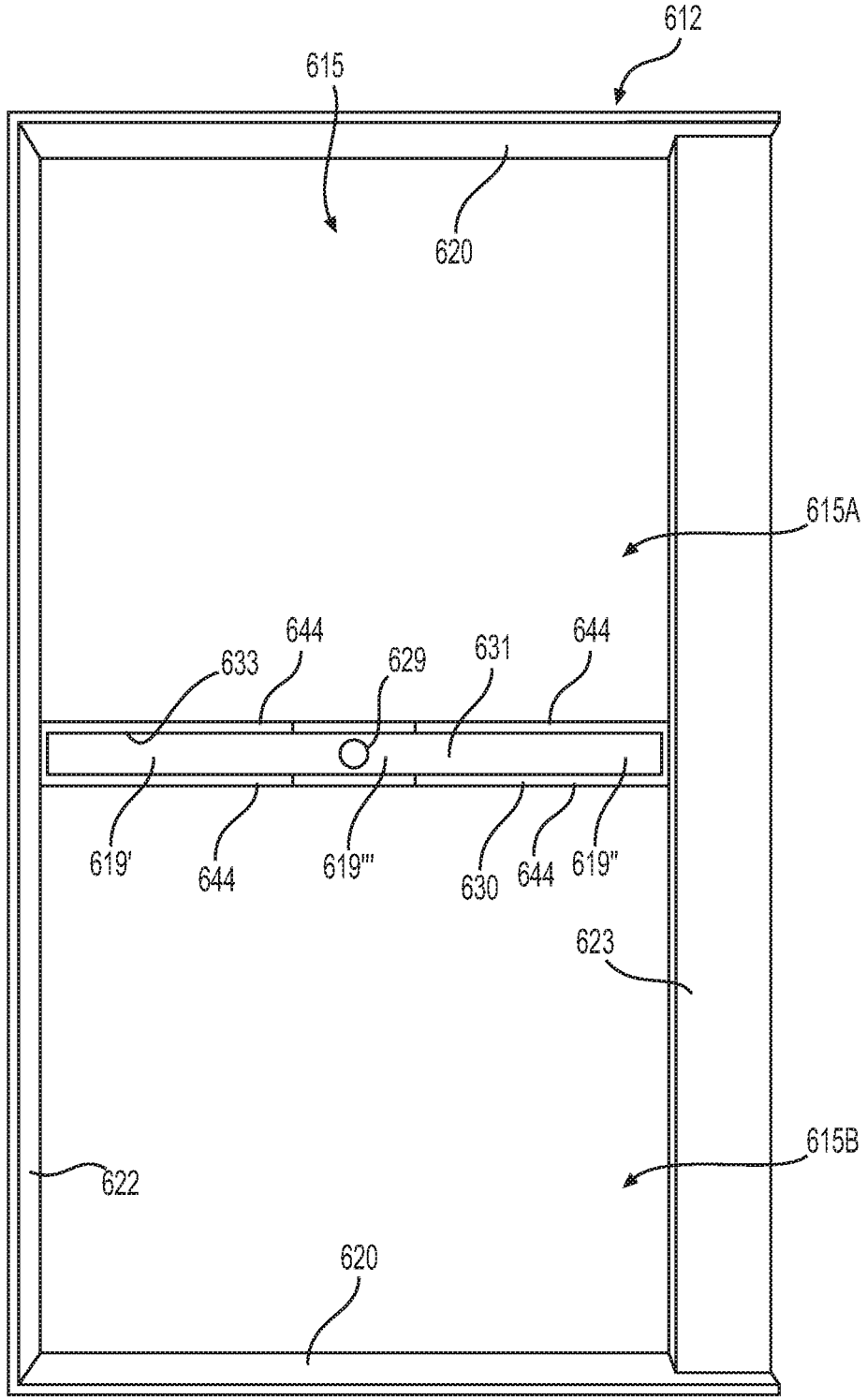
Figure 44:
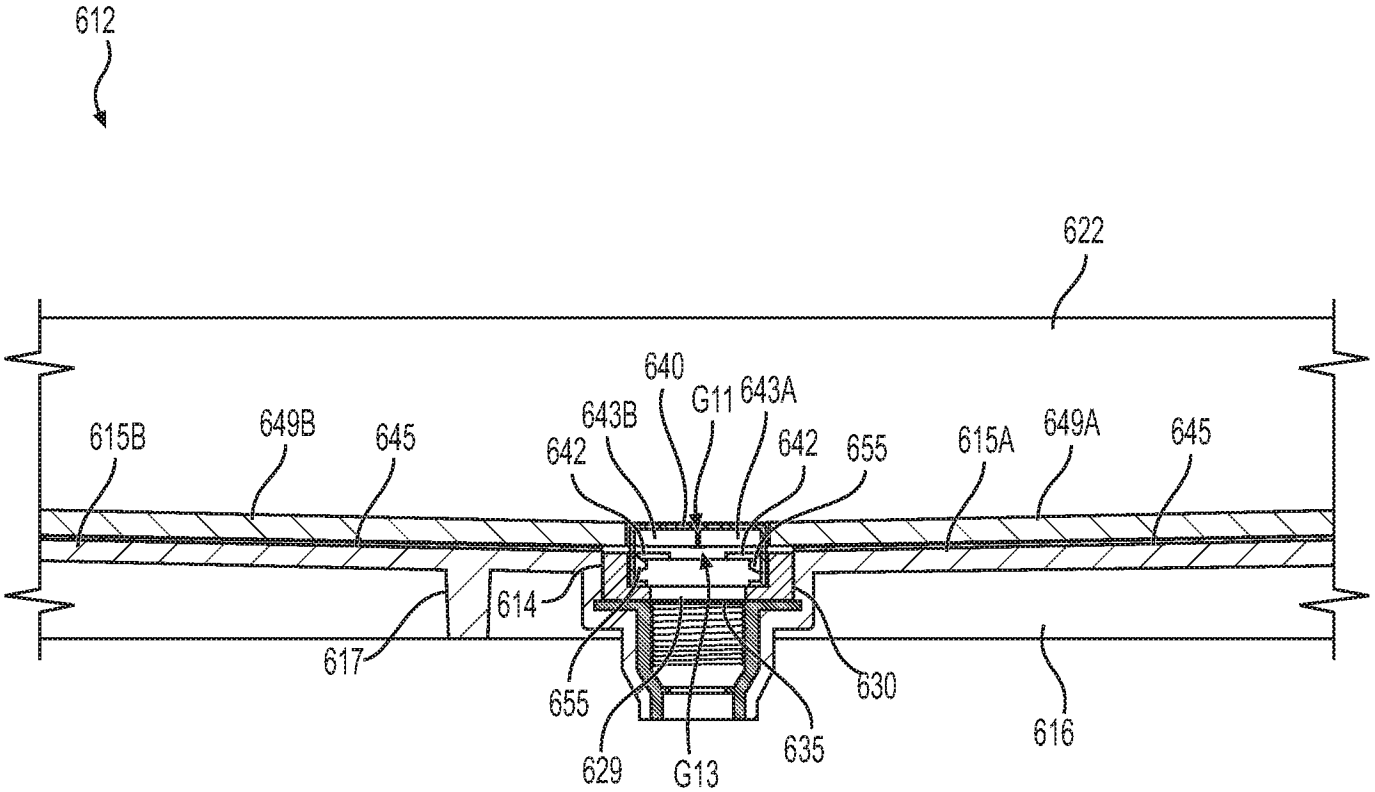
Figure 45A:
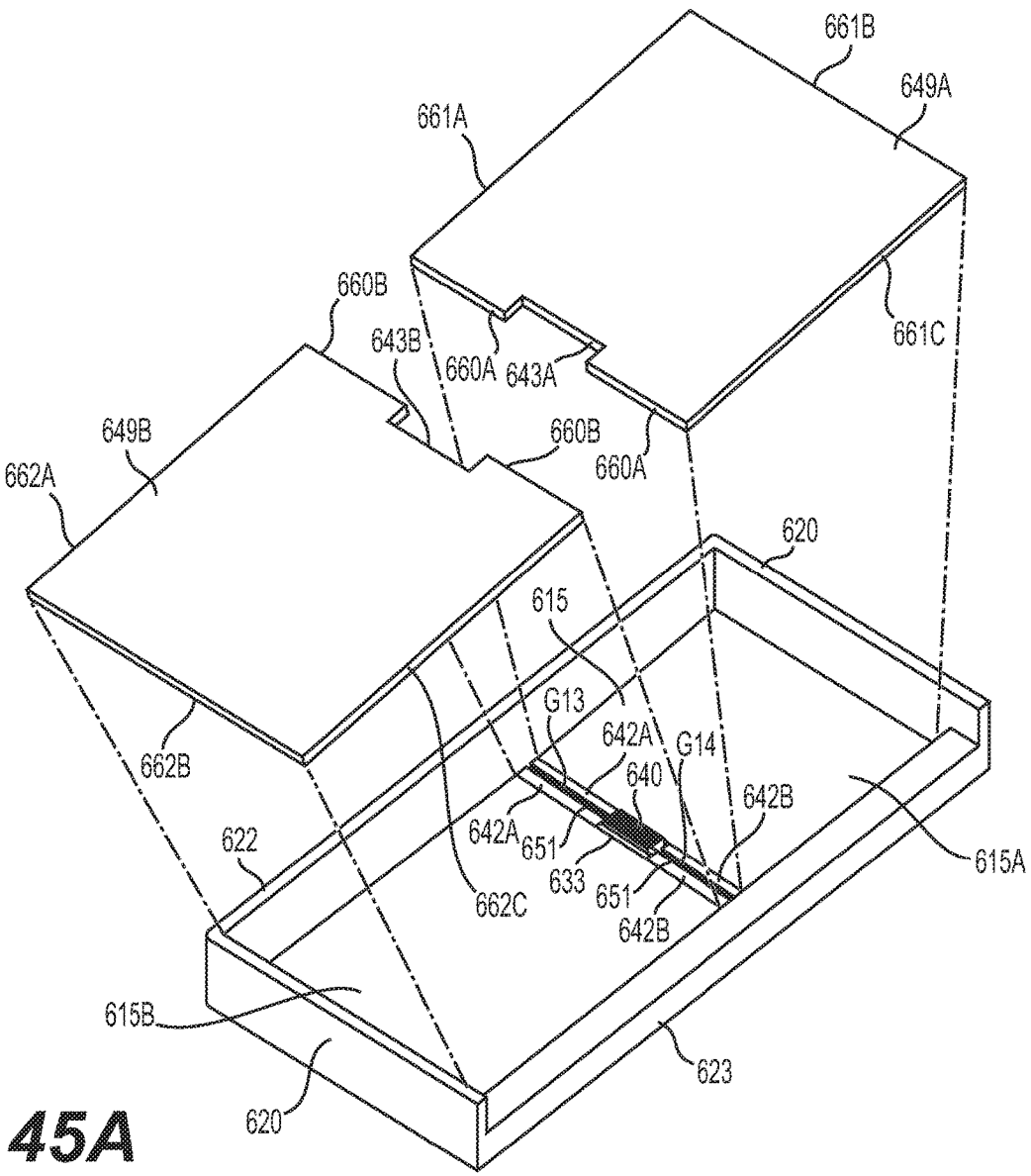
Figure 45B:
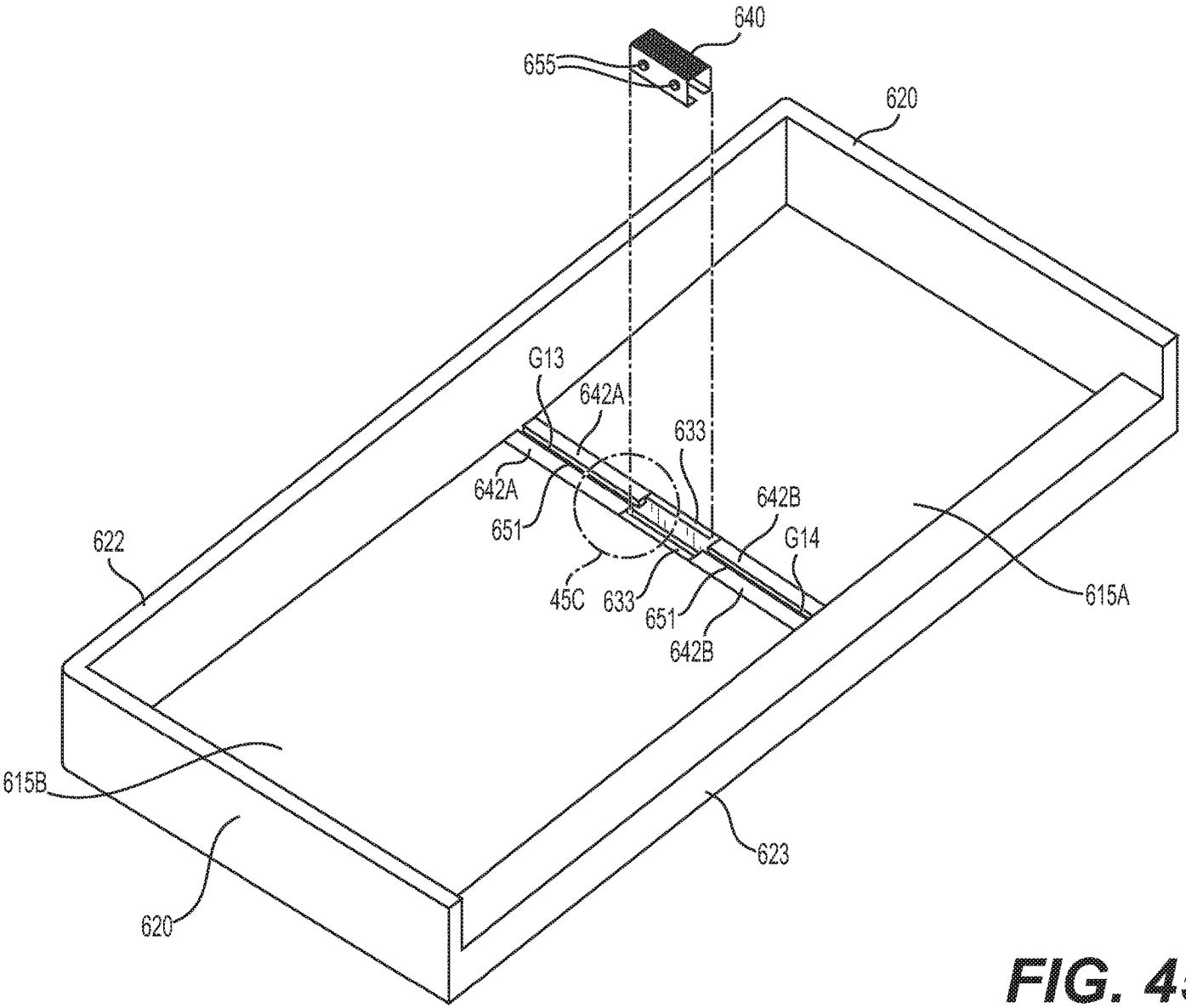
Figure 45C:
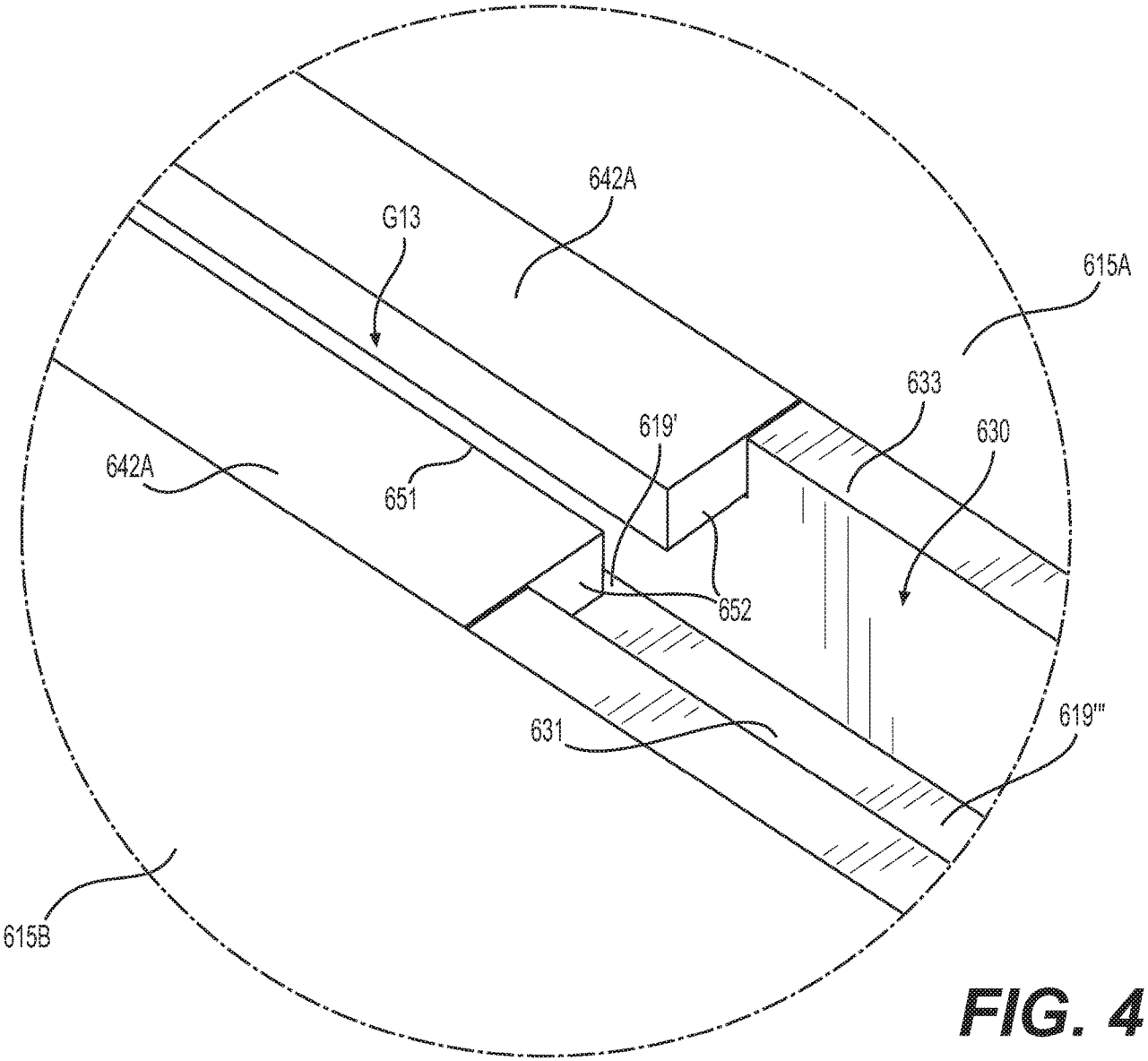
Figure 46:
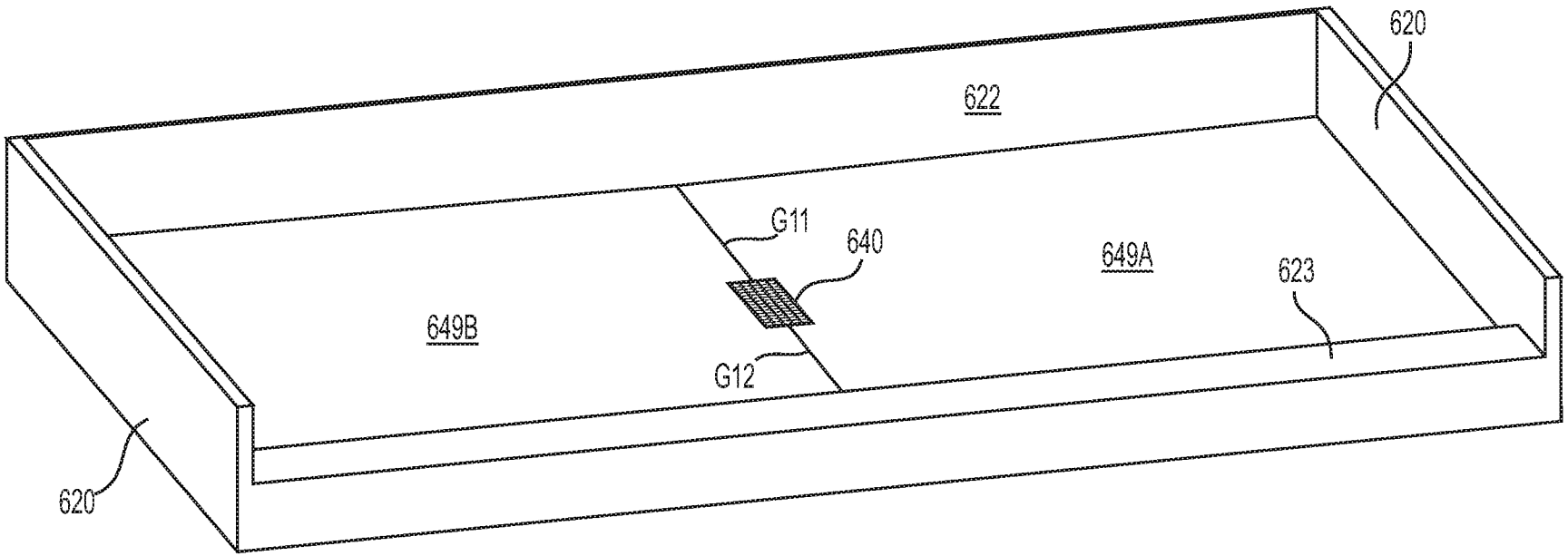
Figure 47:
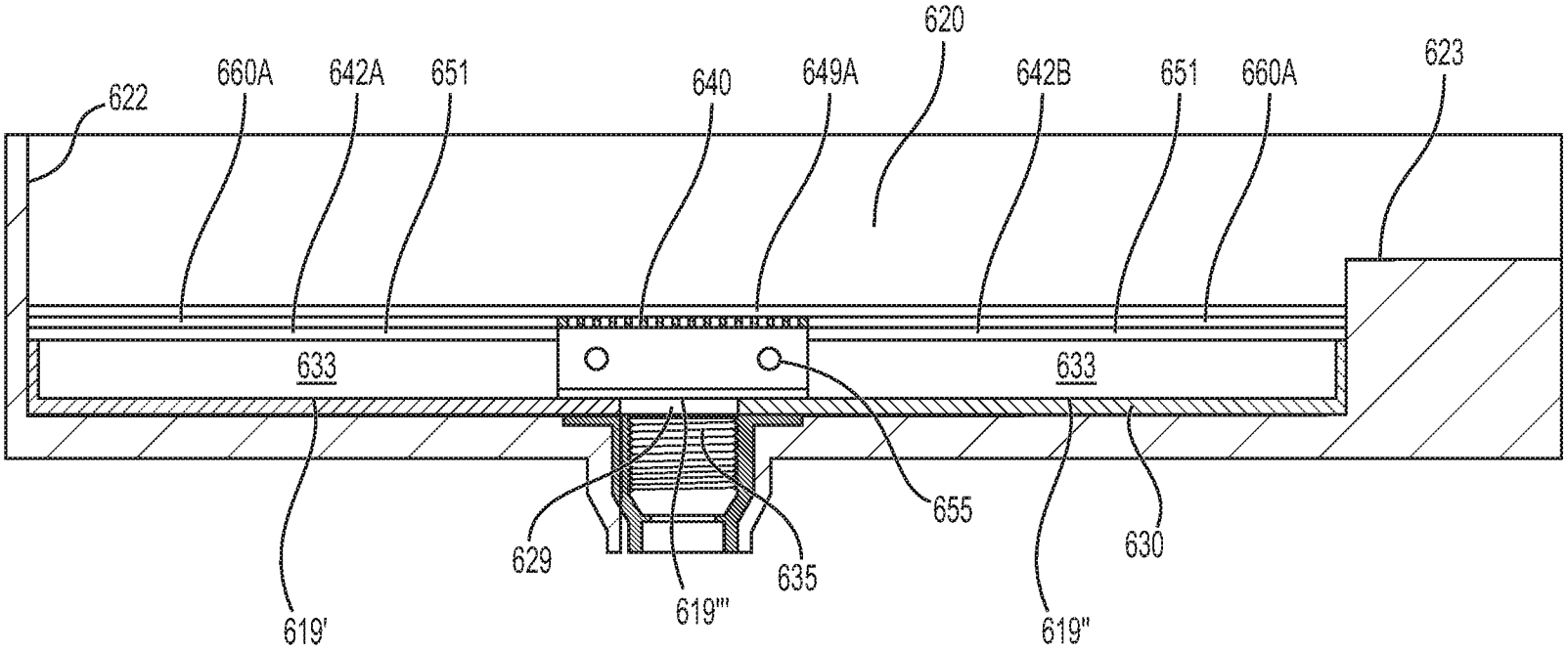
Figure 48:
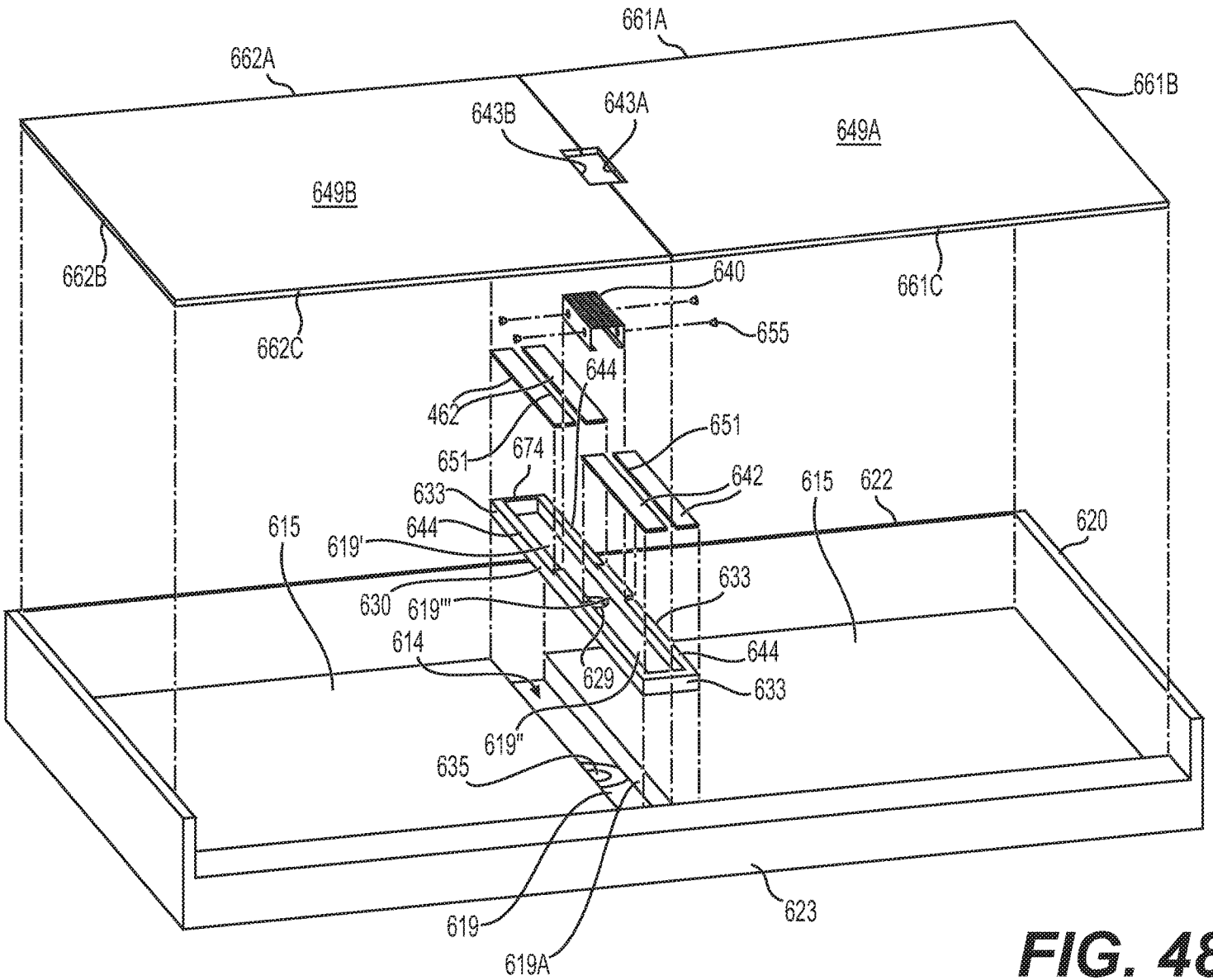

It can be seen, therefore, that, in some embodiments, a combination floor member, linear drain and linear drain concealment arrangement is provided, comprised of: a shower floor comprising a floor member 615, which may or may not be bounded on one or more sides by upstanding sidewalls (not shown) and/or curb (not shown); a recessed linear drain 614 integrally formed within the floor 615, the trench 614 comprising upstanding trench sidewalls 619A and a trench floor 619; a pair of first substrate panels 642A positioned in registry with a first portion 619' of the trench floor, a pair of second substrate panels 642B positioned in registry with a second portion 619" of the trench floor, and a first removable drain grate 640 positioned in registry with a third portion 619'" of trench floor 630 (FIG. 43); a first floor covering panel 649A placed in registry with a first portion 615A of the shower pan floor, the first floor covering panel 649A defining first and second first panel edges 660A; a second floor covering panel 649B placed in registry with a second portion 615B of the shower pan floor 615, the second panel defining first and second second panel edges 660B; the first and second first panel edges 660A being spaced from the first and second second panel edges 660B, respectively, to form first and second drainage gaps G11 and G12 there between; the pair of first substrate panels 642A defining a gap G13 therebetween which is disposed in substantial registry with the first drainage gap G11, and the pair of second substrate panels 642B defining a gap G14 therebetween which is disposed in substantial registry with the second drainage gap G12, when the shower pan 612 is in an in-use orientation such as that shown in FIGS. 41 and 46.

The concealed trenches and trench drains of this invention provide positive drainage to the trench by permanently installing floor coverings aligned with drainage holes in the substrate grates so as to provide positive drainage to the trench so that the installer or designer can now associate tile or other floor coverings including floor panels, by permanently attaching the floor covering to the top of the trench so the substrate(s) cannot be removed during normal use.

This invention applies to all shower floors, however they are made, including one or more of the following: (i) one-piece prefabricated shower pans: (ii) mud base shower pans formed in the field or factory; (iii) hot mopped shower bases formed in the field; (iv) trench drains installed in shower pans in the field or in the factory; (iv) shower trenches integrated and assembled with standard drains in the field or fabricated in the factory; and (v) one piece shower pans molded during manufacturing or fabricated and assembled, in whole or in part, in the field, with one or more of a linear drain, one or more removable drain grates, and one or more substrate drain grates.

It is to be understood that the arrangements disclosed herein are suitable for use with any drain location, even though embodiments are shown using specific drain locations. Such locations are shown for example purposes only, it being understood that my invention resides in the creation of a shower pan which employs one or more partially or fully concealed linear drains, where the floor material which covers the linear drain may be supported by a substrate or other structure for supporting the floor against the weight of a person using the shower.

What is claimed is:

1. A combination shower floor, linear drain and linear drain concealment apparatus, comprising:

a shower floor;

a recessed trench associated with the shower floor in such a manner that water draining off of the floor will drain toward the trench, the trench comprising four upstanding trench sidewalls and a trench floor;

a first substrate drain grate positioned in registry with a first portion of the trench floor, a second substrate drain grate positioned in registry with a second portion of the trench floor, and a first removable drain grate positioned in registry with a third portion of the trench floor;

a first shower floor covering panel placed in partial registry with a first portion of the shower floor, the first panel defining first and second first panel edges;

a second shower floor covering panel placed in partial registry with a second portion of the shower floor, the second panel defining first and second second panel edges;

the first and second first panel edges being spaced from the first and second second panel edges, respectively, to form first and second drainage gaps there between;

the first substrate drain grate being in registry with the first drainage gap, and the second substrate drain grate being in registry with the second drainage gap, when the first and second shower floor covering panels are installed over the shower floor.

2. The shower floor, linear drain and linear drain concealment apparatus of claim 1, wherein the first and second floor covering panels are mechanically secured to the shower floor.

3. The shower floor, linear drain and linear drain concealment apparatus of claim 1, further comprising at least one aperture defined by the first substrate drain grate, and at least one aperture defined by the second substrate drain grate.

4. The shower floor, linear drain and linear drain concealment apparatus of claim 3, wherein the at least one aperture defined by the first substrate drain grate lies at least partially in registry with the first drainage gap.

5. The shower floor, linear drain and linear drain concealment apparatus of claim 3, wherein the at least one aperture defined by the second substrate drain grate lies at least partially in registry with the second drainage gap.

6. The shower floor, linear drain and linear drain concealment apparatus of claim 3, wherein the at least one aperture in the first and second substrate drain grates is rectangular in shape.

7. The shower floor, linear drain and linear drain concealment apparatus of claim 3, wherein the at least one aperture in the first and second substrate drain grates is circular in shape.

8. The shower floor, linear drain and linear drain concealment apparatus of claim 3, wherein the at least one aperture in the first and second substrate drain grates is oval in shape.

9. The shower floor, linear drain and linear drain concealment apparatus of claim 1, wherein the first and second floor covering panels define first and second removable drain grate cutouts, respectively, such that, when the first and second floor covering panels are associated with the shower floor, the first and second cutouts provide an area in which the removable drain grate may be removably received.

10. The shower pan, linear drain and linear drain concealment apparatus of claim 1, further comprising second and third removable drain grates positioned in registry with fourth and fifth portions of the trench floor, and second and third removable drain grate cutouts defined, respectively, by the first and second floor covering panels, the second and third removable drain grate cutouts providing second and third areas in which the second and third removable drain grates may be removably received.

11. The shower pan, linear drain and linear drain concealment apparatus of claim 10, further comprising third and fourth substrate drain grates substantially coextensive with and in registry with third and fourth drainage gaps, respectively, defined the first and second floor covering panels.

12. The shower floor, linear drain and linear drain concealment apparatus of claim 10, wherein the second removable drain grate lies at least in partial registry with a wastewater drain pipe associated with a subfloor of a building in which the apparatus is installed.

13. The shower floor, linear drain and linear drain concealment apparatus of claim 10, wherein the third removable drain grate lies at least in partial registry with a wastewater drain pipe associated with a subfloor of a building in which the apparatus is installed.

14. The shower floor, linear drain and linear drain concealment apparatus of claim 10, wherein the second removable drain grate lies adjacent the second and third substrate drain grates.

15. The shower floor, linear drain and linear drain concealment apparatus of claim 10, wherein the third removable drain grate lies adjacent the third and fourth substrate drain grates.

16. The shower floor, linear drain and linear drain concealment apparatus of claim 10, wherein there are no obstructions to drainage of water associated with the trench floor.

17. The shower floor, linear drain and linear drain concealment apparatus of claim 10, wherein a bottom surface of the first, second and third substrate drain grates are spaced from the trench floor by a distance which is greater than or equal to 1/32 of an inch.

18. The shower floor, linear drain and linear drain concealment apparatus of claim 10, wherein the shower floor adjacent the trench defines a recessed shoulder on which the first, second, third and fourth substrate drain grates rest.

19. The shower floor, linear drain and linear drain concealment apparatus of claim 10, further comprising a trench liner residing within the trench, the trench liner including upstanding sidewalls having a height which is less than a height of the trench sidewalls, thereby forming a shoulder on which the first, second, third and fourth substrate drain grates rest.

20. The shower floor, linear drain and linear drain concealment apparatus of claim 1, wherein the first removable drain grate lies at least in partial registry with a wastewater drain pipe associated with a subfloor of a building in which the apparatus is installed.

21. The shower floor, linear drain and linear drain concealment apparatus of claim 1, wherein the first removable drain grate lies adjacent the first and second substrate drain grates.

22. The shower floor, linear drain and linear drain concealment apparatus of claim 1, wherein there are no obstructions to drainage of water associated with the trench floor.

23. The shower floor, linear drain and linear drain concealment apparatus of claim 1, wherein a bottom surface of the first substrate drain grate is spaced from the trench floor by a distance which is greater than or equal to 1/32 of an inch.

24. The shower floor, linear drain and linear drain concealment apparatus of claim 1, wherein the shower floor adjacent the trench defines a recessed shoulder on which the first and second substrate drain grates rest.

25. The shower floor, linear drain and linear drain concealment apparatus of claim 1, further comprising a trench liner residing within the trench, the trench liner including upstanding sidewalls having a height which is less than a height of the trench sidewalls, thereby forming a shoulder on which the first and second substrate drain grates rest.

26. A combination shower pan floor, linear drain and linear drain concealment arrangement, comprised of: a shower pan comprising a shower pan floor, bounded on one or more sides by one or more upstanding sidewalls; a recessed trench integrally formed within the shower pan floor, the trench comprising upstanding trench sidewalls and a trench floor; a first substrate drain grate positioned in registry with a first portion the trench floor, a second substrate drain grate positioned in registry with a second portion of the trench floor, and a first removable drain grate positioned in registry with a third portion of trench floor; a first floor covering panel placed in registry with a first portion of the shower pan floor, the first floor covering panel defining first and second first panel edges; a second floor covering panel placed in registry with a second portion of the shower pan floor, the second panel defining first and second second panel edges; the first and second first panel edges being spaced from the first and second second panel edges, respectively, to form first and second drainage gaps there between; the first substrate drain grate being disposed in registry below the first drainage gap, and the second substrate drain grate being in registry below the second drainage gap, when the shower pan is in an in-use orientation.

27. The shower pan, linear drain and linear drain concealment apparatus of claim 26, further comprising second and third removable drain grates positioned in registry with fourth and fifth portions of the trench floor, and second and third removable drain grate cutouts defined, respectively, by the first and second floor covering panels, the second and third removable drain grate cutouts providing second and third areas in which the second and third removable drain grates may be removably received.

28. The shower pan, linear drain and linear drain concealment apparatus of claim 27, further comprising third and fourth substrate drain grates substantially coextensive with and in registry with third and fourth drainage gaps, respectively, defined by the first and second floor covering panels.

29. A combination mud based shower floor, linear drain and linear drain concealment arrangement, comprised of: a mud based shower floor; a recessed trench associated with the shower floor, the trench comprising upstanding trench sidewalls and a trench floor; a first substrate drain grate positioned in registry with a first portion the trench floor, a second substrate drain grate positioned in registry with a second portion of the trench floor, and a first removable drain grate positioned in registry with a third portion of trench floor; a first floor covering panel placed in registry with a first portion of the shower floor, the first floor covering panel defining first and second first panel edges; a second floor covering panel placed in registry with a second portion of the shower floor, the second panel defining first and second second panel edges; the first and second first panel edges being spaced from the first and second second panel edges, respectively, to form first and second drainage gaps there between; the first substrate drain grate being disposed in registry below the first drainage gap, and the second substrate drain grate being disposed in registry below the second drainage gap, when the first and second floor covering panels are installed over the shower floor.

30. The mud based shower floor, linear drain and linear drain concealment apparatus of claim 29, further comprising second and third removable drain grates positioned in registry with fourth and fifth portions of the trench floor, and second and third removable drain grate cutouts defined, respectively, by the first and second floor covering panels, the second and third removable drain grate cutouts providing second and third areas in which the second and third removable drain grates may be removably received.

31. The shower pan, linear drain and linear drain concealment apparatus of claim 30, further comprising third and fourth substrate drain grates substantially coextensive with and in registry with third and fourth drainage gaps, respectively, defined by the first and second floor covering panels.

* * * * *